US012486092B2

(12) United States Patent
Thompson et al.

(10) Patent No.: US 12,486,092 B2
(45) Date of Patent: Dec. 2, 2025

(54) CARRIER FOR CONTAINERS

(71) Applicant: Graphic Packaging International, LLC, Atlanta, GA (US)

(72) Inventors: Jon Thompson, Bristol (GB); Anna Maria Gonzalez Manzano, Igualada (ES); Raymond R. Spivey, Sr., Mableton, GA (US); Jean-Manuel Gomes, Rockmart, GA (US); John Murdick Holley, Jr., Lawrenceville, GA (US); Matthew R. Kearns, Woodstock, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 19/057,430

(22) Filed: Feb. 19, 2025

(65) Prior Publication Data

US 2025/0187805 A1 Jun. 12, 2025

Related U.S. Application Data

(63) Continuation of application No. 18/535,165, filed on Dec. 11, 2023, which is a continuation-in-part of (Continued)

(51) Int. Cl.
*B65D 71/46* (2006.01)

(52) U.S. Cl.
CPC .... *B65D 71/46* (2013.01); *B65D 2571/00154* (2013.01); *B65D 2571/00265* (2013.01); (Continued)

(58) Field of Classification Search
CPC ..... B65D 71/44; B65D 71/46; B65D 71/48; B65D 2571/00154; B65D 2571/00265; (Continued)

(56) References Cited

U.S. PATENT DOCUMENTS 1,527,399 A 2/1925 Davidson
2,289,859 A 7/1942 Arthur
(Continued)

FOREIGN PATENT DOCUMENTS

AT 399701 B 7/1995
AU 2009200835 A1 9/2009
(Continued)

OTHER PUBLICATIONS

"Florida brewery unveils six-pack rings that spare sea turtles, not snare them," by Thomas Leavy, CBSNews.com. Date posted: May 24, 2018. Site visited: Sep. 12, 2022. Available online: https://www.cbsnews.com/news/ florida-saltwater-brewery-non-plastic-six-pack-rings-spare-sea-turtles/ (Year: 2018).
(Continued)

*Primary Examiner* — Bryon P Gehman
(74) *Attorney, Agent, or Firm* — James F. Vaughan; FisherBroyles, LLC

(57) ABSTRACT

A carrier for holding a plurality of containers, the carrier includes a front portion, the front portion including a portion of at least one attachment panel for at least partially receiving a respective container of the plurality of containers, a back portion, the back portion including a portion of the at least one attachment panel for at least partially receiving a respective container of the plurality of containers, and a reinforcement portion extending from the front portion to the back portion for reinforcing the carrier.

6 Claims, 29 Drawing Sheets

Related U.S. Application Data application No. 17/835,127, filed on Jun. 8, 2022, now Pat. No. 11,840,387.

(60) Provisional application No. 63/537,328, filed on Sep. 8, 2023, provisional application No. 63/532,527, filed on Aug. 14, 2023, provisional application No. 63/208,568, filed on Jun. 9, 2021.

(52) U.S. Cl.
CPC ..... *B65D 2571/0029* (2013.01); *B65D 2571/0066* (2013.01); *B65D 2571/00716* (2013.01); *B65D 2571/00839* (2013.01)

(58) Field of Classification Search
CPC .... B65D 2571/0029; B65D 2571/0066; B65D 2571/00716; B65D 2571/00839
USPC ..... 206/145, 147, 148, 151, 153, 158, 161; 294/87.2
See application file for complete search history.

(56) References Cited

U.S. PATENT DOCUMENTS 2,320,440 A 6/1943 Kruea
2,331,038 A 10/1943 Meller
2,397,376 A 3/1946 Caldwell
2,397,716 A 4/1946 Wendler
2,522,950 A 9/1950 Keith
2,594,376 A 4/1952 Arneson
2,594,377 A 4/1952 Arneson
2,737,326 A 3/1956 Toensmeier
2,798,603 A 7/1957 Grinspoon
2,814,385 A 11/1957 Stone
2,823,062 A 2/1958 Toensmeier
2,877,894 A 3/1959 Forrer
2,929,181 A 3/1960 Poupitch
2,936,070 A 5/1960 Poupitch
2,950,041 A 8/1960 Stone
2,965,410 A 12/1960 Hughes
3,001,647 A 9/1961 Liss
3,005,654 A 10/1961 Stone et al.
3,046,711 A 7/1962 Harrison
3,061,141 A 10/1962 Cote
3,066,795 A 12/1962 Mansfield
3,094,210 A 6/1963 Van Der Berg
3,099,475 A 7/1963 Manizza
3,118,537 A 1/1964 Copping
3,128,034 A 4/1964 Weiss
3,137,109 A 6/1964 Rapata
3,146,885 A 9/1964 Grantham
3,156,358 A 11/1964 Randrup
RE25,781 E 5/1965 Akiereb
3,200,944 A 8/1965 Rapata
3,223,308 A 12/1965 Weiss
3,245,711 A 4/1966 Dantoin
3,257,066 A 6/1966 Williams
3,281,180 A 10/1966 Spery
3,302,784 A 2/1967 Copping
3,310,334 A 3/1967 Murphy
3,317,234 A 5/1967 Burford
3,387,879 A 6/1968 Wood
3,404,912 A 10/1968 Watts
3,410,596 A 11/1968 Slevin, Jr.
3,432,202 A 3/1969 Ebelhardt
3,463,535 A 8/1969 Beart
3,515,272 A 6/1970 Ga
3,528,697 A 9/1970 Wood
3,587,847 A 6/1971 Graser
3,601,253 A 8/1971 Poupitch
3,601,439 A 8/1971 Poupitch
3,612,266 A 10/1971 Graser
D222,579 S 11/1971 Oglesbee
3,627,121 A 12/1971 Deasy
3,640,448 A 2/1972 Wood
3,653,503 A 4/1972 Arneson
3,653,504 A 4/1972 Saumsiegle
3,664,497 A 5/1972 Mascia
3,693,787 A 9/1972 Duerr
3,698,550 A 10/1972 Graser
3,701,416 A 10/1972 Lawrence
3,722,945 A 3/1973 Wood
3,726,558 A 4/1973 Klygis
3,734,278 A 5/1973 Kerrigan
3,764,001 A * 10/1973 Graser ..... B65D 71/48 206/148
3,876,066 A 4/1975 Klygis
3,897,873 A 8/1975 Graser
3,924,739 A 12/1975 Gravesteijn
3,942,631 A 3/1976 Sutherland et al.
4,029,204 A 6/1977 Manizza
4,078,357 A 3/1978 Ida
4,111,298 A 9/1978 Mascia
4,120,396 A 10/1978 Mascia
4,136,772 A 1/1979 Mascia
4,155,502 A 5/1979 Forte
4,190,149 A 2/1980 Oliff et al.
4,192,540 A 3/1980 Oliff
D257,001 S 9/1980 Oliff
4,244,617 A 1/1981 Manizza
4,273,273 A 6/1981 Zenri
4,304,329 A 12/1981 Graser
D265,292 S 7/1982 Killy
4,339,032 A 7/1982 Wood
D265,979 S 8/1982 Arfert
4,372,599 A 2/1983 Kiedaisch et al.
4,378,879 A 4/1983 Killy
4,382,505 A 5/1983 Sutherland et al.
4,441,611 A 4/1984 Sommariva
4,453,630 A 6/1984 Helms
4,471,870 A 9/1984 Uhlig
4,518,081 A 5/1985 de Larosiere
4,523,676 A 6/1985 Barrash
D294,331 S 2/1988 Panazzolo
4,736,977 A 4/1988 Killy
4,784,266 A 11/1988 Chaussadas
D304,017 S 10/1989 Oliff
4,911,288 A 3/1990 Dantoin, Jr.
4,911,289 A 3/1990 Bird
4,974,726 A 12/1990 Klygis et al.
5,002,225 A 3/1991 Bienaime
5,065,862 A 11/1991 Mousseau
5,103,971 A 4/1992 Schuster
5,125,506 A 6/1992 Galbierz et al.
5,135,104 A 8/1992 Jorba
5,139,147 A 8/1992 Sutherland
D329,807 S 9/1992 Heider
5,186,321 A 2/1993 Fadus
5,188,225 A 2/1993 Jorba
5,193,673 A 3/1993 Rathbone et al.
5,201,412 A 4/1993 Schuster et al.
5,230,425 A 7/1993 Edqvist et al.
5,246,113 A 9/1993 Schuster
5,263,299 A 11/1993 Galbierz et al.
5,267,644 A 12/1993 Tsao
5,282,348 A 2/1994 Dampier et al.
5,285,892 A 2/1994 Adami
5,297,673 A 3/1994 Sutherland
5,310,050 A 5/1994 Sutherland
5,310,051 A 5/1994 Sutherland
5,314,224 A 5/1994 Bates
5,318,178 A 6/1994 Davies et al.
5,320,216 A 6/1994 Pangborn
5,323,895 A 6/1994 Sutherland et al.
5,328,024 A 7/1994 Sutherland
5,335,774 A 8/1994 Ganz
5,351,815 A 10/1994 Fogle et al.
5,351,816 A 10/1994 Sutherland et al.
5,351,817 A 10/1994 Sutherland
5,355,999 A 10/1994 Sutherland
5,360,104 A 11/1994 Sutherland
5,390,784 A 2/1995 Sutherland
5,407,065 A 4/1995 Sutherland
5,415,278 A 5/1995 Sutherland

(56) References Cited

U.S. PATENT DOCUMENTS 5,425,446 A 6/1995 Weaver
5,443,153 A 8/1995 Sutherland
5,445,262 A 8/1995 Sutherland
5,452,799 A 9/1995 Sutherland
5,469,687 A 11/1995 Olson
5,474,172 A 12/1995 Zavatone et al.
5,484,053 A 1/1996 Harris
5,485,914 A 1/1996 Martin
5,487,464 A 1/1996 Galbierz et al.
5,490,593 A 2/1996 Gordon et al.
5,503,267 A 4/1996 Sutherland
5,520,283 A 5/1996 Sutherland
5,524,756 A 6/1996 Sutherland
5,551,566 A 9/1996 Sutherland
5,553,704 A 9/1996 Gordon et al.
5,553,705 A 9/1996 Bakx
5,573,111 A 11/1996 Gordon
5,590,776 A 1/1997 Galbierz
5,593,027 A 1/1997 Sutherland
5,609,247 A 3/1997 Appleton
5,609,251 A 3/1997 Harris
5,609,379 A 3/1997 Harrelson
5,627,150 A 5/1997 Peterson
5,639,137 A 6/1997 Bakx
5,682,982 A 11/1997 Stonehouse
5,706,936 A 1/1998 Bernstein
5,711,419 A 1/1998 Beales et al.
5,718,330 A 2/1998 Auffret et al.
5,735,394 A 4/1998 Harrelson
5,746,310 A 5/1998 Slomski
5,762,193 A 6/1998 Marco
5,791,463 A 8/1998 Negelen
5,791,464 A 8/1998 Galbierz et al.
5,816,391 A 10/1998 Harris
5,845,776 A 12/1998 Galbierz et al.
5,878,876 A 3/1999 Galbierz et al.
5,960,945 A 10/1999 Sutherland
6,039,181 A 3/2000 Whiteside
6,059,099 A 5/2000 Galbierz
6,082,532 A 7/2000 Miess
6,145,656 A 11/2000 Marco
6,168,012 B1 1/2001 Galbierz
6,293,392 B1 9/2001 Galbierz
6,315,111 B1 11/2001 Sutherland
6,394,272 B1 5/2002 Domansky
6,896,130 B2 5/2005 Theelen
D506,925 S 7/2005 Plumer
7,011,209 B2 3/2006 Sutherland et al.
7,690,507 B2 4/2010 Sutherland
7,721,878 B2 5/2010 Requena
7,762,397 B2 7/2010 Coltri-Johnson et al.
7,789,231 B2 9/2010 Requena
7,823,721 B2 11/2010 Sutherland et al.
8,056,709 B2 11/2011 Sutherland
8,096,413 B2 1/2012 DePaula
8,113,968 B2 2/2012 Fittler
8,162,135 B2 4/2012 Oliveira
8,353,398 B2 1/2013 DePaula et al.
8,387,784 B2 3/2013 Gonzalez et al.
8,443,968 B2 5/2013 DePaula
8,464,866 B2 6/2013 Sutherland et al.
8,469,184 B2 6/2013 Spivey, Sr.
8,602,209 B2 12/2013 Jones et al.
8,631,932 B2 1/2014 Holley, Jr.
8,701,878 B2 4/2014 Spivey, Sr.
8,925,720 B2 1/2015 Sutherland et al.
8,936,149 B2 1/2015 Smalley
8,955,674 B2 2/2015 Spivey, Sr. et al.
9,004,344 B2 4/2015 Smith
9,079,699 B2 7/2015 Holley, Jr.
9,169,050 B2 10/2015 Spivey, Sr.
9,284,090 B2 3/2016 Lettre
9,359,093 B2 6/2016 DePaula et al.
9,376,250 B2 6/2016 Spivey, Sr.
D767,408 S 9/2016 Shuster
9,446,891 B2 9/2016 Jones et al.
9,511,916 B2 12/2016 Holley, Jr.
D786,702 S 5/2017 Borg et al.
9,669,976 B2 6/2017 Kastanek et al.
9,676,535 B2 6/2017 Spivey, Sr.
10,077,131 B2 9/2018 Lettre
10,293,998 B2 5/2019 Borg et al.
D881,021 S 4/2020 Bandinu
D881,718 S 4/2020 Bandinu
10,836,550 B2 11/2020 Zacherle
D918,057 S 5/2021 L'Heureux
D918,058 S 5/2021 L'Heureux
11,014,727 B2 5/2021 McCree
D920,809 S 6/2021 Chesnet et al.
D921,493 S 6/2021 Chesnet
D923,416 S 6/2021 Luciano
11,027,905 B2 6/2021 Ford
11,180,301 B2 11/2021 Smalley
D944,656 S 3/2022 Spivey, Sr.
D946,416 S 3/2022 Smalley
D946,417 S 3/2022 Gonzalez Manzano
D946,418 S 3/2022 Gonzalez Manzano
D946,419 S 3/2022 Gonzalez Manzano
D946,420 S 3/2022 Gonzalez Manzano
D946,421 S 3/2022 Gonzalez Manzano
11,261,013 B2 3/2022 Smalley
11,261,014 B2 3/2022 Zacherle
11,286,094 B2 3/2022 Gonzalez Manzano
D955,889 S 6/2022 Gonzalez Manzano
D955,890 S 6/2022 Gonzalez Manzano
11,365,039 B2 6/2022 Berga Ferres
D956,574 S 7/2022 Gonzalez Manzano
11,401,095 B2 8/2022 Rosenbrien
11,420,802 B2 8/2022 Kooc
D962,789 S 9/2022 Noel
11,447,317 B2 9/2022 Zacherle et al.
D974,923 S 1/2023 Smalley
D984,279 S 4/2023 McCree
11,628,994 B2 * 4/2023 McCree ..... B65D 71/42
206/153
D1,000,290 S 10/2023 Thompson
11,840,387 B2 12/2023 Thompson
2002/0195371 A1 12/2002 Brown
2003/0080004 A1 5/2003 Olsen et al.
2003/0213705 A1 11/2003 Woog
2004/0007480 A1 1/2004 Pattee et al.
2004/0134799 A1 7/2004 Mattson
2004/0206639 A1 10/2004 Karlsson
2004/0211695 A1 10/2004 Karlsson
2004/0226833 A1 11/2004 Daniel
2005/0127151 A1 6/2005 Johnson
2005/0199513 A1 9/2005 Bakx et al.
2006/0255114 A1 11/2006 Hand et al.
2007/0080084 A1 4/2007 Sutherland
2007/0163908 A1 7/2007 Sutherland
2007/0193889 A1 8/2007 Olsen et al.
2008/0257763 A1 10/2008 Ogg
2009/0101526 A1 4/2009 Sutherland et al.
2009/0127147 A1 5/2009 Sutherland
2010/0078337 A1 4/2010 Sutherland et al.
2010/0264043 A1 10/2010 DePaula
2011/0000799 A1 1/2011 Gonzalez
2012/0080328 A1 4/2012 DePaula
2012/0138489 A1 6/2012 Holley, Jr.
2015/0191287 A1 7/2015 L'Heureux et al.
2016/0159546 A1 6/2016 Cassidy
2016/0280436 A1 9/2016 Taylor et al.
2016/0325899 A1 11/2016 L'Heureux et al.
2016/0340097 A1 11/2016 Jones et al.
2018/0111734 A1 4/2018 Jego
2018/0222650 A1 8/2018 Zacherle
2018/0362234 A1 12/2018 L'Heureux et al.
2019/0119019 A1 4/2019 Patton
2019/0135512 A1 5/2019 Kooc
2019/0233145 A1 8/2019 Kooc
2020/0010255 A1 1/2020 Zacherle et al.
2020/0079564 A1 3/2020 Ford
2020/0189817 A1 6/2020 Smalley
2020/0189818 A1 6/2020 McCree

(56) References Cited

U.S. PATENT DOCUMENTS

| | | | |
|---|---|---|---|
| 2020/0189819 | A1 | 6/2020 | McCree |
| 2020/0189821 | A1 | 6/2020 | Smalley |
| 2020/0189822 | A1 | 6/2020 | Smalley |
| 2020/0223612 | A1 | 7/2020 | Swenson |
| 2021/0061502 | A1 | 3/2021 | Johnston |
| 2021/0094742 | A1 | 4/2021 | Gonzalez Manzano |
| 2021/0276776 | A1 | 9/2021 | Zammit |
| 2021/0316921 | A1 | 10/2021 | Holtz |
| 2021/0331847 | A1 | 10/2021 | Gonzalez Manzano |
| 2021/0331848 | A1 | 10/2021 | Gonzalez Manzano |
| 2021/0339928 | A1 | 11/2021 | Blin |
| 2022/0009685 | A1 | 1/2022 | Thompson |
| 2022/0097941 | A1 | 3/2022 | McCree |
| 2022/0396407 | A1 | 12/2022 | Thompson |
| 2022/0411155 | A1 | 12/2022 | Ford |
| 2022/0411156 | A1 | 12/2022 | Ford |
| 2023/0019145 | A1 | 1/2023 | Thompson |
| 2023/0031526 | A1 | 2/2023 | Holley, Jr. |
| 2023/0286717 | A1 | 9/2023 | Garnier |
| 2023/0303300 | A1 | 9/2023 | Spivey, Sr. |
| 2023/0322458 | A1 | 10/2023 | Barrette |
| 2023/0382619 | A1 | 11/2023 | Ford |
| 2024/0034532 | A1 | 2/2024 | Merzeau |
| 2024/0109703 | A1 | 4/2024 | Thompson et al. |

FOREIGN PATENT DOCUMENTS

| | | | |
|---|---|---|---|
| CA | 2133827 | | 10/1993 |
| DE | 81 02 677 | U1 | 11/1983 |
| DE | 298 13 672 | U1 | 11/1998 |
| DE | 203 19 247 | U1 | 5/2004 |
| DE | 10 2009 059 047 | A1 | 6/2011 |
| DE | 20 2018 106 535 | | 1/2019 |
| EM | 008574800-0008 | | 12/2021 |
| EP | 0 051 413 | A1 | 5/1982 |
| EP | 0 060 504 | A2 | 9/1982 |
| EP | 0 057 437 | B1 | 5/1985 |
| EP | 0 496 807 | | 6/1993 |
| EP | 0 636 096 | | 2/1995 |
| EP | 0 715 593 | A1 | 6/1996 |
| EP | 0 398 835 | B1 | 10/1996 |
| EP | 1 340 691 | A1 | 9/2003 |
| EP | 1 401 727 | B1 | 6/2006 |
| EP | 1 910 187 | B1 | 3/2009 |
| EP | 2 067 713 | A1 | 6/2009 |
| EP | 1 528 007 | B1 | 10/2010 |
| EP | 2739547 | B1 | 7/2017 |
| EP | 3 666 684 | A1 | 6/2020 |
| EP | 3 666 685 | A1 | 6/2020 |
| ES | 2159235 | | 9/2001 |
| FR | 2 737 196 | A1 | 1/1997 |
| GB | 1 256 684 | | 12/1971 |
| GB | 2 221 666 | A | 2/1990 |
| GB | 2 321 229 | A | 7/1998 |
| GB | 9006736716 | | 8/2019 |
| GB | 2591535 | A | 8/2021 |
| GB | 6161591 | | 9/2021 |
| JP | 37-15730 | | 9/1960 |
| JP | 10-194330 | A | 7/1998 |
| JP | 10-297668 | A | 11/1998 |
| JP | 11-193059 | | 7/1999 |
| JP | 2001-519300 | A | 10/2001 |
| JP | 2003-146359 | | 5/2003 |
| JP | 2004-189243 | A | 7/2004 |
| JP | 2015-048088 | A | 3/2015 |
| JP | 2016-124605 | | 7/2016 |
| KR | 10-2005-0051616 | A | 6/2005 |
| KR | 10-2020-0106806 | A | 9/2020 |
| KR | 301130233 | | 10/2021 |
| WO | WO 91/05716 | A1 | 5/1991 |
| WO | WO 93/02941 | A1 | 2/1993 |
| WO | WO 93/21083 | | 10/1993 |
| WO | WO 93/25439 | A1 | 12/1993 |
| WO | WO 94/22738 | A1 | 10/1994 |
| WO | WO 95/01289 | A1 | 1/1995 |
| WO | WO 95/01696 | A2 | 1/1995 |
| WO | WO 95/06604 | | 3/1995 |
| WO | WO 95/10459 | A1 | 4/1995 |
| WO | WO 95/22495 | A1 | 8/1995 |
| WO | WO D036442-002 | | 7/1996 |
| WO | WO 96/26128 | A1 | 8/1996 |
| WO | WO 96/32340 | A1 | 10/1996 |
| WO | WO 98/09883 | A1 | 3/1998 |
| WO | WO 03/016167 | A1 | 2/2003 |
| WO | WO 2006/044583 | A2 | 4/2006 |
| WO | WO 2008/058294 | A1 | 5/2008 |
| WO | WO 2009/023822 | A1 | 2/2009 |
| WO | WO 2010/006629 | A1 | 1/2010 |
| WO | WO 2010/099164 | A2 | 9/2010 |
| WO | WO 2010/101852 | A1 | 9/2010 |
| WO | WO 2016/008744 | A1 | 1/2016 |
| WO | WO 2016/100010 | A1 | 6/2016 |
| WO | WO 2016/112145 | A1 | 7/2016 |
| WO | WO 2020/210562 | A1 | 10/2020 |
| WO | WO 2021/038516 | A1 | 3/2021 |
| WO | WO 2021/168417 | A1 | 8/2021 |
| WO | WO 2021/188751 | A1 | 9/2021 |
| WO | WO 2021/262858 | A1 | 12/2021 |
| WO | WO 2023/09631 | A2 | 6/2023 |

OTHER PUBLICATIONS

"Pepsi trials molded pulp alternative to plastic rings" in BeverageDaily.com. Date posted: Feb. 28, 2020. Site visited: Sep. 12, 2022. Available online: https://www.beveragedaily.com/Article/2020/02/28/Pepsi-trials-molded-pulp-alternative-to-plastic-rings# (Year: 2020).

Enviroclip. Date posted: 2022. Site visited: Sep. 12, 2022. Available online: https://www.graphicpkg.com/products/enviroclip/ (Year: 2022).

"Paperboard Can Handle Applicator," as seen in Packaging World Online. Date first available: 2020. Site visited: Sep. 13, 2022. Available online: https://www.packworld.com/news/sustainability/article/21202650/paperboard-can-handle-applicator (Year: 2020).

"The 'ECOGRIP' Corrugated Bottle Carrier is a Plastic Alternative" in Trendhunter.com. Date published: Jan. 20, 2021. Site visited: Sep. 12, 2022. Available online: https://www.trendhunter.com/trends/corrugated-bottle-carrier (Year: 2021).

Cap-it packaging video on Vimeo. Date posted: 2021. Site visited: Sep. 19, 2022. Available online: https://vimeo.com/610619455?embedded=true&source=vimeo_logo&owner=24551687 (Year: 2021).

2020 Package of the Year and Innovation of the Year on YouTube. Date posted: Oct. 19, 2020. Site visited: Sep. 12, 2022. Available online: https://www.youtube.com/watch?v=wxwpM4hodFA (Year: 2020).

International Search Report and Written Opinion for PCT/US2022/032608 dated Sep. 28, 2022.

International Search Report and Written Opinion for PCT/US2022/035207 dated Oct. 14, 2022.

International Search Report and Written Opinion for PCT/US2022/034840 dated Oct. 21, 2022.

International Search Report and Written Opinion for PCT/US2022/036297 dated Oct. 21, 2022.

International Search Report and Written Opinion for PCT/US2022/037069 dated Oct. 28, 2022.

International Search Report and Written Opinion for PCT/US2022/037071 dated Nov. 2, 2022.

International Search Report and Written Opinion for PCT/US2022/038638 dated Nov. 8, 2022.

Issue Notification for U.S. Appl. No. 17/835,127 dated Nov. 22, 2023.

Issue Fee Transmittal Form for U.S. Appl. No. 17/835,127 dated Nov. 1, 2023.

Notice of Allowance and Fee(s) Due for U.S. Appl. No. 17/835,127 dated Aug. 2, 2023.

Amendment A and Response to Office Action for U.S. Appl. No. 17/835,127 dated Jun. 21, 2023.

Office Action for U.S. Appl. No. 17/835,127 dated Mar. 23, 2023.

6 Pack Cardboard Carrier_Beer Carriers_Pak-It Products, [date first available: Dec. 9, 2021], [date found online: Jun. 10, 2024], https:/www.pakitproducts.com/product/recyclable-6-pak-cardboard-can-carrier/ (Year: 2021).

(56) References Cited

OTHER PUBLICATIONS

Introducing Fishbone Recyclable Can Carrier System_Atlantic Packaging, [date first available: Dec. 7, 20202], [date found online: Jun. 11, 2024], https://www.atlanticpkg.com/2020/12/introducing-fishbone-recyclable-can-carrier-system/ (Year: 2020).
WestRock Company_YouTube, [date first posted: Jul. 22, 2020], [date found online: Jun. 12, 2024], https://www.youtube.com/watch?v=LAq-uYiU2UE (Year: 2020).
Asahi Breweries First Japanese User of WestRock Cancollar® Eco Packaging, [date first posted: Oct. 15, 2021], [date found online: Jun. 12, 2024], https://www.asahibeer.com.jp/news/2021/1015_2.html (Year 2021).
Smurtfit Kappa GreenClip_Facebook, [date first posted: Dec. 7, 2020], [date found online: Jun. 12, 2024], https://www.facebook.com/SmurfitKappaGroup/videos/smurfit-kappa-greenclip/410973346931978/ (Year: 2020).
Smurfit Kappa and KHS Join Forces for TopClip Solution_ThePackagingPortal.com, [date first available: Nov. 19, 2020], [date found online: Jun. 24, 2024], https://www.thepackagingportal.com/industry-news/smurfit-kappa-and-khs-join-forces-for-topclip-solution (Year: 2021).
International Search Report and Written Opinion for PCT/US2024/041864 dated Nov. 26, 2024.
Supplementary European Search Report for European Application No. 22820929.2 dated Mar. 14, 2025.

* cited by examiner

CARRIER FOR CONTAINERS

CROSS-REFERENCE TO RELATED APPLICATION

This application is a continuation of U.S. patent application Ser. No. 18/535,165, filed on Dec. 11, 2023, which is a continuation-in-part of U.S. patent application Ser. No. 17/835,127, filed on Jun. 8, 2022, which claims the benefit of U.S. Provisional Patent Application No. 63/208,568, filed on Jun. 9, 2021. U.S. patent application Ser. No. 18/535,165 also claims the benefit of U.S. Provisional Patent Application No. 63/532,527, filed on Aug. 14, 2023, and U.S. Provisional Patent Application No. 63/537,328, filed on Sep. 8, 2023.

INCORPORATION BY REFERENCE

The disclosures of each of U.S. patent application Ser. No. 18/535,165, filed on Dec. 11, 2023, U.S. patent application Ser. No. 17/835,127, filed on Jun. 8, 2022, U.S. Provisional Patent Application No. 63/208,568, filed on Jun. 9, 2021, U.S. Design patent application Ser. No. 29/838,182, filed on May 11, 2022, U.S. patent application Ser. No. 17/835,127, filed on Jun. 8, 2022, U.S. Provisional Patent Application No. 63/532,527, filed on Aug. 14, 2023, and U.S. Provisional Patent Application No. 63/537,328, filed on Sep. 8, 2023, are hereby incorporated by reference for all purposes as if presented herein in their entireties.

BACKGROUND OF THE DISCLOSURE

The present disclosure generally relates to cartons or carriers for holding, displaying, and/or transporting containers.

SUMMARY OF THE DISCLOSURE

According to one aspect, the disclosure is generally directed to a carrier for holding a plurality of containers, the carrier comprising a plurality of panels comprising an attachment panel, an outer panel extending upwardly from the attachment panel, a top panel extending from the outer panel, an inner panel extending at least partially downwardly from the top panel, and a reinforcement panel at least partially overlapping the attachment panel, an attachment flap extending at least partially upwardly from the reinforcement panel, and container retention features comprising a plurality of container retention openings at least partially defined in the attachment panel for at least partially receiving a respective container of the plurality of containers.

According to another aspect, the disclosure is generally directed to a blank for forming a carrier for holding a plurality of containers, the blank comprising a plurality of panels comprising an attachment panel, an outer panel for extending upwardly from the attachment panel when the carrier is formed from the blank, a top panel extending from the outer panel, an inner panel for extending at least partially downwardly from the top panel when the carrier is formed from the blank, and a reinforcement panel for at least partially overlapping the attachment panel when the carrier is formed from the blank, an attachment flap for extending at least partially upwardly from the reinforcement panel when the carrier is formed from the blank, and container retention features comprising a plurality of container retention openings at least partially defined in the attachment panel for at least partially receiving a respective container of the plurality of containers.

According to another aspect, the disclosure is generally directed to a method of forming a carrier for holding a plurality of containers, the method comprising obtaining a blank, the blank comprising a plurality of panels comprising an attachment panel, an outer panel, a top panel extending from the outer panel, an inner panel extending from the top panel, and a reinforcement panel, the blank further comprising an attachment flap, and container retention features comprising a plurality of container retention openings at least partially defined in the attachment panel, positioning the attachment panel for at least partially receiving a respective container of the plurality of containers, positioning the outer panel extending upwardly from the attachment panel, positioning the inner panel extending at least partially downwardly from the top panel, at least partially overlapping the reinforcement panel on the attachment panel, and positioning the attachment flap extending at least partially upwardly from the reinforcement panel.

According to another aspect, the disclosure is generally directed to a package, the package comprising a plurality of containers, and a carrier holding the plurality of containers, the carrier comprising a plurality of panels comprising an attachment panel, an outer panel extending upwardly from the attachment panel, a top panel extending from the outer panel, an inner panel extending at least partially downwardly from the top panel, and a reinforcement panel at least partially overlapping the attachment panel, an attachment flap extending at least partially upwardly from the reinforcement panel, and container retention features comprising a plurality of container retention openings at least partially defined in the attachment panel and at least partially receiving a respective container of the plurality of containers.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to carriers, packages, constructs, sleeves, cartons, or the like, for holding and displaying containers such as jars, bottles, cans, etc. The containers can be used for packaging food and beverage products, for example. The containers can be made from materials suitable in composition for packaging the particular food or beverage item, and the materials include, but are not limited to, glass; plastics such as PET, LDPE, LLDPE, HDPE, PP, PS, PVC, EVOH, and Nylon; and the like; aluminum and/or other metals; or any combination thereof.

Carriers according to the present disclosure can accommodate containers of numerous different shapes. For the purpose of illustration and not for the purpose of limiting the scope of the disclosure, the following detailed description describes beverage containers (e.g., aluminum cans) at least partially disposed within the carrier embodiments. In this specification, the terms "lower," "bottom," "upper," "top," "front," and "back" indicate orientations determined in relation to fully erected carriers.

As described herein, carriers may be formed by multiple overlapping panels, end flaps, and/or other portions of blanks. Such panels, end flaps, and/or other portions of the blank can be designated in relative terms to one another, e.g., "first", "second", "third", etc., in sequential or non-sequential reference, without departing from the disclosure.

Figure 1:
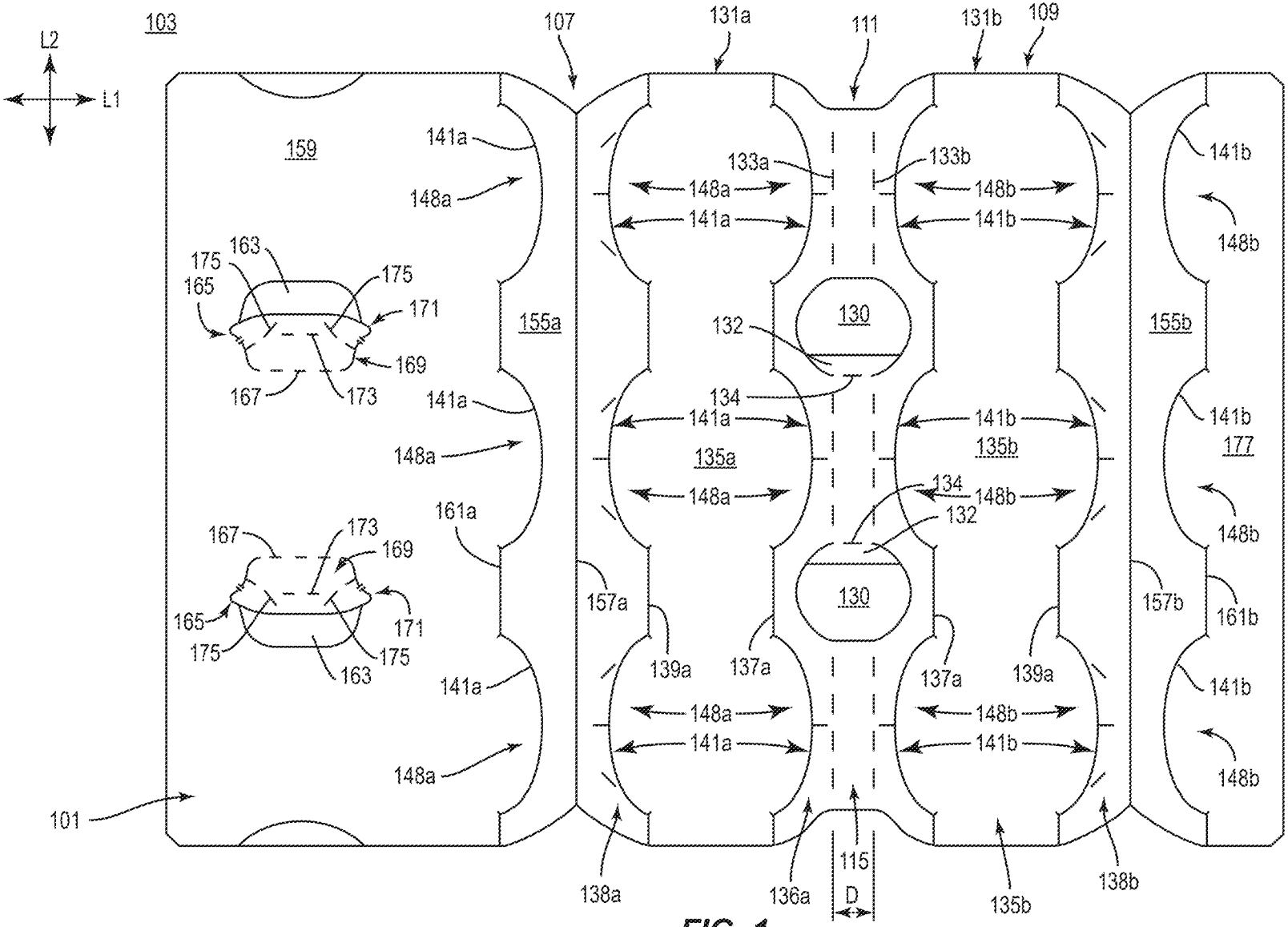
FIG. 1 is a plan view of an outer surface of a blank for forming a package and carrier according to a first exemplary embodiment of the disclosure.
Figure 3:
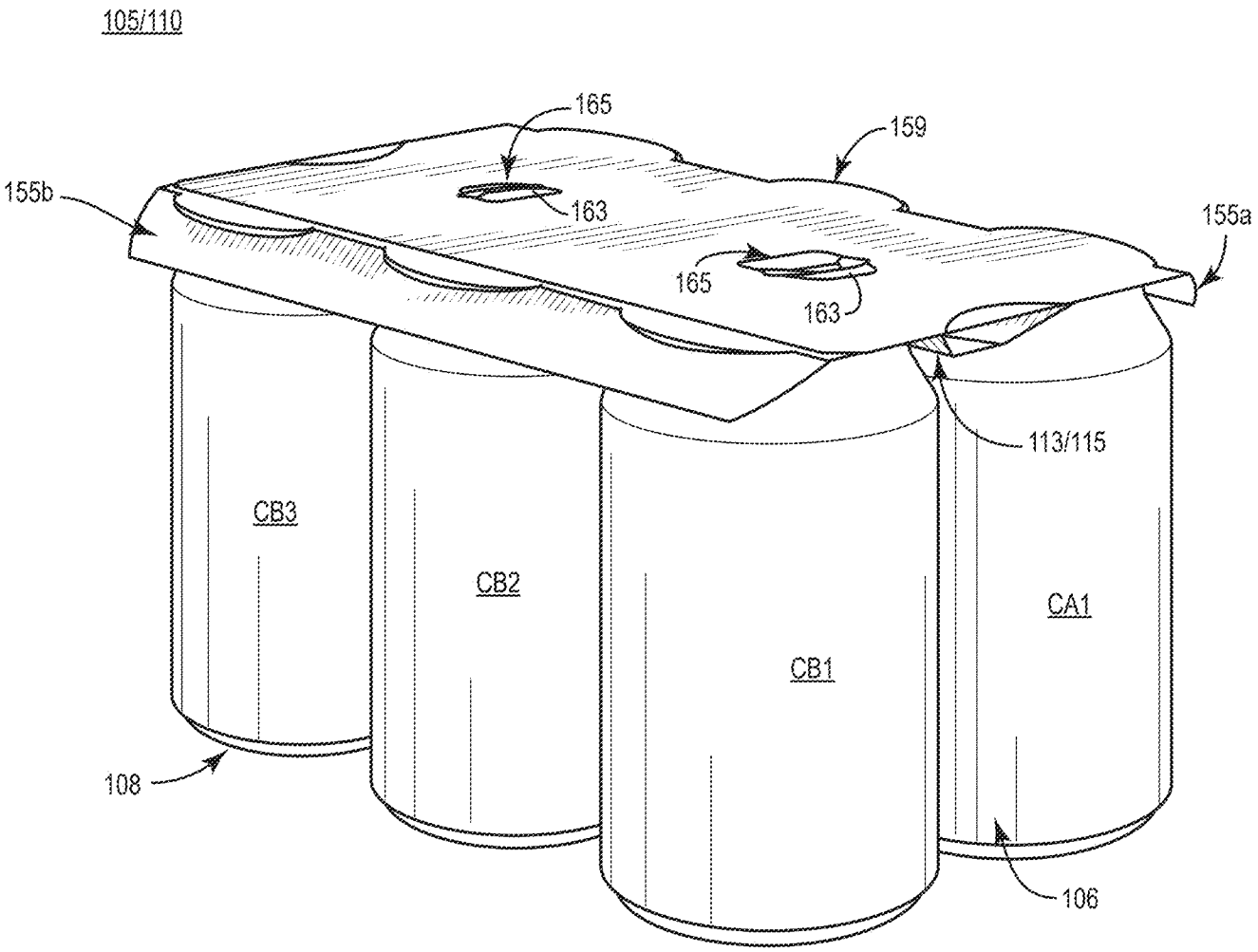
FIG. 3 is a perspective view of the package and carrier formed from the blank of FIG. 1 according to the first exemplary embodiment.

FIG. 1 shows a plan view of an exterior side 101 of a blank 103 used to form a carrier 105 (FIG. 3) in accordance with a first exemplary embodiment of the disclosure. As shown in FIG. 3, the carrier 105 is sized to contain or support six containers, with three containers CA1, CA2, CA3 being attached to a front portion 106 of the carrier 105 and three containers CB1, CB2, CB3 being attached to a back portion 108 of the carrier 105. In the illustrated embodiment, the containers CA1, CA2, CA3, CB1, CB2, CB3 can be beverage cans, or could be any other suitable type and size of container without departing from the disclosure. In some embodiments, the containers can have an upper rim or other top portion corresponding to a diameter of 53 mm, 58 mm, or 56 mm, or the like.

The carrier 105 can be sized and shaped to hold more or less than six containers. In one embodiment, the front portion 106 and the back portion 108 of the carrier 105 each have three containers, and in other embodiments, the front portion 106 and the back portion 108 of the carrier 105 can carry more or less than three containers without departing from the disclosure. The carrier 105 can be provided together with one or more containers as a package 110 (FIG. 3).

As shown in FIG. 1, the blank 103 has a longitudinal axis L1 and a lateral axis L2. The blank 103 has a front portion 107 for forming the front portion 106 of the carrier 105, a back portion 109 for forming the back portion 108 of the carrier 105, and a central or reinforcement portion 111 for forming a central or reinforcement portion 113 of the carrier 105 extending from the front portion 106 of the carrier 105 to the back portion 108 of the carrier 105 for reinforcing the carrier 105.

In the illustrated embodiment, the reinforcement portion 111 of the blank 103 includes a reinforcement panel 115 interrupted by a laterally-spaced pair of handle apertures 130. The reinforcement panel 115 can have a width D along the longitudinal axis L1 defined between a pair of fold lines 133*a*, 133*b* to which the front portion 107 of the blank 103 and the back portion 109 of the blank 103 are foldably connected to the reinforcement portion 111, respectively.

While the reinforcement panel 115 is described in the illustrated embodiment as a single interrupted panel, it will be understood that such portion of the blank 103/carrier 105 can be formed from multiple cooperating panels/flaps/structures. The reinforcement portion 111 of the blank 103/reinforcement portion 113 of the carrier 105 can have a different configuration without departing from the disclosure. Furthermore, it will be understood that the reinforcement portion 111 of the blank 103/reinforcement portion 113 of the carrier 105 can be considered a central portion of the blank 103/carrier 105 and/or a portion of one of the front portion 107 of the blank 103/front portion 106 of the carrier 105 and the back portion 109 of the blank 103/back portion 108 of the carrier 105.

With continued reference to FIG. 1, the front portion 107 of the blank 103 can include a front container retention panel or front attachment panel 131*a* foldably connected to the reinforcement panel 115 at respective portions of a lateral fold line 133*a* that is interrupted by the handle apertures 130. As shown, handle reinforcement flaps 132 (broadly, "lower handle reinforcement flaps") can be foldably connected to the reinforcement panel 115 at respective longitudinal fold lines 134, and can be positioned to extend into the respective handle apertures 130.

The front attachment panel 131*a* can also include a container retention portion 135*a* that is at least partially defined between a pair of longitudinally-spaced lateral fold lines 137*a*, 139*a* that are each interrupted by a respective pair of longitudinally-spaced cuts 141*a* that can each include one or more curved and/or angled portions. As shown, the longitudinally-spaced cuts 141*a* define container retention tabs 148*a* that extend outwardly from the container retention portion 135*a*. As also shown, respective oblique cuts can extend outwardly from one or more cuts 141*a* that interrupt the fold line 139*a*. Furthermore, longitudinal cuts can extend outwardly from respective central portions of the cuts 141*a*.

As shown, an interior marginal portion 136*a* of the attachment panel 131*a* is defined between the fold lines 137*a*, 133*a*, and an exterior marginal portion 138*a* of the attachment panel 131*a* is defined between the fold line 139*a* and a lateral fold line 157*a* adjacent the attachment panel 131*a*.

A bevel or front side panel 155*a*, as shown, is foldably connected to the front attachment panel 131*a* at the lateral fold line 157*a*, and a front top panel 159 is foldably connected to the front side panel 155*a* at a lateral fold line 161*a*. The lateral fold line 157*a* can be interrupted by a plurality of the cuts 141*a* so as to define container retention tabs 148*a* protruding from the top panel 159, as described further herein.

The top panel 159, as shown, includes a pair of laterally-spaced handle openings 163 (broadly, "upper handle openings") that are generally aligned with the respective handle apertures 130 (broadly, "lower handle openings"). A respective handle reinforcement flap 165 (broadly, "upper handle reinforcement flap") can be foldably connected to the top panel 159 at respective longitudinal fold lines 167 and positioned to extend into the respective handle openings 163. Each handle reinforcement flap 165, as shown, can include a base portion 169 foldably connected to the top panel 159 at the respective fold lines 167, and a respective distal portion 171 foldably connected to the respective base portion 169 at a respective longitudinal fold line 173 and including a pair of oblique lines of weakening 175 intersecting the respective longitudinal fold lines 173.

In the illustrated embodiment, the back portion 109 of the blank 103 includes a back container retention panel or back attachment panel 131*b* and a back side panel 155*b* having associated features that are generally a mirror-image of the corresponding portions of the front portion 107 of the blank 103. Corresponding components (e.g., panels, flaps, fold lines, cuts, etc.) have been designated by corresponding reference numbers that differ by the "a" or "b" suffix, with the "a" components corresponding to the front portion 107 of the blank 103 and the "b" components corresponding to the back portion 109 of the blank 103.

The back portion 109 of the blank 103 also includes a second top panel or attachment flap 177 foldably connected to the back side panel 155*b* at a lateral fold line 161*b*.

Any of the panels, flaps, fold lines, cuts, or other features could be otherwise shaped, arranged, and/or omitted from the blank 103 without departing from the disclosure. The blank 103 could be sized and/or shaped to accommodate more or less than six containers without departing from this disclosure.

Figure 2:
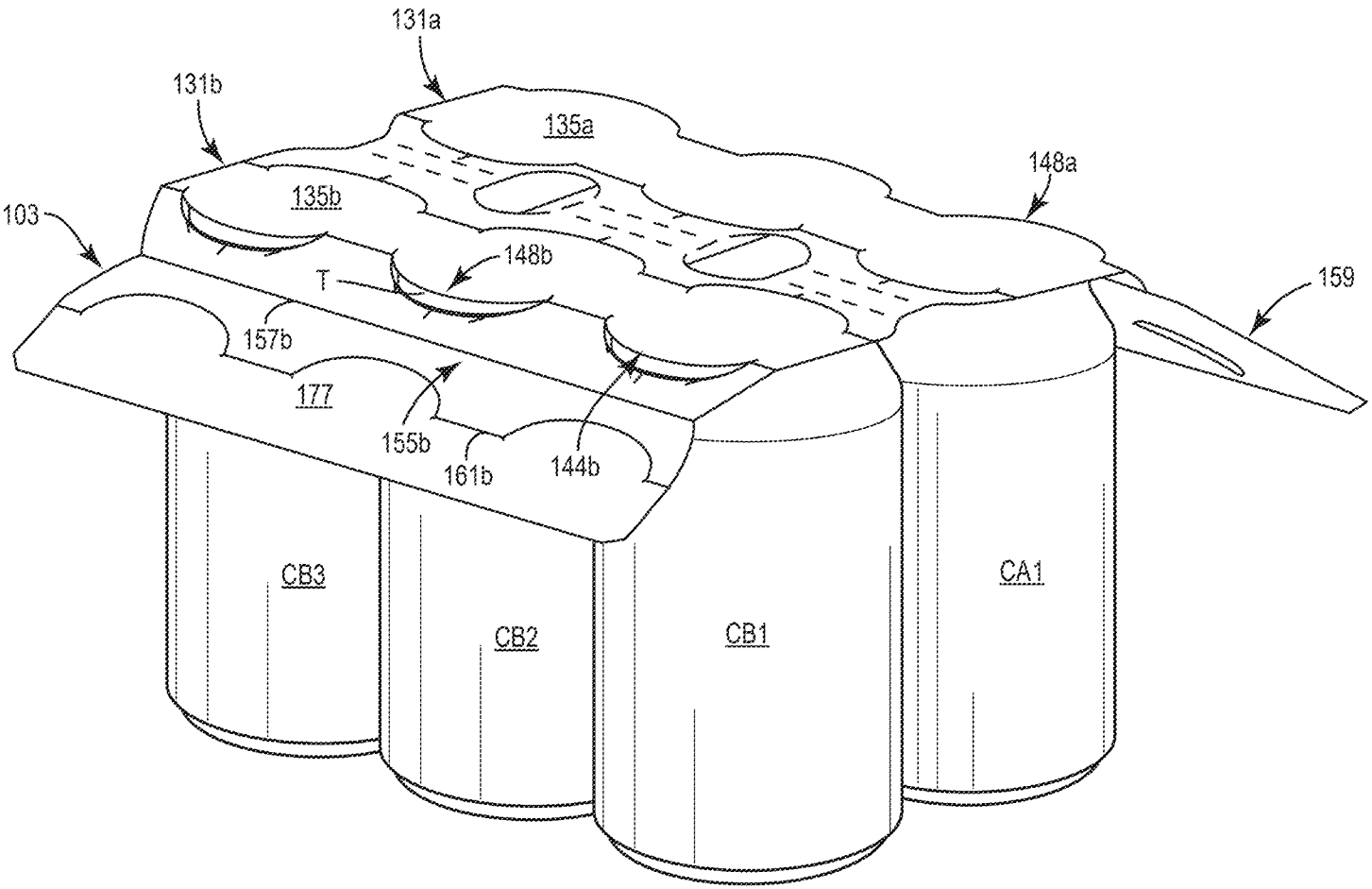
FIG. 2 is a perspective view of a formation of a package and carrier from the blank of FIG. 1 according to the exemplary embodiment.

As shown in FIG. 2, the blank 103 can be inverted such that the exterior surface 101 of the blank 103 can be placed atop the containers CA1, CA2, CA3, CB1, CB2, CB3 such that the container retention portion 135*a* of the front attachment panel 131*a* overlies the containers CA1, CA2, CA3 and such that the container retention portion 135*b* of the back attachment panel 131*b* overlies the containers CB1, CB2, CB3. Further downward positioning of the attachment panels 131*a*, 131*b* over the plurality of containers CA1, CA2, CA3, CB1, CB2, CB3 can activate the respective container retention portions 135*a*, 135*b* to engage respective containers.

For example, as the front attachment panel 131*a* is lowered or urged downwardly onto the containers CA1, CA2, CA3 the container retention portion 135*a* can at least partially separate from the remainder of the front attachment panel 131*a* at the cuts 141*a*. In such an arrangement, upper or top portions T of the respective containers CA1, CA2, CA3 can extend at least partially through respective openings formed by the respective cuts 141*a* such that the container retention tabs 148*a* can sit within recessed portions of the containers CA1, CA2, CA3, e.g., recessed tops of the containers CA1, CA2, CA3 below rolled upper rims thereof.

Such reconfiguration of the corresponding portions of the back attachment panel 131*b* can occur as the back attachment panel 131*b* is lowed or urged downwardly onto the containers CB1, CB2, CB3.

The marginal portions 136*a*, 138*a* of the attachment panel 131*a* can fold at least partially downwardly at the respective fold lines 137*a*, 139*a* in such a configuration, and, similarly, the marginal portions 136*b*, 138*b* of the attachment panel 131*b* can fold at least partially downwardly at the respective fold lines 137*b*, 139*b*. In this regard, the marginal portions 136*a*, 138*a* can be obliquely arranged relative to the attachment portion 135*a* of the attachment panel 131*a* and the marginal portions 136*b*, 138*b* can be obliquely arranged relative to the attachment portion 135*b* of the attachment panel 131*b*. Such movement can cause reconfiguration of the outer marginal portion 138*a* of the front attachment panel 131*a* to reconfigure at the respective cuts 143*a*, 145*a*, 146*a* to engage a rolled rim or other top structure of the respective containers CA1, CA2, CA3.

The back attachment panel 131*b* and corresponding container retention portion 135*b* can engage the containers CB1, CB2, CB3 in a manner similar to that described above with respect to the engagement of the front attachment panel 131*a* and container retention portion 135*a* with respect to the containers CA1, CA2, CA3.

Still referring to FIG. 2, the front side panel 155*a* can be folded upwardly at the fold line 157*a*, for example, to be at an oblique arrangement relative to the attachment portion 135*a* of the attachment panel 131*a*, and the top panel 159 (broadly, "first top panel") can be folded at the fold line 161*a* into at least partial face-to-face contact with at least a portion of the attachment panels 131*a*, 131*b*. Such movement of the top panel 159 can cause the container retention tabs 148*a* to separate from the front side panel 155*a* at the respective cuts 141*a*, and can at least partially overlie the container retention tabs 148*a* associated with the attachment panel 131*a*. In this regard, the rolled rim or other top structure of the respective containers CA1, CA2, CA3 can be at least partially received through the cuts 141*a* along the fold line 161*a* such that the container retention tabs 148*a* extending from the top panel 159 can also sit within recessed upper portions of the containers CA1, CA2, CA3.

Similarly, the back side panel 155*b* can be folded upwardly at the fold line 157*b* into an oblique arrangement with the attachment portion 135*b* of the attachment panel 131*b*, and the attachment flap 177 can be folded at the fold line 161*b* into at least partial face-to-face contact with the top panel 159 and/or the attachment panel 131*b*. Such movement of the attachment flap 177 can cause engagement with the containers CB1, CB2, CB3 in a manner similar to that described above with regard to the engagement of the top panel 159 with the containers CA1, CA2, CA3.

This positioning of the top panel 159 can align the handle openings 163 with the respective handle apertures 130 therebelow to facilitate engagement with the carrier 105/package 110 by a customer or other user. The aforementioned arrangement of the carrier 105 can be maintained with one or more applications of an adhesive such as glue, or, in embodiments, the carrier 105 can be devoid of glue.

Figure 4:
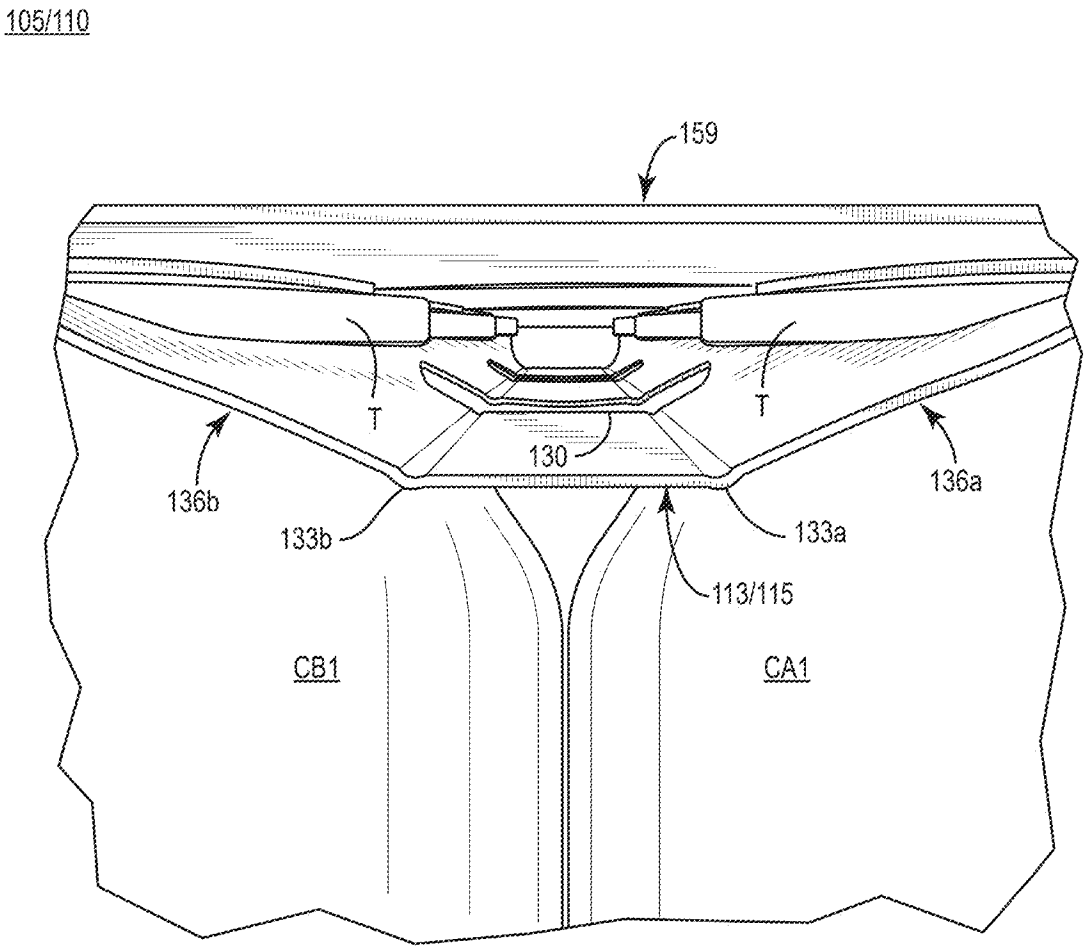
FIG. 4 is an enlarged view of a portion of the package and carrier of FIG. 3.

Accordingly, in the formed carrier 105 as shown in FIGS. 3 and 4, containers can be engaged by the respective attachment panels 131*a*, 131*b* and can extend below the respective container retention portions 135*a*, 135*b* in the assembled carrier 105/package 110. In such an arrangement, the containers CA1, CA2, CA3 extend below the container retention portion 135*a* in the front portion 106 of the carrier 105, and the containers CB1, CB2, CB3 extend below the container retention portion 135*b* in the back portion 108 of the carrier 105, with the top panel 159 and the attachment flap 177 overlying and in at least partial face-to-face contact with respective portions of the respective container retention portions 135*a*, 135*b*.

Furthermore, the positioning of the reinforcement panel 115 extending from the front portion 106 of the carrier 105 to the back portion 108 of the carrier 105 provides reinforcement to the carrier 105 in the course of movement or other loading, e.g., transportation, storage, carrying, incidental to use, etc. In this regard, the arrangement of reinforcement panel 115 spaced below the top panels 159, 177/attachment portions 135*a*, 135*b* and in generally parallel relation thereto provides the carrier 105 with an increased capacity to minimize, inhibit, avoid, prevent, and/or otherwise resist bending, bowing, flexing, buckling, curling, deflection, and/or other deformation.

In one embodiment, the arrangement of the reinforcement panel 115 extending from the obliquely-arranged interior marginal portion 136*a* of the front portion 106 of the carrier 105 to the obliquely-arranged interior marginal portion 136*b* of the back portion 108 of the carrier 105 can provide an arch-like construction that tends to resolve applied forces into compressive stresses outwardly away from the reinforcement panel 115, e.g., so as to favorably distribute stresses along the carrier 105.

Still referring to FIGS. 3 and 4, the carrier 105 can be grasped by inserting a user's fingers through the handle openings 163 and into the handle apertures 130 below to facilitate contact by the user's fingers of the underside of one or more of the reinforcement panel 115, the front attachment panel 131*a*, and the back attachment panel 131*b*. Such engagement of the carrier 105 by the user can cause one or both of the handle reinforcement flaps 165 to fold downwardly at the respective longitudinal fold lines 167, which in turn, can cause further downward folding of the respective handle reinforcement flaps 132 at the respective fold lines 134 to provide one or more additional plies of material between the user's fingers and the underside of the carrier 105, e.g., for comfort, to avoid pinching, etc. and/or to provide a reinforced structure for engagement by the user that is resistant to tearing or other deformation due to carrying stresses. In addition, the lines of weakening 175 in the handle reinforcement flaps 165 can permit at least partial reconfiguration thereof, e.g., to at least partially fold, flex, curl, etc. about a user's fingers to provide additional cushioning and support. In this regard, the handle apertures 130, the handle reinforcement flaps 132, the handle openings 163, and the handle reinforcement flaps 165, in combinations and subcombinations, can form handle features of the carrier 105.

The package 110/carrier 105 described above has a compact structure that can, for example, provide materials savings and waste reduction. Additionally, the positioning of the reinforcement panel 115 between the front portion 106 and the back portion 108 of the carrier 105 results in a robust structure for holding and carrying the containers CA1, CA2, CA3, CB1, CB2, CB3. Further, the exposure of one or more portions of the containers CA1, CA2, CA3, CB1, CB2, CB3 on exterior portions of the carrier 105/package 110 provides a consumer with a clear view of labeling or surface graphics associated with the containers CA1, CA2, CA3, CB1, CB2, CB3 as well as providing convenient access to remove one or more of the containers CA1, CA2, CA3, CB1, CB2, CB3 from the carrier 105/package 110, for example, by withdrawing a respective container through the respective cuts 141*a*, 141*b* to disengage the container from the respective panel 131*a*, 131*b*, 159, 177.

Figure 5:
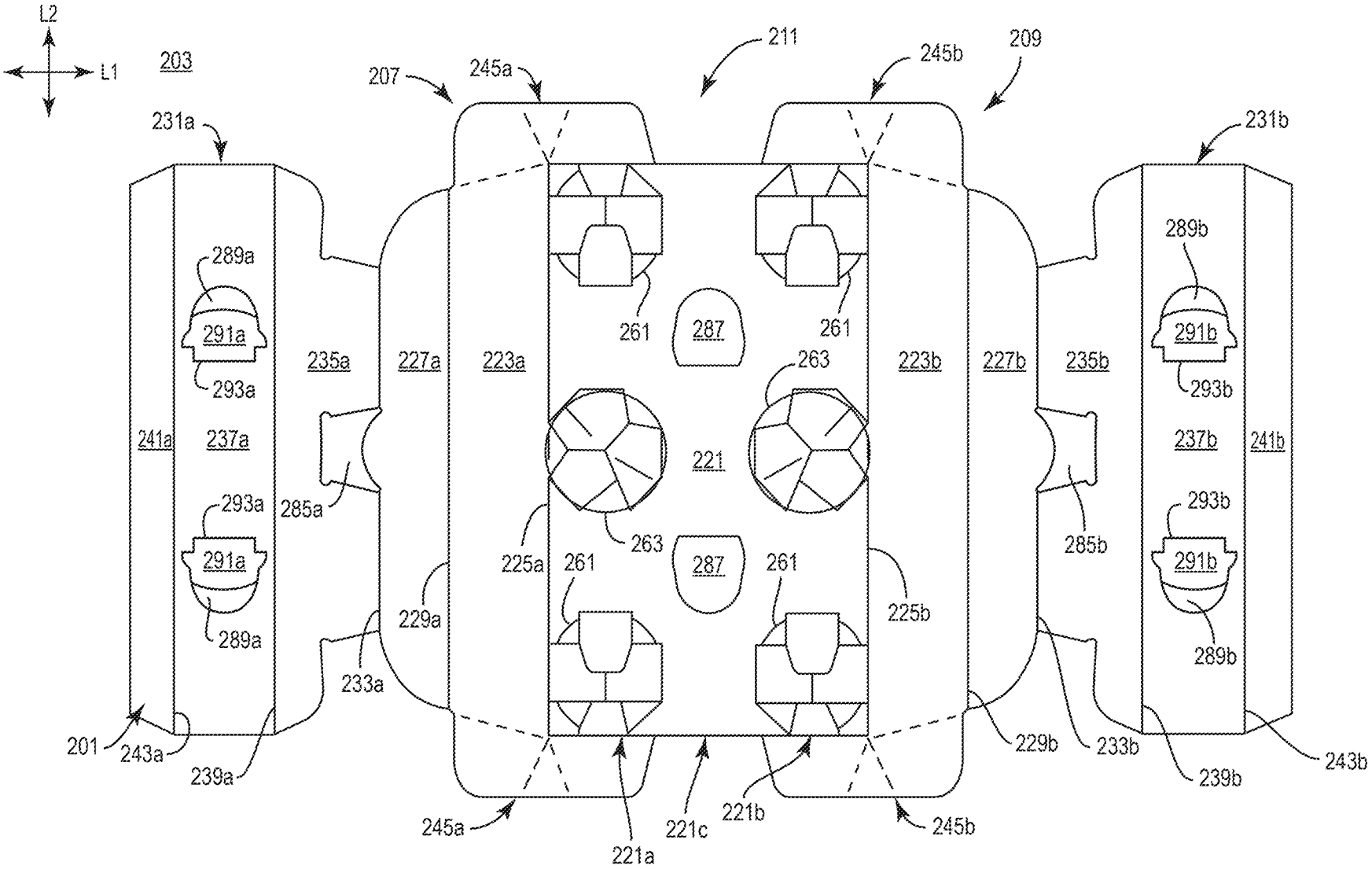
FIG. 5 is a plan view of an outer surface of a blank for forming a package and carrier according to a second exemplary embodiment of the disclosure.
Figure 5A:
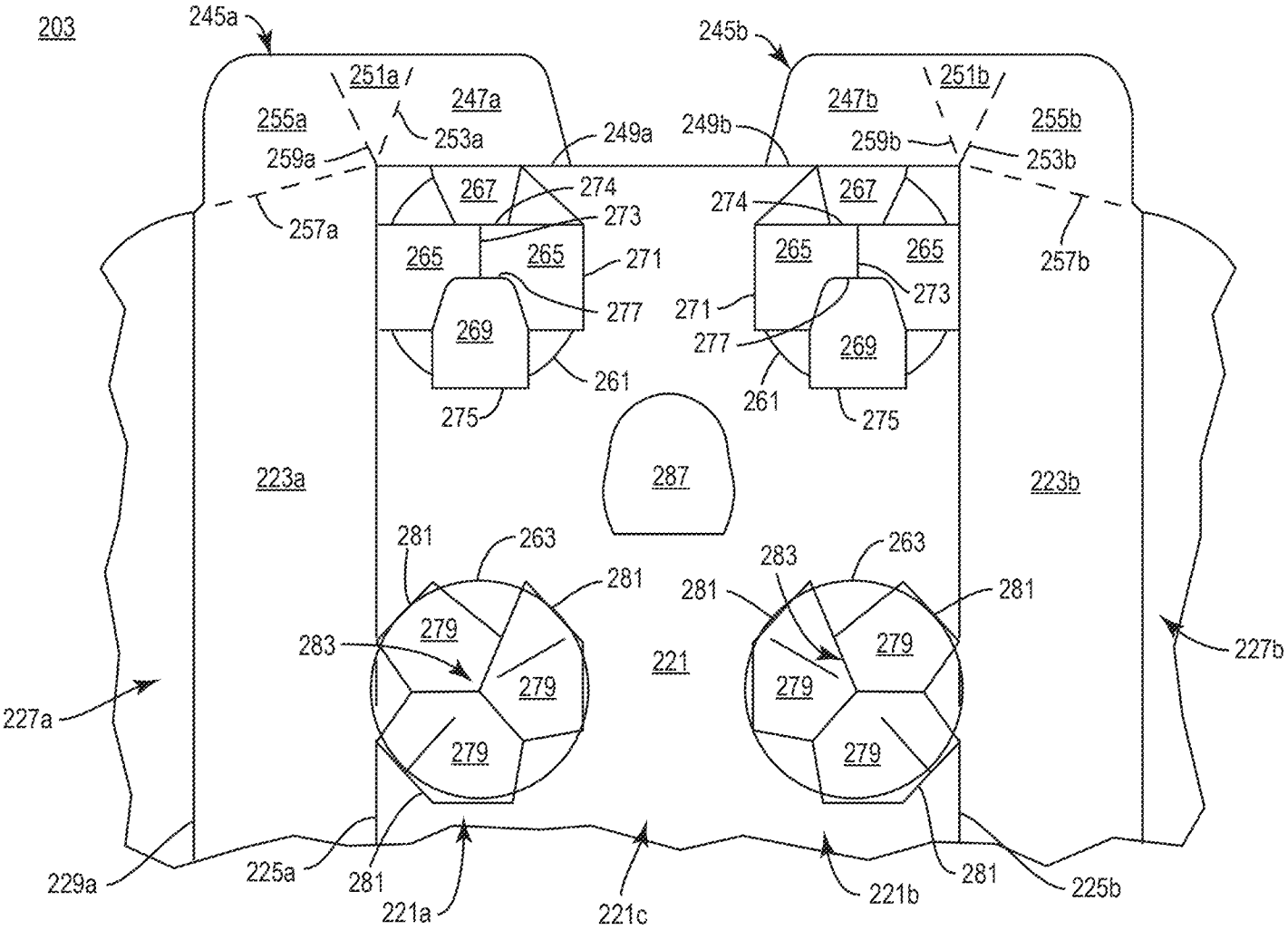
FIG. 5A is an enlarged view of a portion of the blank of FIG. 5.

FIG. 5 is a plan view of an exterior surface 201 of a blank 203 for forming a carrier 205 (FIG. 7) according to a second exemplary embodiment of the disclosure. FIG. 5A is an enlarged view of a portion of the blank 203. The blank 203 and carrier 205 formed therefrom can have one or more features that are the same or similar to those described above with respect to the blank 103 and carrier 105 formed therefrom, and like or similar features are designated with like or similar reference numerals.

As described further herein, the carrier 205 can be configured for holding/supporting/retaining/receiving a plurality of containers. The carrier 205 can be provided with one or more containers to form a package 210 (FIG. 7).

Figure 7:
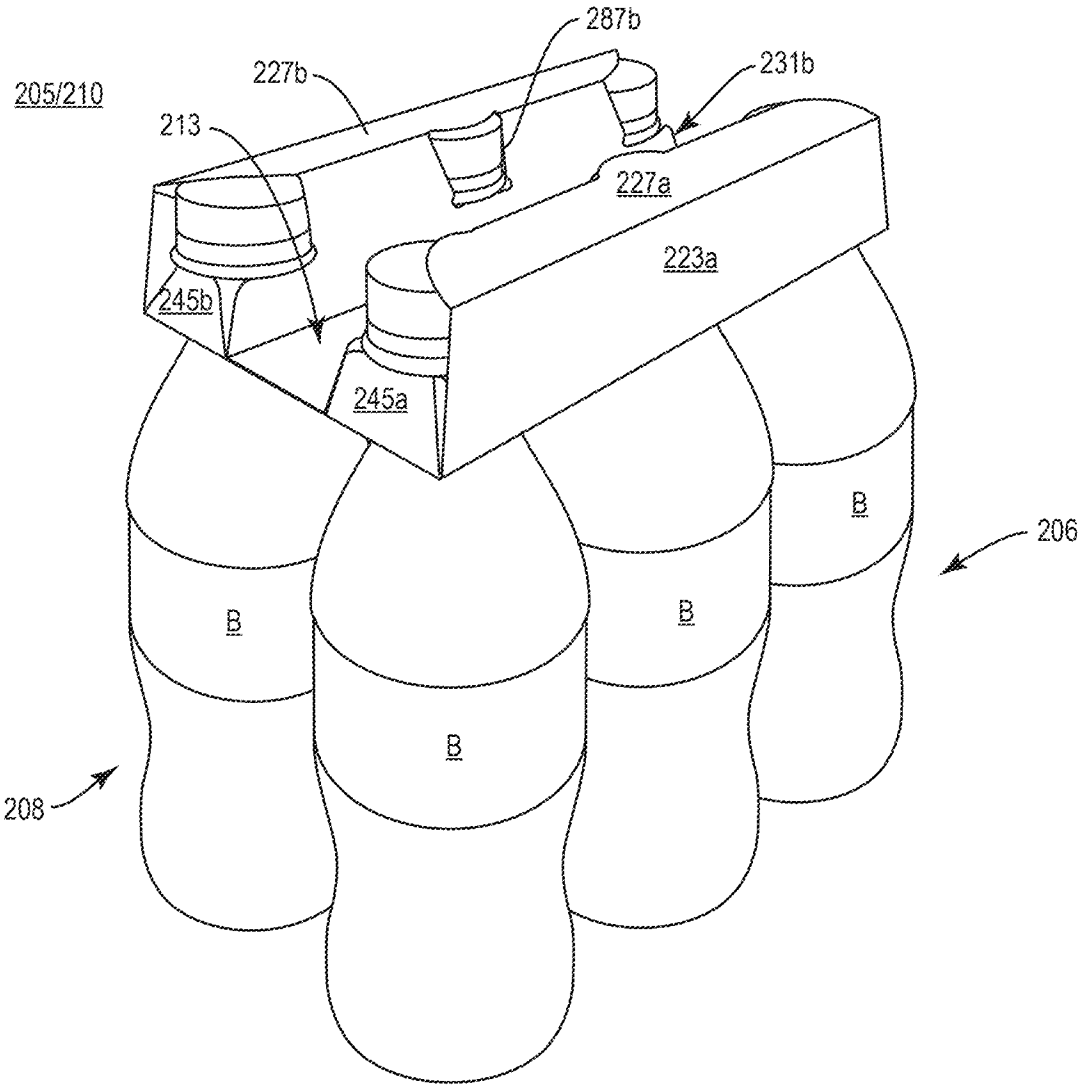
FIG. 7 is a perspective view of the package and carrier formed from the blank of FIG. 5 according to the second exemplary embodiment.

As shown in FIG. 7, the carrier 205 is sized to contain or support six containers, with three containers B being attached to a front portion 206 of the carrier 205 and three containers B being attached to a back portion 208 of the carrier 205. The carrier 205 can be sized and shaped to hold more or less than six containers. In one embodiment, the front portion 206 and the back portion 208 of the carrier 205 each have three containers, and in other embodiments, the front portion 206 and the back portion 208 of the carrier 205 can carry more or less than three containers without departing from the disclosure.

In the illustrated embodiment, the containers B can be bottles, e.g., plastic bottles formed of polyethylene terephthalate (PET) or another polymer, and having upper portions that include an at least partially tapered neck portion N intersecting a flange F that at least partially supports a cap CP. In other embodiments, the containers B could be beverage cans or another suitable type and size of container.

With continued reference to FIG. 5 and the enlarged view of FIG. 5A, the blank 203 has a longitudinal axis L1 and a lateral axis L2. The blank 203 has a front portion 207 for forming the front portion 206 of the carrier 205, a back portion 209 for forming the back portion 208 of the carrier 205, and a central or reinforcement portion 211 for forming a central or reinforcement portion 213 of the carrier 205 extending from the front portion 206 of the carrier 205 to the back portion 208 of the carrier 205 for reinforcing the carrier 205.

The blank 203 and carrier 205 formed therefrom can include a plurality of panels and a plurality of end flaps foldably connected to a respective panel of the plurality of panels.

The front portion 207 of the blank 203 and the carrier 205 formed therefrom can include a front portion 221*a* of an attachment panel 221 (broadly, "central attachment panel"), a front panel 223*a* foldably connected to the attachment panel 221 at a lateral fold line 225*a*, a front top panel 227*a* foldably connected to the front panel 223*a* at a lateral fold line 229*a*, and a front reinforcement panel 231*a* foldably connected to the top panel 227*a* at a lateral fold line 233*a*.

As shown, the front reinforcement panel 231*a* can include an inner portion 235*a* foldably connected to the top panel 227*a* at the lateral fold line 233*a*, a central or reinforcement portion 237*a* foldably connected to the inner portion 235*a* at a lateral fold line 239*a*, and an attachment portion 241*a* foldably connected to the central portion 237*a* at a lateral fold line 243*a*.

In some embodiments, the front panel 223*a* can be an outer front panel, the inner portion 235*a* of the reinforcement panel 231*a* can be an inner front panel, the reinforcement portion 237*a* of the reinforcement panel 231*a* can be a reinforcement panel, and the attachment portion 241*a* of the reinforcement panel 231*a* can be a reinforcement flap of the blank/carrier.

The front portion of the blank 203 and the carrier 205 formed therefrom can also include a first gusset end flap 245*a* and a second gusset end flap 245*a* foldably connected to respective portions of the attachment panel 221 and the front panel 223*a* at opposite longitudinal ends of the blank 203/carrier 205. Each gusset end flap 245*a*, as shown, can include an inner portion 247*a* foldably connected to a respective portion of the attachment panel 221 at a longitudinal fold line 249*a*, a central portion 251*a* foldably connected to the inner portion 247*a* at an oblique fold line 253*a*, and an outer portion 255*a* foldably connected to the front panel 223*a* at an oblique fold line 257*a* and to the central portion 251*a* at an oblique fold line 259*a*.

The blank 203 and carrier 205 formed therefrom can also include a plurality of container retention features for at least partially receiving a respective container B of a plurality of containers B. In the illustrated embodiment, the attachment panel 221 can include a plurality of container retention openings 261, 263. As shown, the container retention openings 261 can be positioned adjacent longitudinal ends of the blank 203/carrier 205 and the container retention openings 263 can be positioned therebetween, though a different arrangement of container openings can be provided without departing from the disclosure.

Each container retention opening 261, as shown, can have a generally circular configuration, and a plurality of container retention tabs 265, 267, 269 can be foldably connected to the attachment panel 221 at respective fold lines and positioned extending into the respective container retention opening 261.

As shown, a pair of laterally-opposed container retention tabs 265 can be foldably connected to the attachment panel 221 at a respective portion of the lateral fold line 225*a* and a lateral fold line 271, and can be separated at a lateral cut 273. The container retention tabs 267 can be foldably connected to the attachment panel 221 at a respective portion of the respective fold lines 249*a* and separated from the container retention tabs 265 at a lateral cut 274. Similarly, the container retention tabs 269 can be foldably connected to the attachment panel 221 at respective longitudinal fold lines 275, and can be separated from the container retention tabs 265 at a cut 277.

With continued reference to FIGS. 5 and 5A, a plurality of container retention tabs 279 can be foldably connected to the attachment panel 221 at respective oblique fold lines 281 and positioned at least partially extending into the respective container retention openings 263. Abutting container retention tabs 279 can be separable from one another at a respective plurality of cuts 283. In some embodiments, one or more of the container retention tabs 279 can include a line of weakening at least partially formed along an interior region thereof, for example, to facilitate relative movement of portions thereof.

The container retention features can also include a container retention opening 285*a* at least partially interrupting the fold line 233*a* for at least partially receiving a respective portion of a container B of the plurality of containers B.

The blank 203 and carrier 205 formed therefrom can further include handle features for forming a handle 213 of the carrier 205. In the illustrated embodiment, the handle features can include a pair of laterally spaced apart handle openings 287 defined in a reinforcement portion 221*c* of the attachment panel 221 between the front portion 221*a* and a back portion 221*b* of the attachment panel 221.

In addition, a pair of laterally spaced apart handle openings 289*a* can be defined in the central portion 237*a* of the front reinforcement panel 231*a*, and a pair of handle reinforcement flaps 291*a* can be foldably connected to the front reinforcement panel 231 at respective longitudinal fold lines 293*a* and positioned extending into the respective handle openings 289*a*.

In the illustrated embodiment, the back portion 209 of the blank 203 can include a back portion 221*b* of the attachment panel 221, a back panel 223*b*, a back top panel 227*b*, a back reinforcement panel 231*b*, and gusset end flaps 245*b* having associated features that are generally a mirror-image of the corresponding portions of the front portion 207 of the blank 203. Corresponding components (e.g., panels, flaps, fold lines, cuts, etc.) have been designated by corresponding reference numbers that differ by the "a" or "b" suffix, with the "a" components corresponding to the front portion 207 of the blank 203 and the "b" components corresponding to the back portion 209 of the blank 203.

In some embodiments, the back panel 223*b* can be an outer back panel, the inner portion 235*b* of the reinforcement panel 231*b* can be an inner back panel, the reinforcement portion 237*b* of the reinforcement panel 231*b* can be a reinforcement panel, and the attachment portion 241*b* of the reinforcement panel 231*b* can be a reinforcement flap of the blank/carrier.

Any of the panels, flaps, fold lines, cuts, or other features could be otherwise shaped, arranged, and/or omitted from the blank 203 without departing from the disclosure. The blank 203 could be sized and/or shaped to accommodate more or less than six containers without departing from this disclosure.

Figure 6:
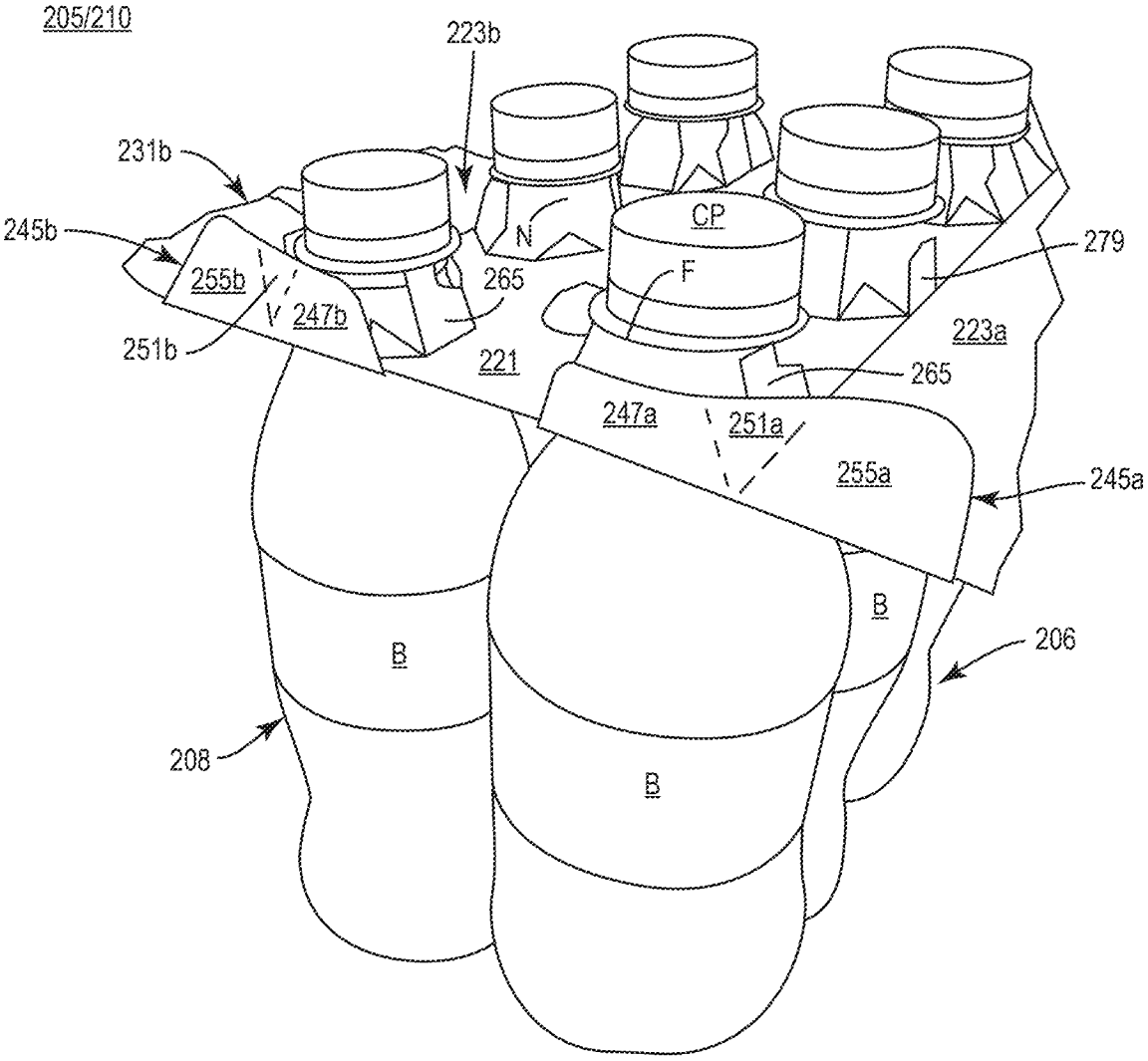
FIG. 6 is a perspective view of a formation of a package and carrier from the blank of FIG. 5 according to the second exemplary embodiment.

As shown in FIG. 6, the blank 203 can be inverted such that the exterior surface 201 of the blank 203 can be placed atop the containers B such that the container retention openings 261, 263 of the attachment panel 221 overlie the containers B. Further downward positioning of the attachment panel 221 over the plurality of containers B can activate one or more container retention features to engage respective containers B.

For example, as the attachment panel 221 is lowered or urged downwardly onto the containers B, the respective cap CP and flange F, and, in some embodiments, a portion of the respective neck N, can be at least partially received through the respective container retention openings 261, 263. Such relative movement of the attachment panel 221 and the containers B can cause the respective container retention tabs 265, 267, 269 to separate from one another at the respective cuts 273, 274, 277 and to fold at least partially upwardly at the respective fold lines 225*a*, 271, 249*a*, 275 toward the respective cap CP and/or flange F.

Similarly, the respective container retention tabs 279 can separate from one another at the respective cuts 283 and can fold at least partially upwardly at the respective fold lines 281 toward the respective cap CP and/or flange F of a respective container B being at least partially received through the respective container retention opening 263.

In such an arrangement, the respective container retention tabs 265, 267, 269, 279 can be positioned extending upwardly from the attachment panel 221 to a portion of the respective container B. In some embodiments, the respective container retention tabs 265, 267, 269, 279 can contact an underside of a respective flange F of a respective container B in a bracing arrangement.

With continued reference to FIG. 6, the gusset end flaps 245*a*, 245*b* can be folded upwardly at the respective fold lines 249*a*, 257*a*, 249*b*, 257*b* into an at least partially upright arrangement relative to the attachment panel 221. In this regard, the gusset end flaps 245*a* can be positioned between the front top panel 227*a* and the front portion 221*a* of the attachment panel 221.

Simultaneously or thereafter, the front panel 223*a* and the back panel 223*b* can be folded upwardly relative to the attachment panel 221 at the respective fold lines 225*a*, 225*b*. Such movement of the panel 223*a* can cause the respective outer portions 255*a* of the respective gusset end flaps 245*a* to further fold at the respective fold lines 257*a* into overlapping and/or at least partial face-to-face contact with respective portions of the front panel 223*a*. The respective central portion 251*a* can fold at the respective fold lines 259*a*, 253*a* to extend obliquely from the respective outer portion 255*a* to the respective inner portion 247*a*.

Similarly, the respective outer portions 255*b* of the respective gusset end flaps 245*b* can be caused to further fold at the respective fold lines 257*b* into overlapping and/or at least partial face-to-face contact with respective portions of the back panel 223*b*. The respective central portion 251*b* can fold at the respective fold lines 259*b*, 253*b* to extend obliquely from the respective outer portion 255*b* to the respective inner portion 247*b*. In this regard, the gusset end flaps 245*b* can be positioned between the back top panel 227*b* and the back portion 221*b* of the attachment panel 221.

Simultaneously or thereafter, the top panel 227*a* can be folded at the fold line 229*a* into generally parallel and spaced relation with the attachment panel 221 so as to overlie the caps CP of respective containers B, and the reinforcement panel 231*a* can be folded at the fold line 233*a* toward the attachment panel 221.

Further movement of the reinforcement panel 231*a* can include positioning of the inner portion 235*a* extending downwardly from the top panel 227*a*, at least partial folding of the central portion 237*a* at the fold line 239*a* to lie in overlapping and generally parallel relation with the attachment panel 221, and at least partial folding of the outer portion 241*a* at the fold line 243*a* to extend partially upwardly relative to the central portion 231*a*.

Similarly, the top panel 227*b* can be folded at the fold line 229*b* into generally parallel and spaced relation with the attachment panel 221 so as to overlie the caps CP of respective containers B, and the reinforcement panel 231*b* can be folded at the fold line 233*b* toward the attachment panel 221.

Further movement of the reinforcement panel 231*b* can include positioning of the inner portion 235*b* extending downwardly from the top panel 227*b*, at least partial folding of the central portion 237*b* at the fold line 239*b* to lie in overlapping and generally parallel relation with the attachment panel 221 and/or the central portion 237*a* of the attachment panel 231*a*, and at least partial folding of the outer portion 241*b* at the fold line 243*b* to extend partially upwardly and obliquely relative to the central portion 231*b*. The inner portions 235*a*, 235*b* and outer portions 241*a*, 241*b* are thus positioned extending generally upwardly and obliquely away from the respective central portions 237*a*, 237*b*.

In some embodiments, the reinforcement panel 231*b* can be positioned with the central portion 237*b* thereof in at least partial face-to-face contact with the attachment panel 221 and with the reinforcement panel 231*a* in at least partial face-to-face contact and overlying the reinforcement panel 231*b*. In this regard, the outer portion 241*a* of the reinforcement panel 231*a* can be positioned overlying at least a portion of the inner portion 235*b* of the reinforcement panel 231*b*.

Such arrangement of the reinforcement panels 231*a*, 231*b* can provide the panels 231*a*, 231*b* in an at least partially enclosing arrangement around the caps CP, flanges F, and upper portions of the respective necks N of respective containers B.

Such arrangement of the reinforcement panels 231*a*, 231*b* can further position the respective container retention openings 285*a*, 285*b* to receive a respective portion of a respective container B therethrough, e.g., a cap CP and flange F thereof.

As shown in FIG. 7, the formed carrier 205 and package 210 including the containers B provides the front portion 206 and back portion 208 thereof, with the reinforcement portion 213 formed by the respective portion of the attachment panel 221 extending from the front portion 206 to the back portion 208 between respective containers B. Such an arrangement provides reinforcement to the carrier 205 in the course of movement or other loading, e.g., transportation, storage, carrying, incidental to use, etc. In this regard, the arrangement of reinforcement portion 221*c* of the attachment panel 221 provides the carrier 205 with an increased capacity to minimize, inhibit, avoid, prevent, and/or otherwise resist bending, bowing, flexing, buckling, curling, deflection, and/or other deformation.

The carrier 205 can be grasped by inserting a user's fingers through the overlapped and aligned handle openings 289*a*, 289*b*, 287. Such engagement of the carrier 205 by the user can cause one or more of the handle reinforcement flaps 291*a*, 291*b* to fold downwardly at the respective longitudinal fold lines 293*a*, 293*b*, to provide one or more additional plies of material between the user's fingers and the underside of the carrier 205, e.g., for comfort, to avoid pinching, etc. and/or to provide a reinforced structure for engagement by the user that is resistant to tearing or other deformation due to carrying stresses. In this regard, the handle openings 287, 289*a*, 289*b* and handle reinforcement flaps 291*a*, 291*b* and associated features can form handle features of the carrier 205.

The package 210/carrier 205 described above has a compact structure that can, for example, provide materials savings and waste reduction. Additionally, the positioning of the reinforcement portion 221*c* of the attachment panel 221/reinforcement portion 213 between the front portion 206 and the back portion 208 of the carrier 205 results in a robust structure for holding and carrying the containers B. Further, the exposure of one or more portions of the containers B on exterior portions of the carrier 205/package 210 provides a consumer with a clear view of labeling or surface graphics associated with the containers B as well as providing convenient access to remove one or more of the containers B from the carrier 205/package 210. Such an arrangement provides advantages similar to those described above with respect to the carrier 105/package 110 described above.

Figure 8:
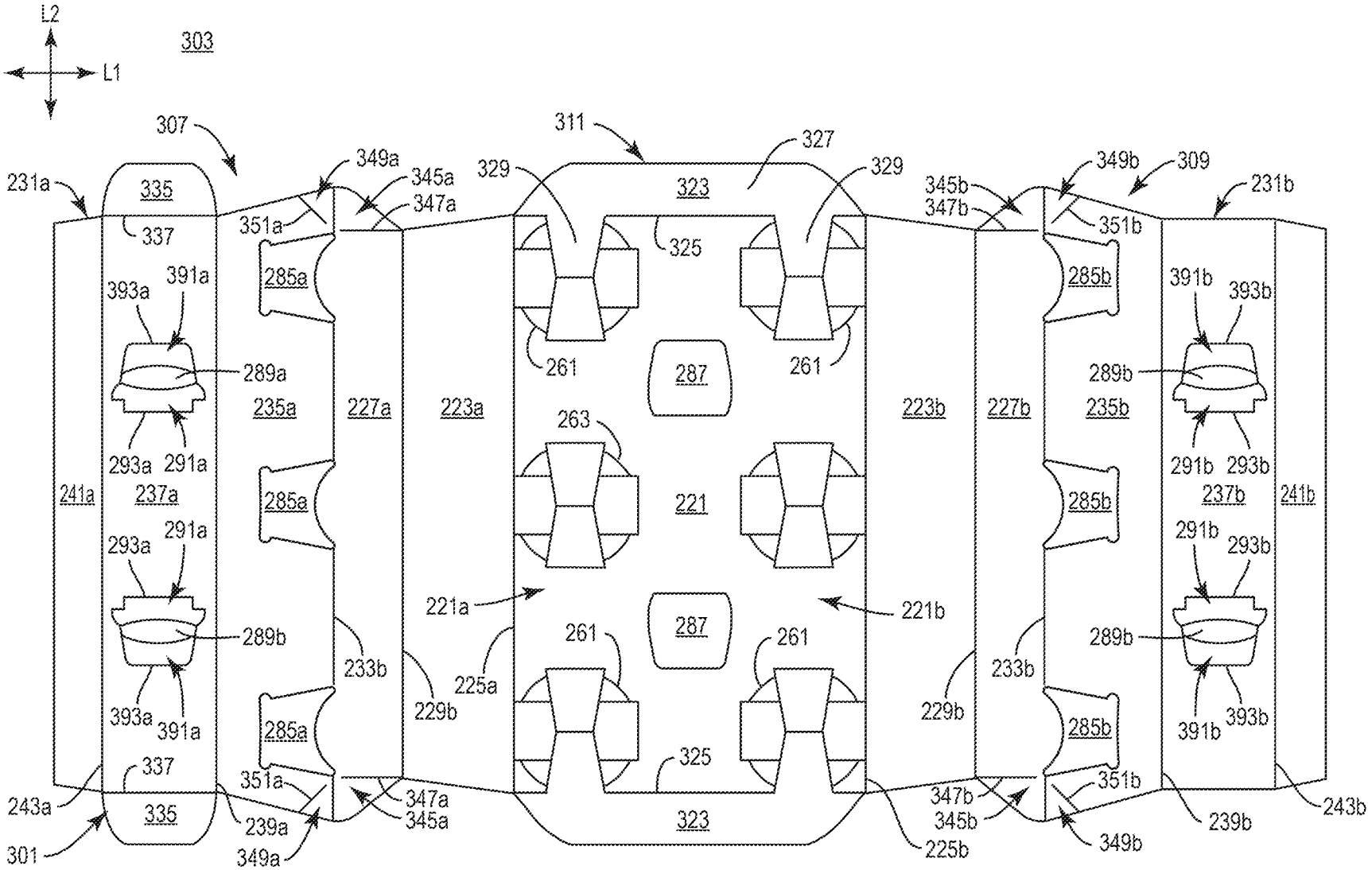
FIG. 8 is a plan view of an outer surface of a blank for forming a package and carrier according to a third exemplary embodiment of the disclosure.
Figure 8A:
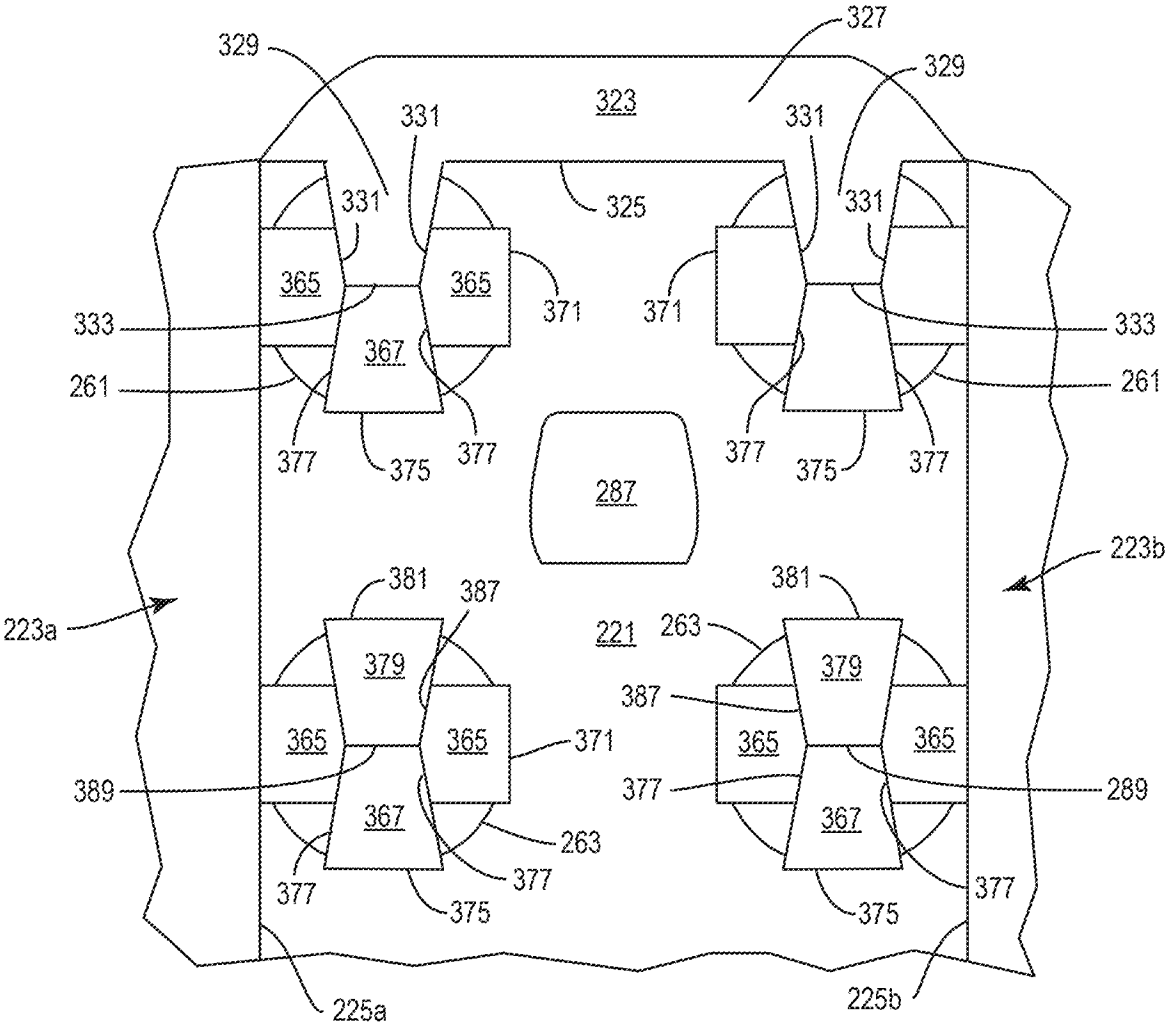
FIG. 8A is an enlarged view of a portion of the blank of FIG. 8.

Turning to FIGS. 8 and 8A, an exterior surface 301 of a blank 303 for forming carrier 305 (FIG. 9) according to a third exemplary embodiment of the disclosure is illustrated. The blank 303 and carrier 305 formed therefrom can have one or more features that are the same or similar to those described above with respect to the blanks 103, 203 and carriers 105, 205 formed therefrom, and like or similar features are designated with like or similar reference numerals. The carrier 305 can be provided with one or more containers B as a package 310.

As shown, the blank 303 can have the longitudinal axis L1, the lateral axis L2, a front portion 307 for forming a front portion 306 of the carrier 305, a back portion 309 for forming a back portion 308 of the carrier 305, and a reinforcement portion 311 extending from the front portion 307 to the back portion 309 for forming a reinforcement portion 313 of the carrier 305 extending from the front portion 306 of the carrier 305 to the back portion 308 of the carrier 305 for reinforcing the carrier 305. The blank 303 and carrier 305 formed therefrom can include the panels 221, 223*a*, 223*b*, 227*a*, 227*b*, 231*a*, 231*b*, as shown.

In the illustrated embodiment, the attachment panel 221 defines the container retention openings 261, 263. A plurality of container retention tabs 365, 367 can be foldably connected to the attachment panel 221 and positioned extending into the respective container retention opening 261. As shown, a pair of laterally-opposed container retention tabs 365 can be foldably connected to the attachment panel 221 at a respective portion of the lateral fold line 225*a* and a lateral fold line 371. The container retention tabs 367 can be foldably connected to the attachment panel 221 at respective longitudinal fold lines 375, and can be separated from the container retention tabs 365 at a pair of oblique cuts 377.

A similar arrangement of container retention tabs 365, 367 can be foldably connected to the attachment panel 221 and positioned extending into the respective container retention openings 263. In addition, a respective container retention tab 379 can be foldably connected to the attachment panel 221 at a respective longitudinal fold line 381, and can be separable from the respective container retention tabs 365 at a respective pair of oblique cuts 387 and from the container retention tabs 367 at a longitudinal cut 389.

As also shown, a plurality of laterally spaced container retention openings 285 are positioned in each of the reinforcement panels 231*a*, 231*b*, each corresponding to a respective container retention opening 261, 263 for at least partially receiving an associated container B when the carrier 305 is formed from the blank 303.

With continued reference to FIG. 8 and the enlarged view of FIG. 8A, the blank 303 and carrier 305 can be devoid of the gusset end flaps 245*a*, 245*b*, but gusset end flaps 345*a* can be foldably connected to opposite edges of the front top panel 227*a* at respective oblique fold lines 347*a*, and can be for cooperating with respective gusset sections 349*a* of the interior portion 235*a* of the reinforcement panel 231*a* at least partially defined by respective oblique fold lines 351*a*. The respective gusset end flaps 345*a* can be foldably connected to the respective gusset sections 349*a* at a respective portion of the fold line 233*a*.

Similarly, gusset end flaps 345*b* can be foldably connected to opposite edges of the back top panel 227*b* at respective oblique fold lines 347*b*, and can be for cooperating with respective gusset sections 349*b* of the interior portion 235*b* of the reinforcement panel 231*b* at least partially defined by respective oblique fold lines 351*b*. The respective gusset end flaps 345*b* can be foldably connected to the respective gusset sections 349*b* at a respective portion of the fold line 233*b*.

In some embodiments, one or more of the gusset sections 349*a*, 349*b* can be considered end flaps of the plurality of end flaps of the blank 303 and carrier 305 formed therefrom.

In the illustrated embodiment, the blank 303 and carrier 305 formed therefrom can have a plurality of end flaps foldably connected to a respective panel of the plurality of panels thereof. In addition to the gusset end flaps 345*a*, 345*b*, the plurality of end flaps can include a pair of attachment panel end flaps 323 foldably connected to opposite edges of the attachment panel 221 at respective longitudinal fold lines 325. As shown, each attachment panel end flap 323 can include a base portion 327 and a pair of tab portions 329 extending therefrom so as to interrupt the respective fold line 325.

The tab portions 329 of the attachment panel end flaps 323 can be positioned extending into the respective container retention openings 261, e.g., so as to interrupt the generally circular edge thereof, and can be separable from the container retention tabs 365 at a pair of oblique cuts 331 and can be separable from the container retention tabs 367 at a longitudinal cut 333.

The plurality of end flaps of the blank 303 and carrier 305 formed therefrom can also include a pair of reinforcement panel end flaps 335 foldably connected to opposite edges of the reinforcement panel 231*a* at respective longitudinal fold lines 337.

Handle features of the blank 303 and carrier 305 formed therefrom can include the handle openings 287, 289*a*, 289*b*, and handle reinforcement flaps 291*a*, 291*b*. However, an additional handle reinforcement flap 391*a*, 391*b* can be foldably connected to the respective reinforcement panel 231*a*, 231*b* at a respective longitudinal fold lines 393*a*, 393*b* and positioned extending into the respective handle opening 291*a*, 291*b*.

Figure 9:
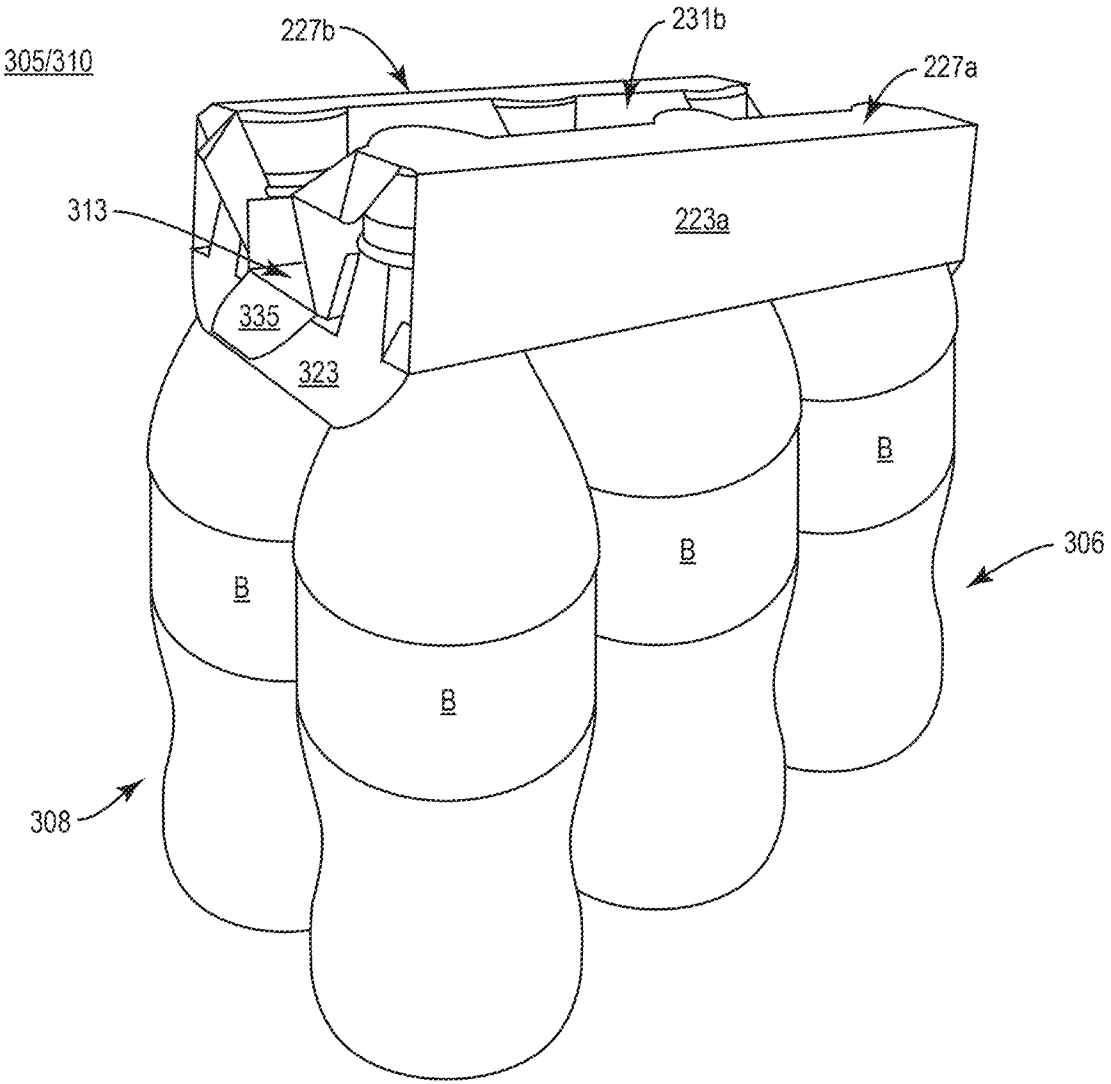
FIG. 9 is a perspective view of the package and carrier formed from the blank of FIG. 8 according to the third exemplary embodiment.

Turning to FIG. 9, formation of the carrier 305 from the blank 303 according to one exemplary embodiment will be described.

The blank 303 can be inverted such that the exterior surface 301 of the blank 303 can be placed atop the containers B such that the container retention openings 261, 263 of the attachment panel 221 overlie the containers B. Further downward positioning of the attachment panel 221 over the plurality of containers B can activate one or more container retention features to engage respective containers B.

For example, as the attachment panel 221 is lowered or urged downwardly onto the containers B, the respective cap CP and flange F, and, in some embodiments, a portion of the respective neck N, can be at least partially received through the respective container retention openings 261, 263. Such relative movement of the attachment panel 221 and the containers B can cause the respective container retention tabs 365, 367, 379 to separate from one another at the respective cuts 377, 387, 389 and to fold at least partially upwardly at the respective fold lines 225*a*, 371, 375, 381 toward the respective cap CP and/or flange F. In addition, the tab portions 329 of the attachment panel end flaps 323 can separate from the adjacent end flaps 365, 367 at the respective cuts 331, 333 and bend/flex upwardly toward the respective cap CP and/or flange F.

In such an arrangement, the respective container retention tabs 365, 367, 379 and tab portions 329 can be positioned extending upwardly from the attachment panel 221 to a portion of the respective container B. In some embodiments, the respective container retention tabs 365, 367, 379 and tab portions 329 can contact an underside of a respective flange F of a respective container B in a bracing arrangement.

With continued reference to FIG. 9, the attachment panel end flaps 323 can be folded downwardly at the respective fold lines 325 so as to extend at least partially downwardly away from the attachment panel 221.

The panels, 223*a*, 223*b*, 227*a*, 227*b*, 231*a*, 231*b* can be folded in a manner similar to that described above with respect to the blank 203 and carrier 205, e.g., at the respective fold lines 225*a*, 225*b*, 229*a*, 229*b*, 233*a*, 233*b* such that the panels 223*a*, 227*a*, 231*a* extend at least partially around upper portions of the respective containers B and such that the panels 223*b*, 227*b*, 231*b* extend at least partially around upper portions of the respective containers B.

Upon such movement of the panels of the blank 303/carrier 305, the respective gusset end flaps 345*a* can at least partially fold relative to the panel 227*a* at the respective fold line 347*a*, and the respective gusset portions 349*a* of the panel 231*a* can fold relative to the interior portion 235*a* thereof at the respective fold lines 351*a* and relative to the respective gusset end flaps 345*a* at the respective portion of the fold line 233*a* so as to extend from the interior portion 235*a* of the panel 231*a* to the respective gusset end flap 345*a*. In some embodiments, one or both of the gusset portions 349*a* can be positioned in at least partial face-to-face contact with the respective gusset end flap 345*a* and/or the interior portion 235*a* of the panel 231*a*. In this regard, the gusset end flaps 345*a* and gusset portions 349*a* can be positioned between the front top panel 227*a* and the front portion 221*a* of the attachment panel 221.

Similarly, the respective gusset end flaps 345*b* can at least partially fold relative to the panel 227*b* at the respective fold line 347*b*, and the respective gusset portions 349*b* of the panel 231*b* can fold relative to the interior portion 235*b* thereof at the respective fold lines 351*b* and relative to the respective gusset end flaps 345*b* at the respective portion of the fold line 233*b* so as to extend from the interior portion 235*b* of the panel 231*b* to the respective gusset end flap 345*b*. In some embodiments, one or both of the gusset portions 349*b* can be positioned in at least partial face-to-face contact with the respective gusset end flap 345*b* and/or the interior portion 235*b* of the panel 231*b*. In this regard, the gusset end flaps 345*b* and gusset portions 349*b* can be positioned between the back top panel 227*b* and the back portion 221*b* of the attachment panel 221.

Such arrangement of the reinforcement panels 231*a*, 231*b* can provide the panels 231*a*, 231*b* in an at least partially enclosing arrangement around the caps CP, flanges F, and upper portions of the respective necks N of respective containers B. Such arrangement of the reinforcement panels 231*a*, 231*b* can further position the respective container retention openings 285*a*, 285*b* to receive a respective portion of a respective container B therethrough, e.g., a cap CP and flange F thereof.

In the illustrated embodiment, the reinforcement panel 231*a* can be overlapped in at least partial face-to-face contact with the reinforcement panel 231*b* such that the reinforcement panel end flaps 335 are presented overlapping the respective attachment end flaps 323 and extending away from the reinforcement portion 313 of the carrier 305.

In some embodiments, one or both of the reinforcement panel end flaps 335 can be pulled upwardly and/or away from the attachment panel 221, for example, to at least partially separate respective portions and/or otherwise deconstruct the carrier 305/package 310, for example, to facilitate access to one or more of the containers B.

In some embodiments, one or more of the reinforcement panel end flaps 335 and the attachment panel end flaps 333 can be grasped as a handle or user engagement feature to move and/or carry the carrier 305/package 310.

Still referring to FIG. 9, the carrier 305 can be grasped by inserting a user's fingers through the overlapped and aligned handle openings 289*a*, 289*b*, 287. Such engagement of the carrier 305 by the user can cause one or more of the handle reinforcement flaps 391*a*, 391*b*, 291*a*, 291*b* to fold downwardly at the respective longitudinal fold lines 393*a*, 393*b*, 293*a*, 293*b*, to provide one or more additional plies of material between the user's fingers and the underside of the carrier 305, e.g., for comfort, to avoid pinching, etc. and/or to provide a reinforced structure for engagement by the user that is resistant to tearing or other deformation due to carrying stresses. In this regard, the handle openings 287, 289*a*, 289*b* and handle reinforcement flaps 391*a*, 391*b*, 291*a*, 291*b* and associated features can form handle features of the carrier 305.

The formed carrier 305 and package 310 including the containers B provides the front portion 306 and back portion 308 thereof, with the reinforcement portion 313 formed by the respective portion of the attachment panel 221 extending from the front portion 306 to the back portion 308 between respective containers B. Such an arrangement provides advantages similar to those described above with respect to the carriers 105, 205/packages 110, 210.

Figure 10:
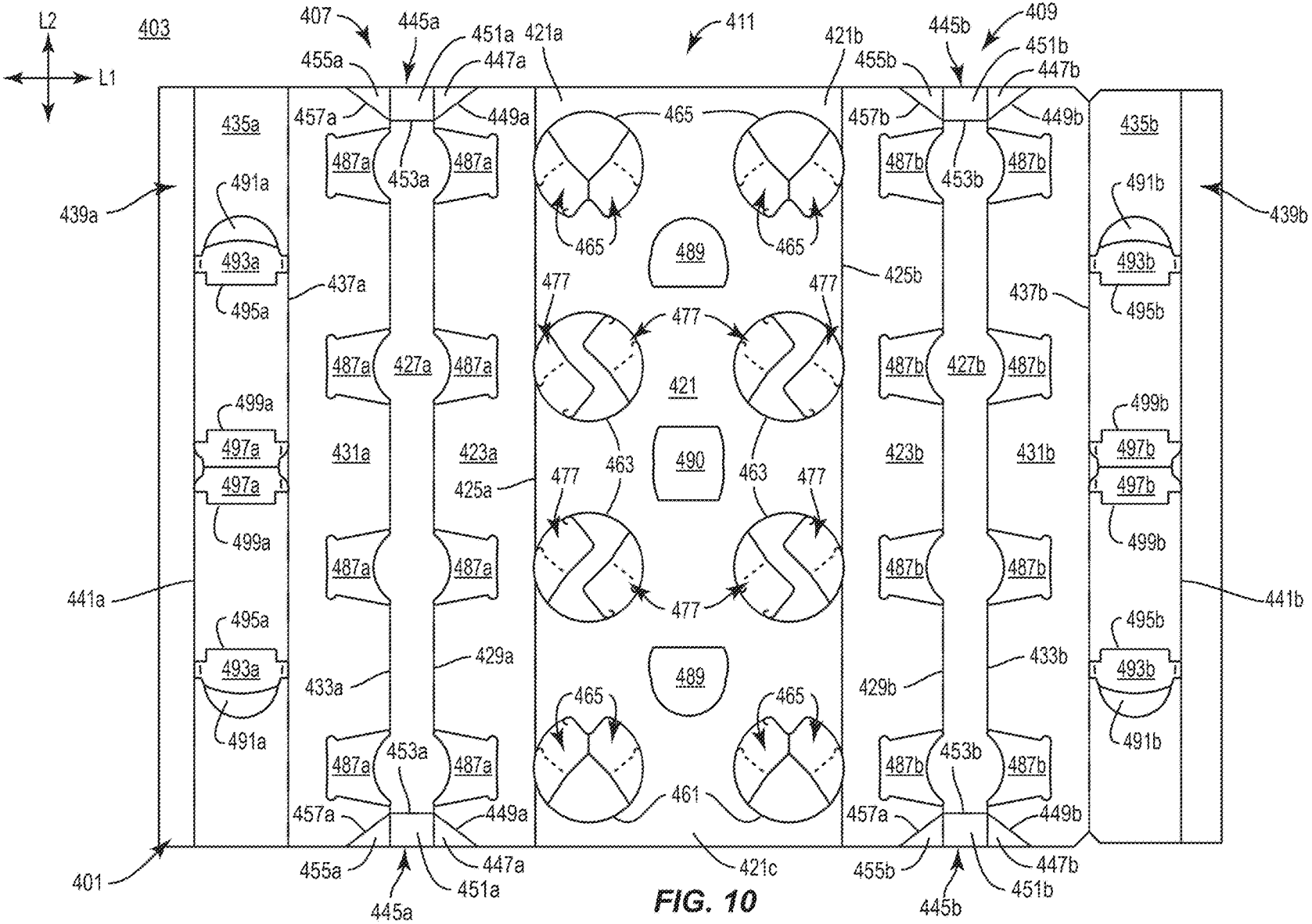
FIG. 10 is a plan view of an outer surface of a blank for forming a package and carrier according to a fourth exemplary embodiment of the disclosure.
Figure 10A:
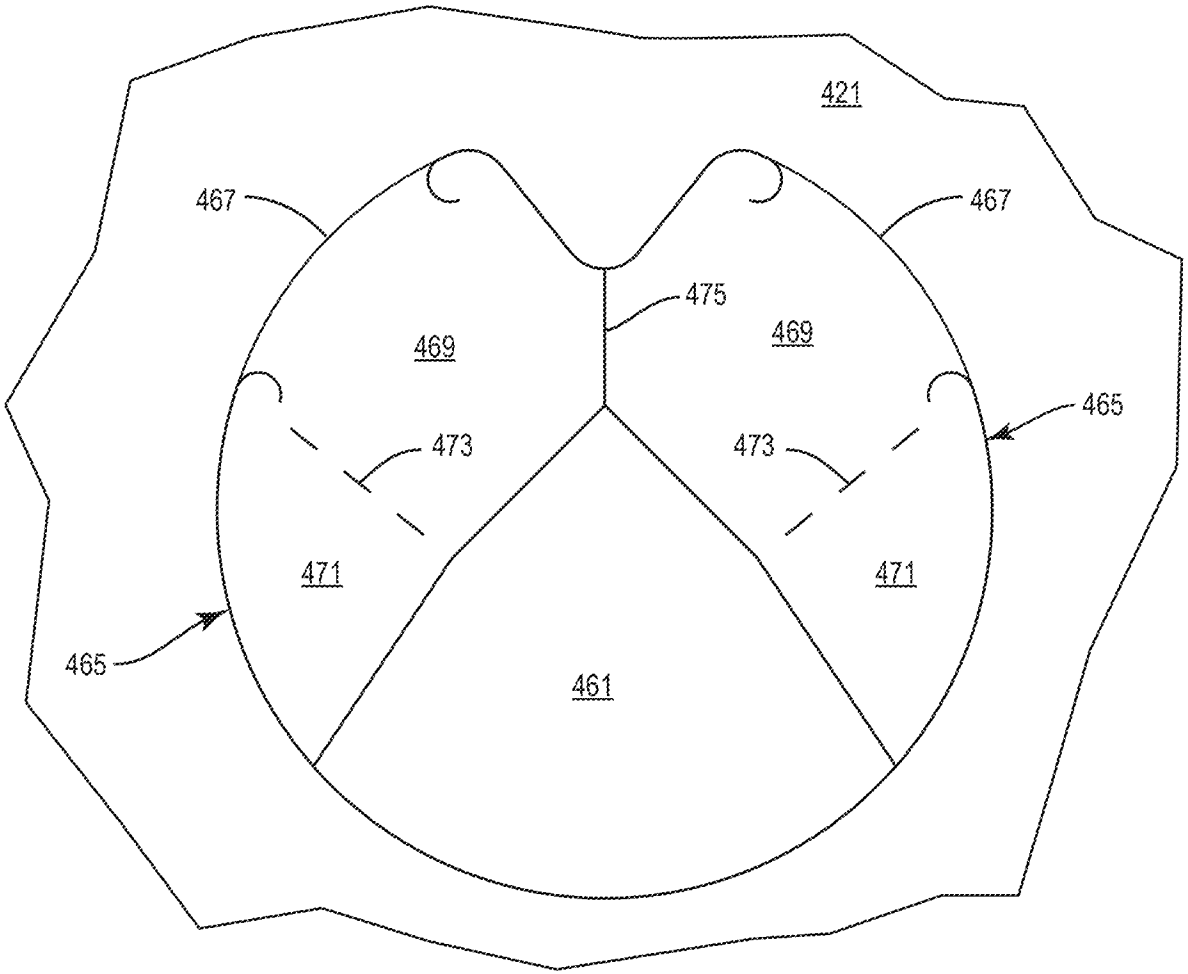
FIG. 10A is an enlarged view of a portion of the blank of FIG. 10.
Figure 10B:
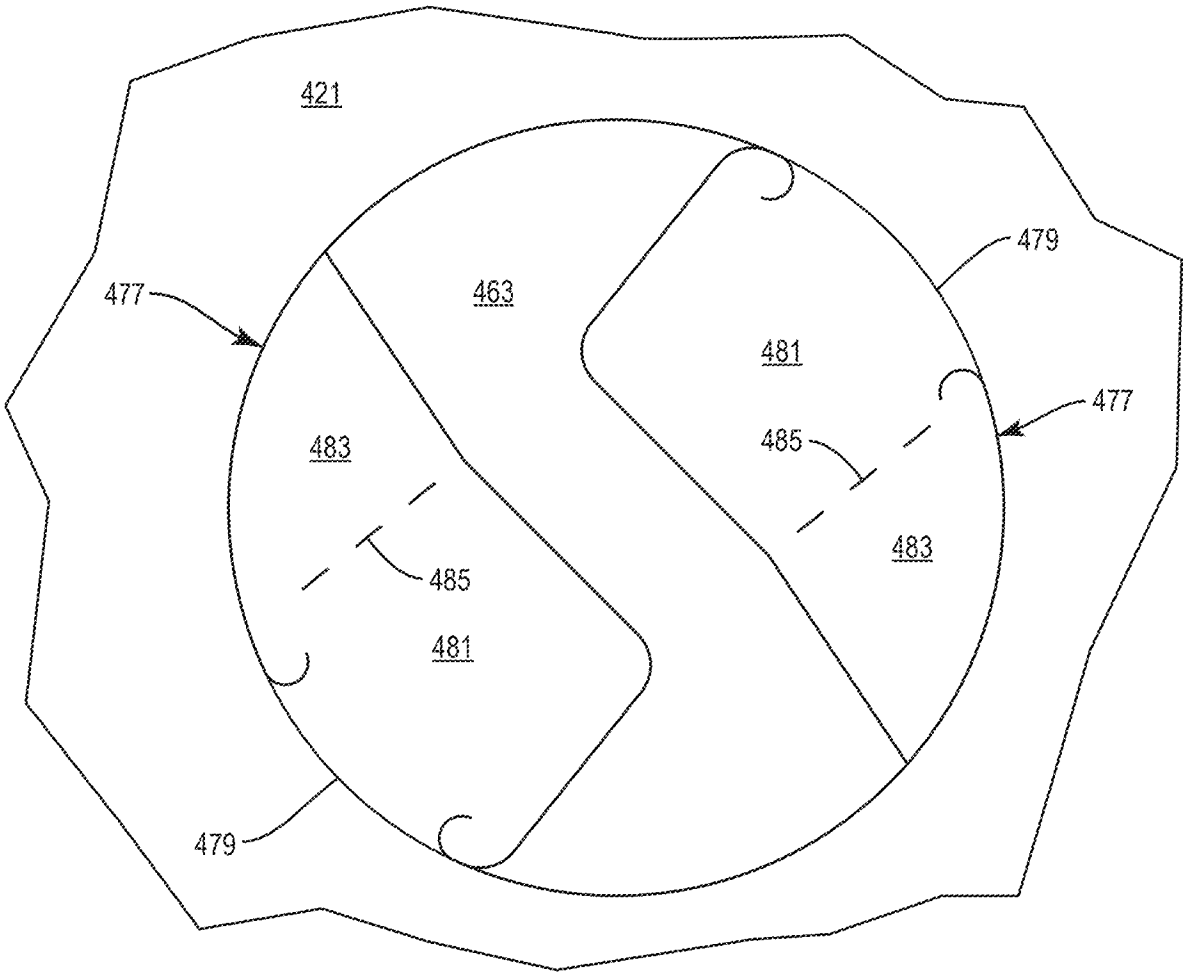
FIG. 10B is an enlarged view of another portion of the blank of FIG. 10.

FIG. 10 is a plan view of an exterior surface 401 of a blank 403 for forming a carrier 405 (FIG. 12) according to a fourth exemplary embodiment of the disclosure. FIGS. 10A and 10B are enlarged views of a portion of the blank 403. The blank 403 and the carrier 405 formed therefrom can have one or more features that are the same or similar to those described above with respect to the blanks 103, 203, 303/carriers 105, 205, 305, and like or similar features are designated with like or similar reference numerals.

Figure 12:
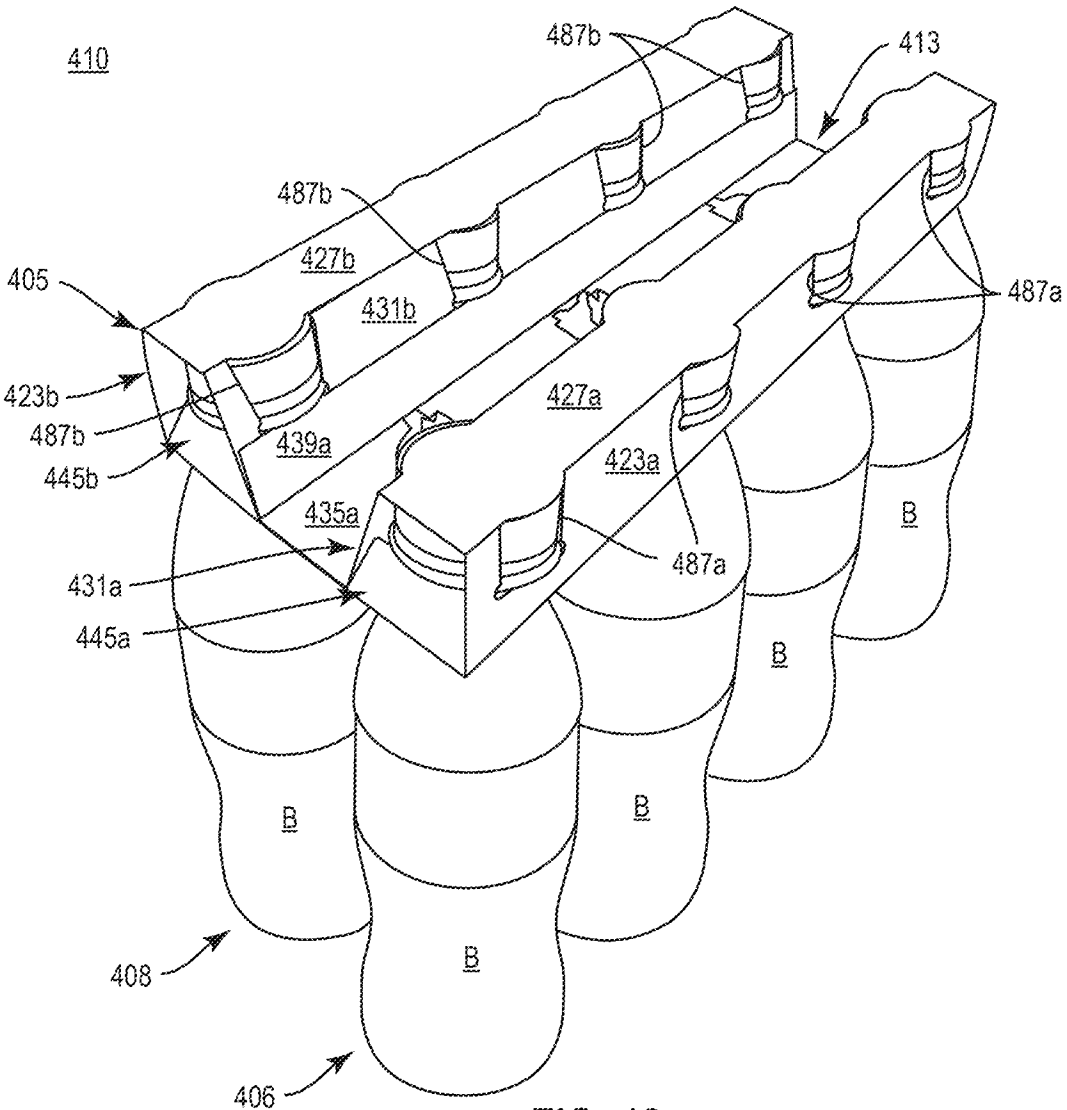
FIG. 12 is a perspective view of the package and carrier formed from the blank of FIG. 10 according to the fourth exemplary embodiment.

As described further herein, the carrier 405 can be configured for holding/supporting/retaining/receiving a plurality of containers. The carrier 405 can be provided with one or more containers to form a package 410 (FIG. 12).

In the illustrated embodiment, the front portion 406 and the back portion 408 of the carrier 405 each have four containers, though the carrier 405 can carry more or less than eight containers without departing from the disclosure. In an alternative configuration, the carrier 405 can be sized to contain or support six containers, with three containers B being attached to a front portion 406 of the carrier 405 and three containers B being attached to a back portion 408 of the carrier 405. The carrier 405 can be sized and shaped to hold a different number of containers B without departing from the disclosure.

With continued reference to FIG. 10, the blank 403 has a longitudinal axis L1 and a lateral axis L2. The blank 403 has a front portion 407 for forming the front portion 406 of the carrier 405, a back portion 409 for forming the back portion 408 of the carrier 405, and a central or reinforcement portion 411 for forming a central or reinforcement portion 413 of the carrier 405 extending from the front portion 406 of the carrier 405 to the back portion 408 of the carrier 405 for reinforcing the carrier 405.

The blank 403 and carrier 405 formed therefrom can include a plurality of panels and a plurality of end flaps foldably connected to a respective panel of the plurality of panels.

The front portion 407 of the blank 403 and the carrier 405 formed therefrom can include a front portion 421*a* of an attachment panel 421 (broadly, "central attachment panel"), an outer front panel 423*a* foldably connected to the attachment panel 421 at a lateral fold line 425*a*, a front top panel 427*a* foldably connected to the front panel 423*a* at a lateral fold line 429*a*, and an inner front panel 431*a* foldably connected to the top panel 427*a* at a lateral fold line 433*a*.

A front reinforcement panel 435*a* can be foldably connected to the inner front panel 431*a* at a lateral fold line 437*a*, and an attachment flap 439*a* can be foldably connected to the reinforcement panel 435*a* at a lateral fold line 441*a*.

In some embodiments, the inner front panel 431*a*, the front reinforcement panel 435*a*, and the attachment flap 439*a* can be considered a respective inner portion, reinforcement portion, and attachment portion of a reinforcement panel.

The front portion of the blank 403 and the carrier 405 formed therefrom can also include a first gusset 445*a* and a second gusset 445*a* foldably connected to respective portions of the attachment panel 421 and the front panels 423*a*, 431*a* at opposite longitudinal ends of the blank 403/carrier 405. Each gusset 445*a*, as shown, can include an inner portion 447*a* foldably connected to a respective portion of the outer front panel 423*a* at an oblique fold line 449*a*, a central portion 451*a* foldably connected to the front top panel 427*a* at a longitudinal fold line 453*a* and to the inner portion 447*a* at a respective portion of the fold line 429*a*, and an outer portion 455*a* foldably connected to the inner front panel 431*a* at an oblique fold line 457*a* and to the central portion 451*a* at a respective portion of the fold line 433*a*.

The blank 403 and carrier 405 formed therefrom can also include a plurality of container retention features for at least partially receiving a respective container B of a plurality of containers B. In the illustrated embodiment, the attachment panel 421 can include a plurality of container retention openings 461, 463. As shown, the container retention openings 461 can be positioned adjacent lateral ends of the blank 403/carrier 405 and the container retention openings 463 can be positioned therebetween, though a different arrangement of container openings can be provided without departing from the disclosure.

Each container retention opening 461, as shown, can have a generally circular configuration interrupted by an inwardly-extending generally V-shaped portion of the attachment panel 421, and a plurality of container retention tabs 465 can be foldably connected to the attachment panel 421 at respective curved fold lines 467 and positioned extending into the respective container retention opening 461.

Each container retention tab 465, as shown, can include a respective base portion 469 foldably connected to the attachment panel 421 at the respective fold line 467, and a respective distal portion 471 foldably connected to the respective base portion 469 at a respective oblique line of weakening 473.

Respective adjacent container retention tabs 465, as shown, can be separable from one another at a respective lateral cut 475. In some embodiments, one or more relief cuts can intersect the respective oblique line of weakening 473. In some embodiments, one or more relief cuts can intersect the respective curved fold line 467.

With continued reference to FIGS. 10, 10A, and 10B, a plurality of container retention tabs 477 can be foldably connected to the attachment panel 421 at respective curved fold lines 479 and positioned extending into the respective container retention openings 463. Each container retention tab 477, as shown, can include a respective base portion 481 foldably connected to the attachment panel 421 at the respective fold line 479, and a respective distal portion 483 foldably connected to the respective base portion 481 at a respective oblique line of weakening 485.

The container retention features can also include a plurality of laterally spaced container retention openings 487*a* at least partially interrupting each of the fold lines 429*a*, 433*a* for at least partially receiving a respective portion of a container B of the plurality of containers B.

The blank 403 and carrier 405 formed therefrom can further include handle features. In the illustrated embodiment, the handle features can include a pair of laterally spaced apart handle openings 489 defined in a reinforcement portion 421*c* of the attachment panel 421 between the front portion 421*a* and a back portion 421*b* of the attachment panel 421. In the illustrated embodiment, a handle opening 490 can be positioned between the handle openings 489.

In addition, a pair of laterally spaced apart handle openings 491*a* can be defined in the top panel 435*a*, and a pair of handle reinforcement flaps 493*a* can be foldably connected to the top panel 435*a* at respective longitudinal fold lines 495*a* and positioned extending into the respective handle openings 491*a*.

A pair of handle reinforcement flaps 497*a* can be foldably connected to the top panel 435*a* at respective longitudinal fold lines 499*a* and separable from one another at a longitudinal cut. The handle reinforcement flaps 497*a* can be positioned extending into a handle opening positioned between the handle openings 491*a*.

In the illustrated embodiment, the back portion 409 of the blank 403 can include a back portion 421*b* of the attachment panel 421, an outer back panel 423*b*, a back top panel 427*b*, an inner back panel 431*b*, a back reinforcement panel 435*b*, a back attachment flap 439*b*, and gussets 445*b* having associated features that are generally a mirror-image of the corresponding portions of the front portion 407 of the blank 403. Corresponding components (e.g., panels, flaps, fold lines, cuts, etc.) have been designated by corresponding reference numbers that differ by the "a" or "b" suffix, with the "a" components corresponding to the front portion 407 of the blank 403 and the "b" components corresponding to the back portion 409 of the blank 403.

Any of the panels, flaps, fold lines, cuts, or other features could be otherwise shaped, arranged, and/or omitted from the blank 403 without departing from the disclosure. The blank 403 could be sized and/or shaped to accommodate more or less than six containers without departing from this disclosure.

Figure 11:
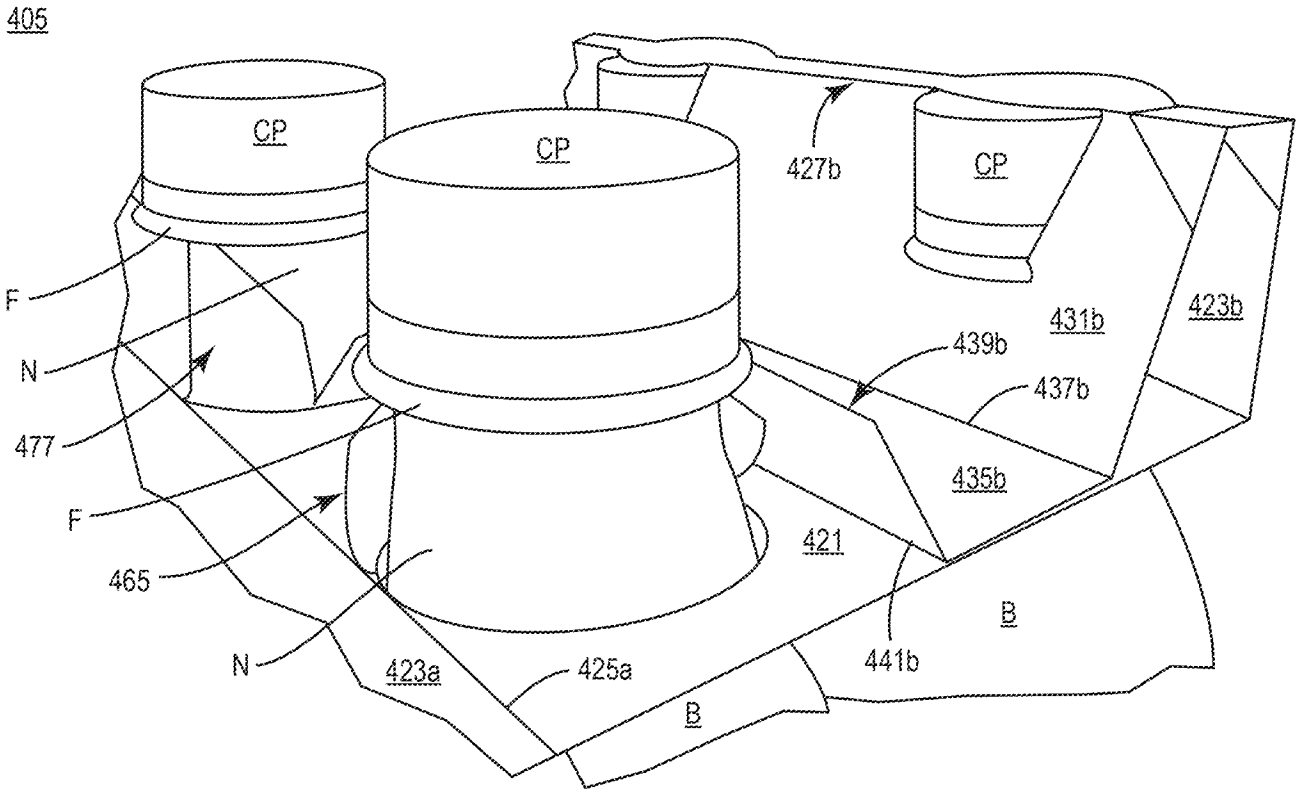
FIG. 11 is a perspective view of a formation of a package and carrier from the blank of FIG. 10 according to the fourth exemplary embodiment.

As shown in FIG. 11, the blank 403 can be inverted such that the exterior surface 401 of the blank 403 can be placed atop the containers B and such that the container retention openings 461, 463 of the attachment panel 421 overlie the containers B. Further downward positioning of the attachment panel 421 over the plurality of containers B can activate one or more container retention features to engage respective containers B.

For example, as the attachment panel 421 is lowered or urged downwardly onto the containers B, the respective cap CP and flange F, and, in some embodiments, a portion of the respective neck N, can be at least partially received through the respective container retention openings 461, 463. Such relative movement of the attachment panel 421 and the containers B can cause the respective container retention tabs 465 to separate from one another at the respective cuts 475 and to fold at least partially upwardly at the respective fold lines 467 toward the respective cap CP and/or flange F.

Such movement of the container retention tabs 465 can include relative movement of a respective base portion 469 and distal portion 471 thereof at a respective lines of weakening 473.

Similarly, the respective container retention tabs 477 can fold at least partially upwardly at the respective fold lines 479 toward the respective cap CP and/or flange F of a respective container B being at least partially received through the respective container retention opening 463.

Such movement of the container retention tabs 477 can include relative movement of a respective base portion 481 and distal portion 483 thereof at a respective lines of weakening 485.

In such an arrangement, the respective container retention tabs 465, 477 can be positioned extending upwardly from the attachment panel 421 to a portion of the respective container B. In some embodiments, the respective container retention tabs 465, 477 can contact an underside of a respective flange F of a respective container B in a bracing arrangement.

With reference to FIGS. 11-12, the gussets 445*a*, 445*b* can be activated, with the central portion 451*a* of the respective gusset 445*a* folded upwardly at the fold line 453*a* and with the respective portions 447*a*, 455*a* folded upwardly at the respective fold lines 449*a*, 457*a* and obliquely toward the central portion 451*a* at respective portions of the respective fold lines 429*a*, 433*a*.

Similarly, the central portion 451*b* of the respective gusset 445*b* can be folded upwardly at the fold line 453*b*, and the respective portions 447*b*, 455*b* can be folded upwardly at the respective fold lines 449*b*, 457*b* and obliquely toward the central portion 451*b* at respective portions of the respective fold lines 429*b*, 433*b*. In this regard, the gussets 445*a* can be positioned between the front top panel 427*a* and the front portion 421*a* of the attachment panel 421, and the gussets 445*b* can be positioned between the back top panel 427*b* and the back portion 421*b* of the attachment panel 421.

Simultaneously or thereafter, the inner front panel 423*a* and the inner back panel 423*b* can be folded upwardly relative to the attachment panel 421 at the respective fold lines 425*a*, 425*b*.

The top panel 427*b* can be folded at the fold line 429*b* into generally parallel and spaced relation with the attachment panel 421 so as to overlie the caps CP of respective containers B, and the inner back panel 431*b* can be folded at the fold line 433*b* toward the attachment panel 421.

The reinforcement panel 435*b* can be positioned to lie in overlapping and generally parallel relation with the attachment panel 421, and the attachment flap 439*b* can be folded at the fold line 441*b* to extend at least partially obliquely upwardly relative to the reinforcement panel 435*b*.

Similarly, the top panel 427*a* can be folded at the fold line 429*a* into generally parallel and spaced relation with the attachment panel 421 so as to overlie the caps CP of respective containers B, and the inner front panel 431*a* can be folded at the fold line 433*a* toward the attachment panel 421. In such an arrangement, the inner front panel 431*a* can at least partially overlie the attachment flap 439*b*.

The reinforcement panel 435*a* can be positioned to lie in overlapping and generally parallel relation with the reinforcement panel 435*b*, and the attachment flap 439*a* can be folded at the fold line 441*a* to extend at least partially obliquely upwardly relative to the reinforcement panel 435*a* to at least partially overlie the inner back panel 431*b*.

In some embodiments, the reinforcement panel 435*a* can be positioned in at least partial face-to-face contact with the attachment panel 421 and with the reinforcement panel 435*b* in at least partial face-to-face contact and overlying the reinforcement panel 435*a*.

Such arrangement of the panels 423*a*, 427*a*, 431*a* can be in an at least partially enclosing arrangement around the caps CP, flanges F, and upper portions of the respective necks N of respective containers B in the front portion 406 of the carrier 405, and such arrangement of the panels 423*b*, 427*b*, 431*b* can be in an at least partially enclosing arrangement around the caps CP, flanges F, and upper portions of the respective necks N of respective containers B in the back portion 408 of the carrier 405.

Such arrangement of the panels 423*a*, 431*a* can further position the respective container retention openings 487*a* to receive a respective portion of a respective container B therethrough, e.g., a cap CP and flange F thereof. Similarly, the panels 423*b*, 431*b* can be positioned such that the respective container retention openings 487*b* at least partially receive a respective portion of a respective container B therethrough.

The formed carrier 405 and package 410 including the containers B provides the front portion 406 and back portion 408 thereof, with the reinforcement portion 413 formed by the respective portion 421*c* of the attachment panel 421 and the respective reinforcement panels 435*a*, 435*b* overlapping the attachment panel 421 and extending from the front portion 406 to the back portion 408 between respective containers B. Such an arrangement provides reinforcement to the carrier 405 in the course of movement or other loading, e.g., transportation, storage, carrying, incidental to use, etc. In this regard, the arrangement of reinforcement portion 411 of the attachment panel 421 provides the carrier 405 with an increased capacity to minimize, inhibit, avoid, prevent, and/or otherwise resist bending, bowing, flexing, buckling, curling, deflection, and/or other deformation.

Still referring to FIGS. 11-12, the carrier 405 can be grasped by inserting a user's fingers through the overlapped and aligned handle openings 489, 491*a*, 491*b* and the handle opening 490 aligned with and overlapped by the handle openings into which the respective handle reinforcement flaps 497*a*, 497*b* extend.

Such engagement of the carrier 405 by the user can cause one or more of the handle reinforcement flaps 493*a* 493*b*, 497*a*, 497*b* to fold downwardly at the respective longitudinal fold lines 495*a*, 495*b*, 499*a*, 499*b* to provide one or more additional plies of material between the user's fingers and the underside of the carrier 405, e.g., for comfort, to avoid pinching, etc. and/or to provide a reinforced structure for engagement by the user that is resistant to tearing or other deformation due to carrying stresses. In this regard, the handle openings 489, 490, 491*a*, 491*b* and handle reinforcement flaps 493*a*, 493*b*, 497*a*, 497*b* and associated features can form handle features of the carrier 405.

The package 410/carrier 405 described above has a compact structure that can, for example, provide materials savings and waste reduction. Additionally, the positioning of the reinforcement portion 421*c* of the attachment panel 421/reinforcement portion 413 between the front portion 406 and the back portion 408 of the carrier 405 results in a robust structure for holding and carrying the containers B. Further, the exposure of one or more portions of the containers B on exterior portions of the carrier 405/package 410 provides a consumer with a clear view of labeling or surface graphics associated with the containers B as well as providing convenient access to remove one or more of the containers B from the carrier 405/package 410. Such an arrangement provides advantages similar to those described above with respect to the carriers 105, 205, 305/packages 110, 210, 310.

Figure 13:
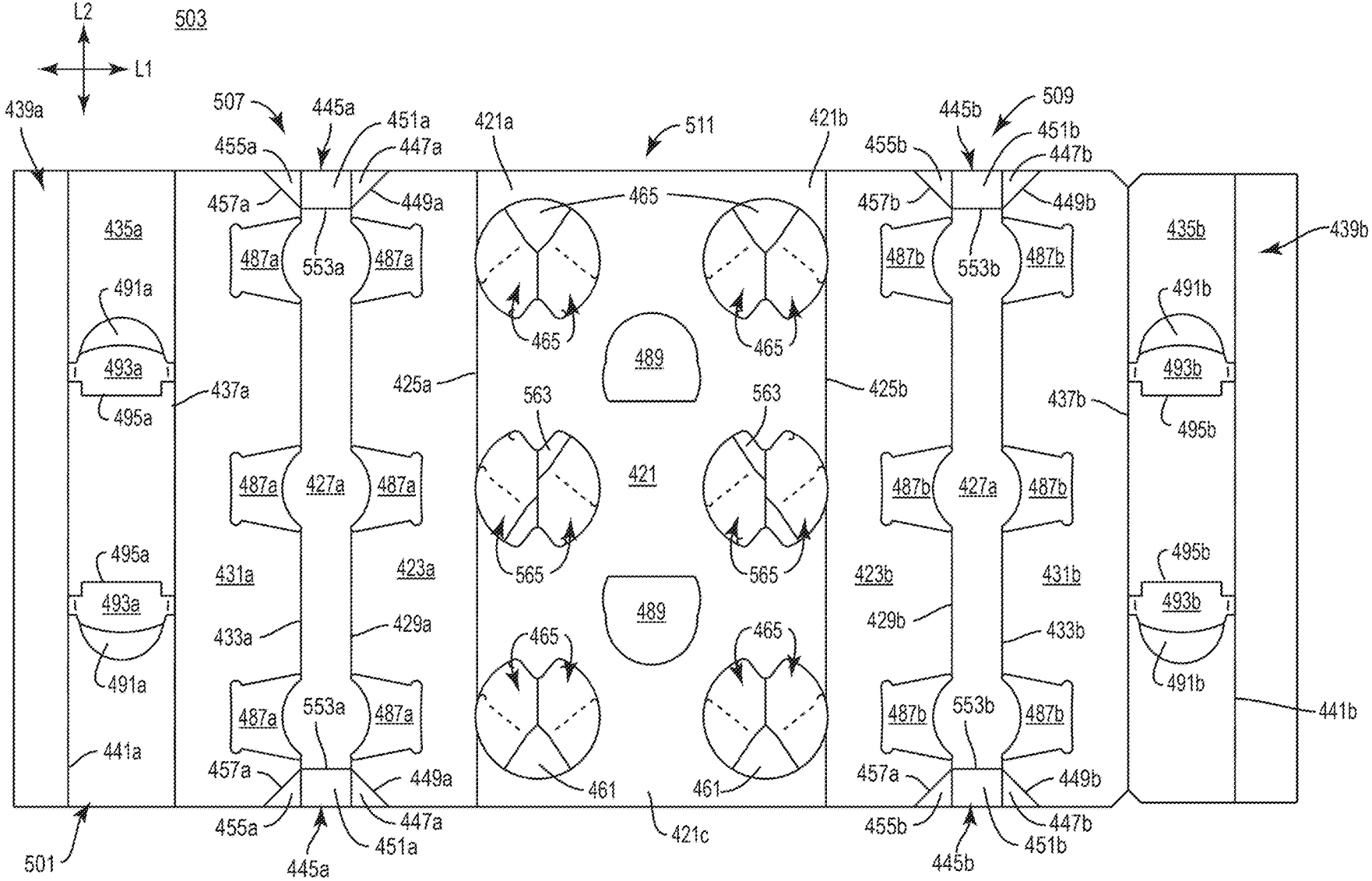
FIG. 13 is a plan view of an outer surface of a blank for forming a package and carrier according to a fifth exemplary embodiment of the disclosure.
Figure 13A:
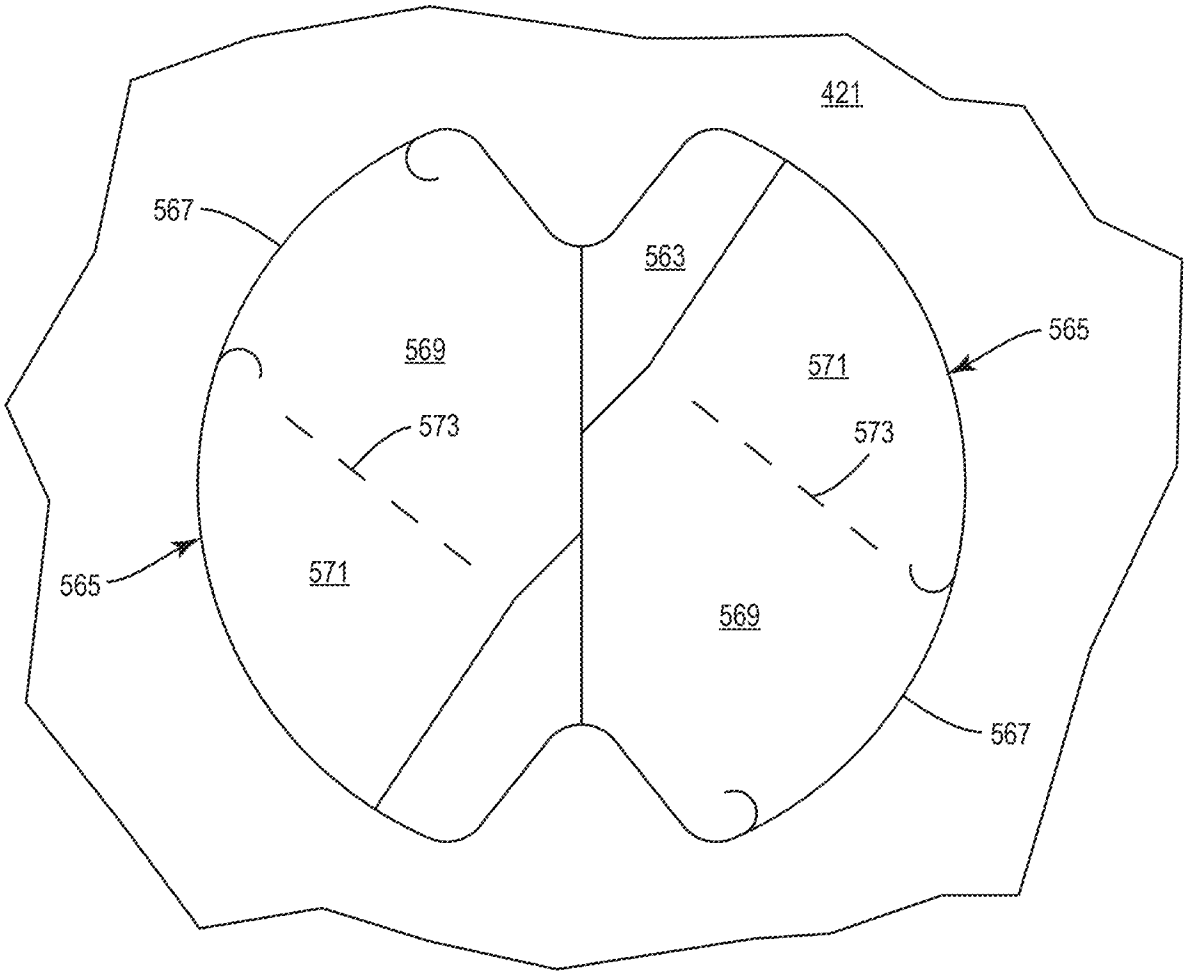
FIG. 13A is an enlarged view of a portion of the blank of FIG. 13.
Figure 14:
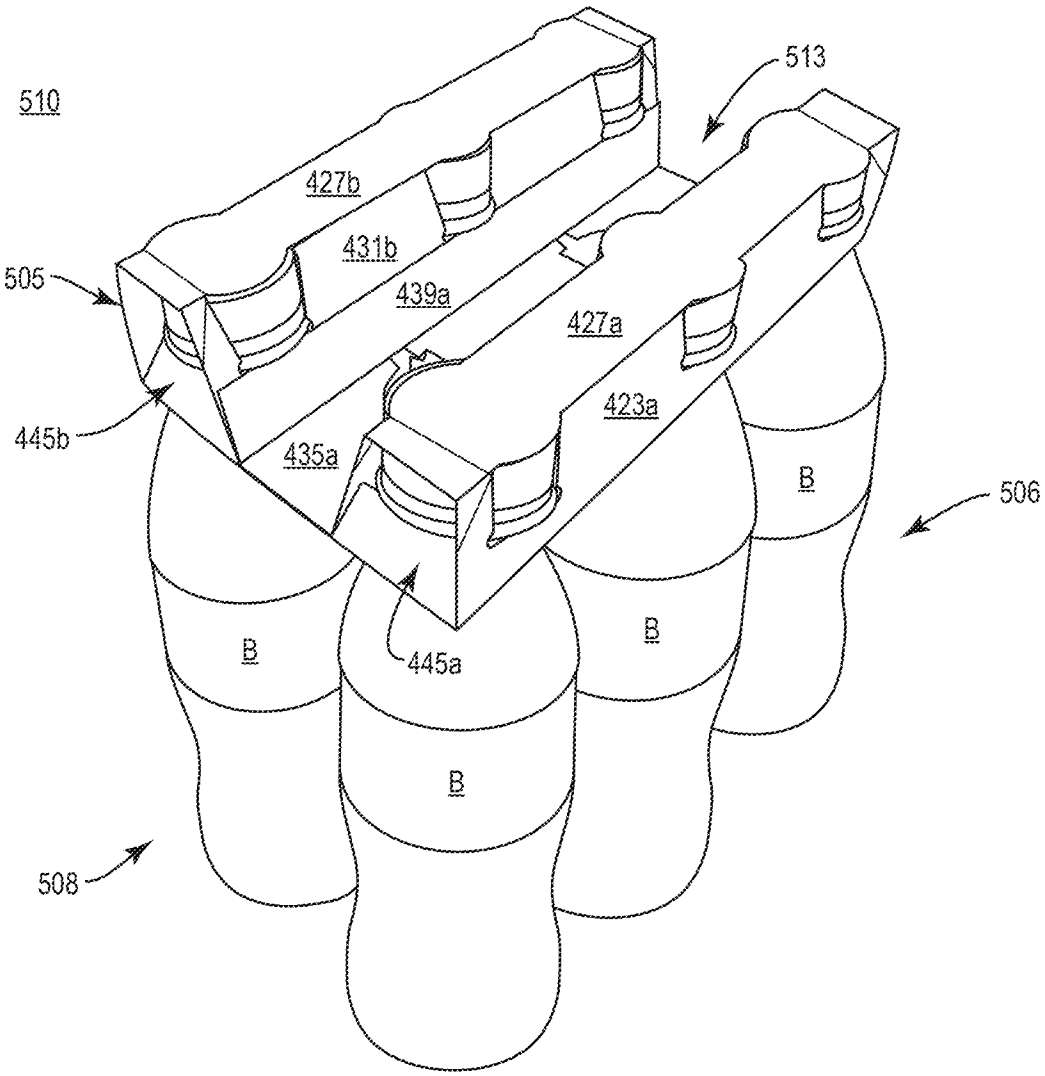
FIG. 14 is a perspective view of the package and carrier formed from the blank of FIG. 13 according to the fifth exemplary embodiment.

Turning to FIGS. 13 and 13A, an exterior surface 501 of a blank 503 for forming a carrier 505 (FIG. 14) according to a fifth exemplary embodiment of the disclosure is illustrated. The blank 503 and carrier 505 formed therefrom can have one or more features that are the same or similar to those described above with respect to the blanks 103, 203, 303, 403 and carriers 105, 205, 305, 405 formed therefrom, and like or similar features are designated with like or similar reference numerals. The carrier 505 can be provided with one or more containers B as a package 510 (FIG. 14).

As shown, the blank 503 can have the longitudinal axis L1, the lateral axis L2, a front portion 507 for forming a front portion 506 of the carrier 505, a back portion 509 for forming a back portion 508 of the carrier 505, and a reinforcement portion 511 extending from the front portion 507 to the back portion 509 for forming a reinforcement portion 513 of the carrier 505 extending from the front portion 506 of the carrier 505 to the back portion 508 of the carrier 505 for reinforcing the carrier 505. The blank 503 and carrier 505 formed therefrom can include the panels 421, 423*a*, 423*b*, 427*a*, 427*b*, 431*a*, 431*b*, 435*a*, 435*b*, the attachment flaps 439*a*, 439*b*, and associated features, as shown.

The blank 503 and carrier 505 formed therefrom can also include the container retention openings 461 and container retention tabs 465, as shown. However, the attachment panel 421 of the blank 503/carrier 505 can at least partially define container retention openings 563 laterally positioned between respective container retention openings 461.

Each container retention opening 563, as shown in FIG. 13A, can have a generally circular configuration interrupted by laterally opposed and inwardly-extending generally V-shaped portions of the attachment panel 421, and a plurality of container retention tabs 565 can be foldably connected to the attachment panel 421 at respective curved fold lines 567 and positioned extending into the respective container retention opening 563.

Each container retention tab 565, as shown, can include a respective base portion 569 foldably connected to the attachment panel 421 at the respective fold line 567, and a respective distal portion 571 foldably connected to the respective base portion 569 at a respective oblique line of weakening 573.

In addition, the blank 503 and carrier 505 formed therefrom can have a dimension along the lateral axis L2 smaller than that of the blank 403/carrier 405, such that the blank 503 and carrier 505 can be devoid of the handle opening 490, handle reinforcement flaps 497*a*, 497*b*, and associated features. However, it will be understood that the blank 503 and carrier 505 formed therefrom can be configured and dimensioned so as to accommodate a desired number and arrangement of container B.

With additional reference to FIG. 14, the carrier 505 and package 510 can be formed from the blank 503 in a manner similar to that described above with respect to the formation of the carriers 105, 205, 305, 405 from the blanks 103, 203, 303, 403, to provide similar functionality and advantages.

Figure 15:
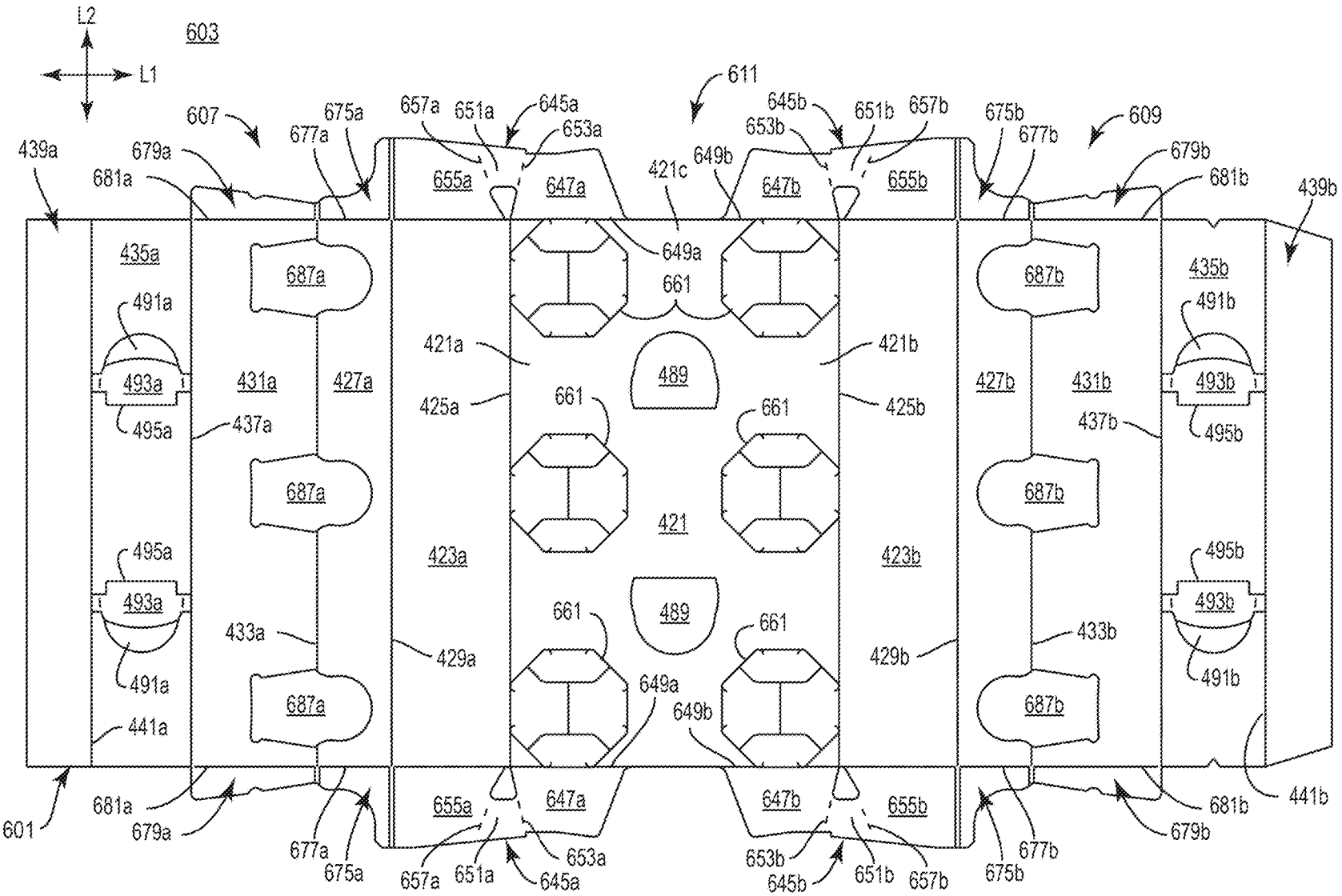
FIG. 15 is a plan view of an outer surface of a blank for forming a package and carrier according to a sixth exemplary embodiment of the disclosure.
Figure 15A:
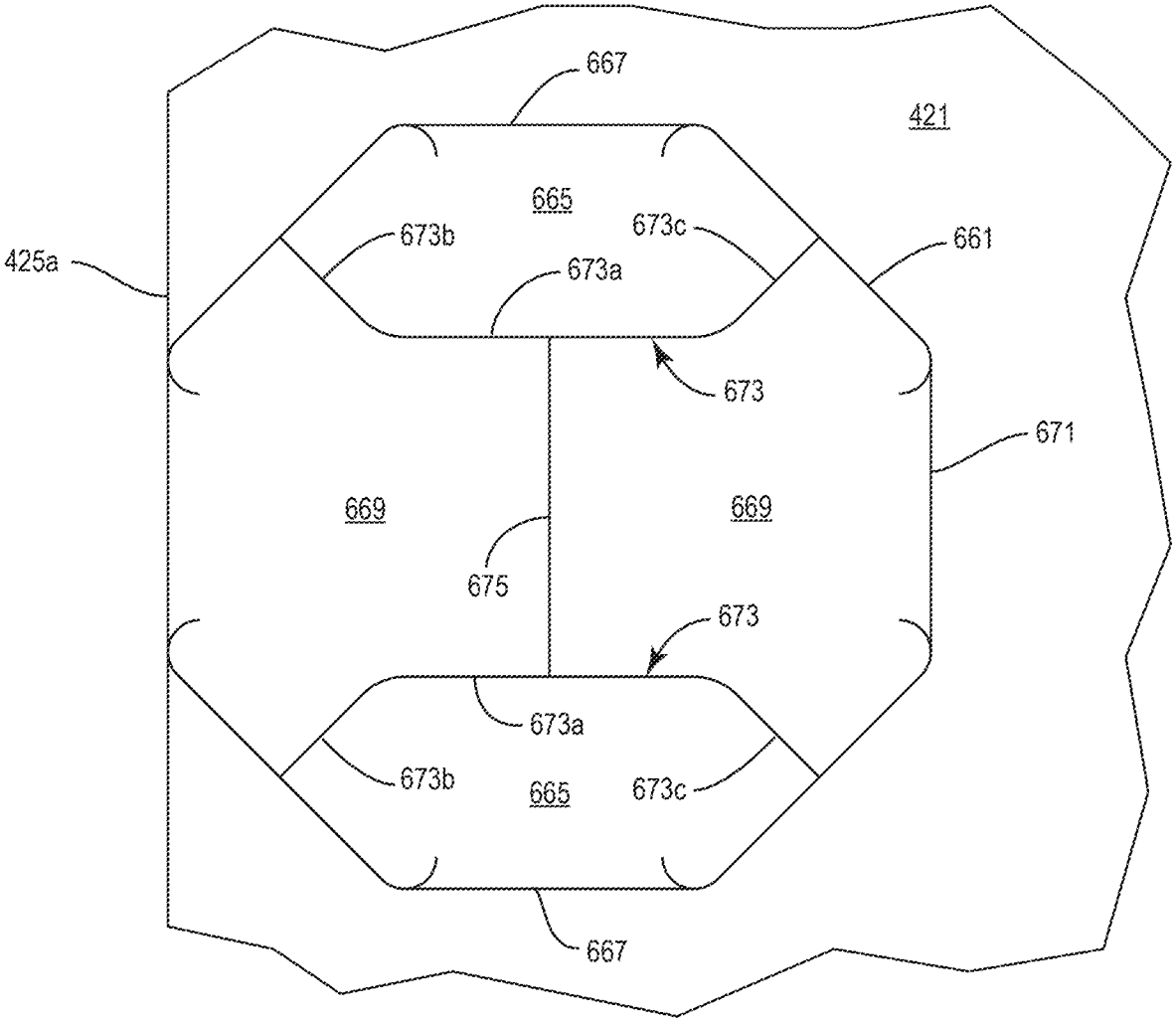
FIG. 15A is an enlarged view of a portion of the blank of FIG. 15.
Figure 16:
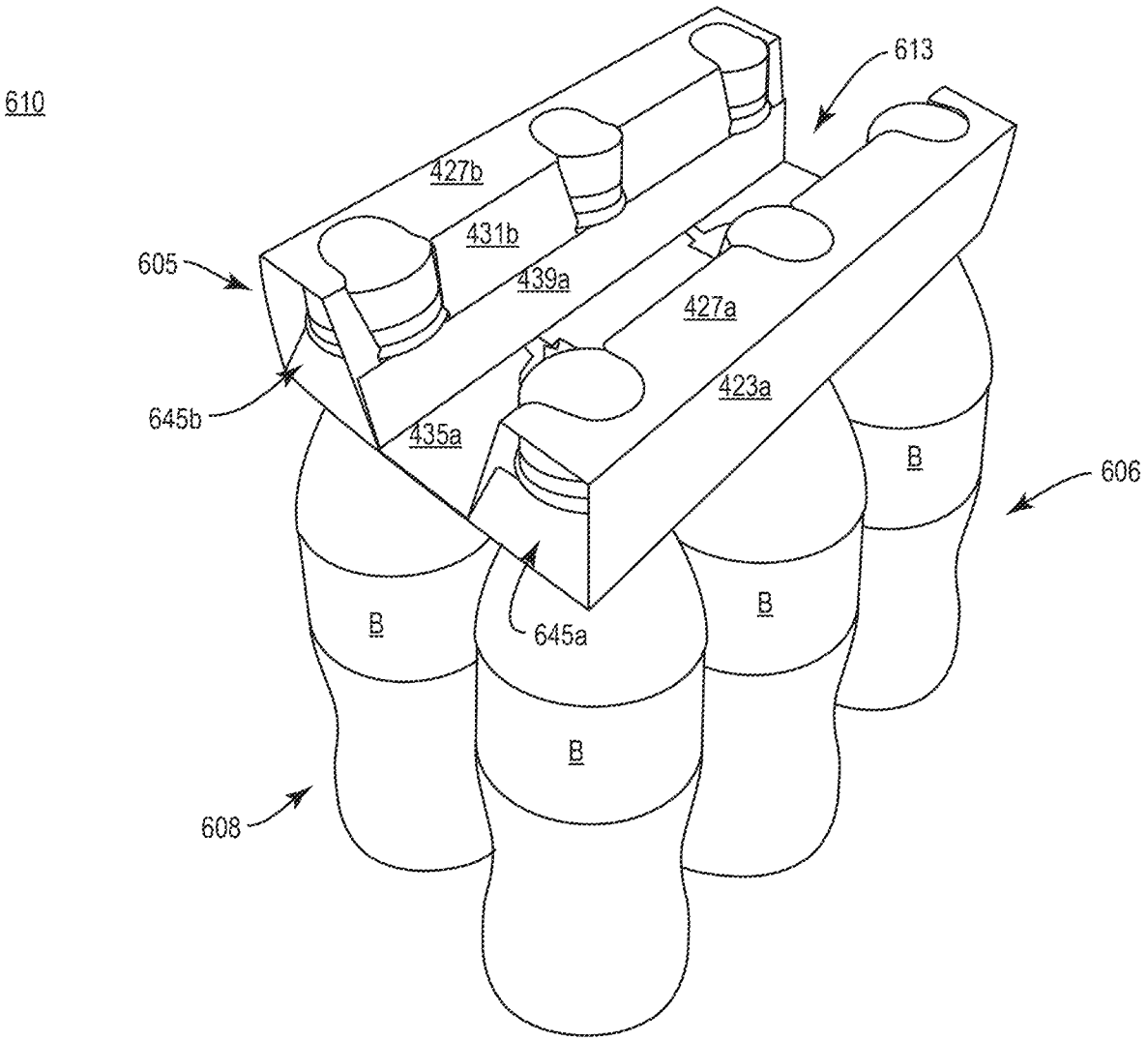
FIG. 16 is a perspective view of the package and carrier formed from the blank of FIG. 15 according to the sixth exemplary embodiment.

Turning to FIGS. 15 and 15A, an exterior surface 601 of a blank 603 for forming a carrier 605 (FIG. 16) according to a sixth exemplary embodiment of the disclosure is illustrated. The blank 603 and carrier 605 formed therefrom can have one or more features that are the same or similar to those described above with respect to the blanks 103, 203, 303, 403, 503 and carriers 105, 205, 305, 405, 505 formed therefrom, and like or similar features are designated with like or similar reference numerals. The carrier 605 can be provided with one or more containers B as a package 610 (FIG. 16).

As shown, the blank 603 can have the longitudinal axis L1, the lateral axis L2, a front portion 607 for forming a front portion 606 of the carrier 605, a back portion 609 for forming a back portion 608 of the carrier 605, and a reinforcement portion 611 extending from the front portion 607 to the back portion 609 for forming a reinforcement portion 613 of the carrier 605 extending from the front portion 606 of the carrier 605 to the back portion 608 of the carrier 605 for reinforcing the carrier 605. The blank 603 and carrier 605 formed therefrom can include the panels 421, 423*a*, 423*b*, 427*a*, 427*b*, 431*a*, 431*b*, 435*a*, 435*b*, the attachment flaps 439*a*, 439*b*, and associated features, as shown.

However, and as shown, the blank 603 can include a plurality of container retention openings 661 at least partially defined by the attachment panel 421, each container retention opening 661 having a generally octagonal-shaped profile.

A plurality of container retention tabs 665 can be foldably connected to the attachment panel 421 at respective longitudinal fold lines 667 and positioned extending into the respective container retention opening 661, and a plurality of container retention tabs 669 can be foldably connected to the attachment panel 421 at respective lateral fold lines 671 and positioned extending into the respective container retention opening 661.

However, and as shown, the laterally outermost container retention tabs 665 can be foldably connected to the attachment panel 421 at a respective portion of a respective fold line 649*a*, 649*b*, and the longitudinally outermost container retention tabs 665 can be foldably connected to the attachment panel 421 at respective portions of the respective fold lines 425*a*, 425*b*.

The pluralities of container retention tabs 665, 669 can be positioned extending into the respective container retention openings 661 such that the container retention tabs 665 are separable from adjacent container retention tabs 669 at a respective cut 673 having a longitudinal portion 673*a* and a pair of oblique portions 673*b*, 673*c* extending from the longitudinal portion 673*a* to the attachment panel 421. Adjacent container retention tabs 669 can be separable from one another at a lateral cut 675 that intersects the respective cuts 673.

In addition, the blank 603 and carrier 605/package 610 formed therefrom can include container retention openings 687*a*, 687*b* at least partially interrupting the respective fold lines 433*a*, 433*b* for at least partially receiving a respective portion of a respective container B of the plurality of containers B. As shown, the container retention openings 687*a*, 687*b* can have a generally boiling flask or keyhole-shaped configuration, though one or more of the container retention openings 687*a*, 687*b* can have a different configuration without departing from the disclosure.

The blank 603 and carrier 605 formed therefrom can also be devoid of the gussets 445*a*, 445*b*, but can instead include gussets 645*a*, 645*b* foldably connected to respective portions of the blank 603/carrier 605.

The gussets 645*a* can include an inner portion 647*a* foldably connected to the front portion 421*a* of the attachment panel 421 at a respective portion of the longitudinal fold line 649*a*, a central portion 651*a* foldably connected to the inner portion 647*a* at an oblique fold line 653*a*, and an outer portion 655*a* foldably connected to the outer front panel 423*a* at a respective portion of the fold line 649*a* and to the central portion 651*a* at an oblique fold line 657*a*.

Similarly, each gusset 645*b* can include an inner portion 647*a* foldably connected to the back portion 421*b* of the attachment panel 421 at a respective portion of a longitudinal fold line 649*b*, a central portion 651*b* foldably connected to the inner portion 647*b* at an oblique fold line 653*b*, and an outer portion 655*b* foldably connected to the inner back panel 431*b* at a respective portion of the fold line 649*b* and to the central portion 651*b* at an oblique fold line 657*b*.

Still referring to FIGS. 15 and 15A, the blank 603 and carrier 605 formed therefrom can include a pair of container reinforcement flaps 675*a* foldably connected to the front top panel 427*a* at a respective longitudinal fold line 677*a*, and a pair of container retention flaps 679*a* foldably connected to the inner front panel 431*a* at respective longitudinal fold lines 681*a*.

Similarly, a pair of container reinforcement flaps 675*b* can be foldably connected to the back top panel 427*b* at a respective longitudinal fold line 677*b*, and a pair of container retention flaps 679*b* can be foldably connected to the outer front panel 431*b* at respective longitudinal fold lines 681*b*.

Turning to FIG. 16, the blank 603 can be inverted such that the exterior surface 601 of the blank 603 can be placed atop the containers B and such that the container retention openings 661 of the attachment panel 421 overlie the containers B. Further downward positioning of the attachment panel 421 over the plurality of containers B can activate one or more container retention features to engage respective containers B.

For example, as the attachment panel 421 is lowered or urged downwardly onto the containers B, the respective cap CP and flange F, and, in some embodiments, a portion of the respective neck N, can be at least partially received through the respective container retention openings 661. Such relative movement of the attachment panel 421 and the containers B can cause the respective container retention tabs 665, 669 to separate from one another at the respective cuts 673, 675 and to fold at least partially upwardly at the respective fold lines 667, 671, 425*a*, 425*b*, 649*a*, 649*b* toward the respective cap CP and/or flange F.

In such an arrangement, the respective container retention tabs 665, 669 can be positioned extending upwardly from the attachment panel 421 to a portion of the respective container B. In some embodiments, the respective container retention tabs 665, 669 can contact an underside of a respective flange F of a respective container B in a bracing arrangement.

The gussets 645*a*, 645*b* can be activated, with the inner portion 647*a* of the gussets 645*a* folded upwardly at the respective portion of the fold line 649*a*, the central portion 651*a* folded relative to the inner portion 647*a* at the fold line 653*a* and/or relative to the outer portion 655*a* at the fold line 657*a*, and the outer portion 655*a* folded at least partially upwardly at the respective portion of the fold line 649*a*.

Similarly, the inner portions 647*b* of the gussets 645*b* can be folded upwardly at the respective portion of the fold lines 649*b*, the central portions 651*b* can be folded relative to the inner portion 647*b* at the fold line 653*b* and/or relative to the outer portion 655*b* at the fold line 657*b*, and the outer portion 655*b* can be folded at least partially upwardly at the respective portion of the fold line 649*b*. In this regard, the gussets 645*a* can be positioned between the front top panel 427*a* and the front portion 421*a* of the attachment panel 421, and the gussets 645*b* can be positioned between the back top panel 427*b* and the back portion 421*b* of the attachment panel 421.

In addition the respective container reinforcement flaps 675*a*, 675*b*, 679*a*, 679*b* can be folded at the respective fold lines 677*a*, 677*b*, 681*a*, 681*b* toward the respective panels 427*a*, 427*b*, 431*a*, 431*b*.

Simultaneously or thereafter, the outer front panel 423*a* and the outer back panel 423*b* can be folded upwardly relative to the attachment panel 421 at the respective fold lines 425*a*, 425*b*.

The top panel 427*b* can be folded at the fold line 429*b* into generally parallel and spaced relation with the attachment panel 421 so as to overlie the caps CP of respective containers B, and the inner panel 431*b* can be folded at the fold line 433*b* toward the attachment panel 421.

The reinforcement panel 435*b* can be positioned to lie in overlapping and generally parallel relation with the attachment panel 421, and the attachment flap 439*b* can be folded at the fold line 441*b* to extend at least partially obliquely upwardly relative to the reinforcement panel 435*b*. In such an arrangement, the inner panel 431*b* is also positioned extending at least partially obliquely upwardly away from the reinforcement panel 435*b*.

Similarly, the top panel 427*a* can be folded at the fold line 429*a* into generally parallel and spaced relation with the attachment panel 421 so as to overlie the caps CP of respective containers B, and the inner front panel 431*a* can be folded at the fold line 433*a* toward the attachment panel 421. In such an arrangement, the inner front panel 431*a* can at least partially overlie the attachment flap 439*b*.

The reinforcement panel 435*a* can be positioned to lie in overlapping and generally parallel relation with the reinforcement panel 435*b*, and the attachment flap 439*a* can be folded at the fold line 441*a* to extend at least partially obliquely upwardly relative to the reinforcement panel 435*a* to at least partially overlie the inner back panel 431*b*. The inner front panel 431*a* is also positioned extending at least partially obliquely upwardly away from the reinforcement panel 435*a*.

In some embodiments, the reinforcement panel 435*a* can be positioned in at least partial face-to-face contact with the attachment panel 421 and with the reinforcement panel 435*b* in at least partial face-to-face contact and overlying the reinforcement panel 435*a*.

Such arrangement of the panels 423*a*, 427*a*, 431*a* can be in an at least partially enclosing arrangement around the caps CP, flanges F, and upper portions of the respective necks N of respective containers B in the front portion 606 of the carrier 605, and such arrangement of the panels 423*b*, 427*b*, 431*b* can be in an at least partially enclosing arrangement around the caps CP, flanges F, and upper portions of the respective necks N of respective containers B of the back portion 608 of the carrier 605. The geometry and presence of the respective gussets 645*a*, 645*b* and container reinforcement flaps 675*a*, 675*b*, 679*a*, 679*b* within such enclosed portions can, for example, take up empty space and/or provide a tighter engagement of the carrier 605 with the containers B.

Such arrangement of the panels 423*a*, 427*a* can further position the respective container retention openings 687*a* to receive a respective portion of a respective container B therethrough, e.g., a cap CP and flange F thereof. Similarly, the panels 423*b*, 427*b* can be positioned such that the respective container retention openings 687*b* at least partially receive a respective portion of a respective container B therethrough.

The formed carrier 605 and package 610 including the containers B provides the front portion 606 and back portion 608 thereof, with the reinforcement portion 611 formed by the respective portion 421*c* of the attachment panel 421 and the respective reinforcement panels 435*a*, 435*b* overlapping the attachment panel 421 and extending from the front portion 606 to the back portion 608 between respective containers B. Such an arrangement provides reinforcement to the carrier 605 in the course of movement or other loading, e.g., transportation, storage, carrying, incidental to use, etc. In this regard, the arrangement of reinforcement portion 611 of the attachment panel 421 provides the carrier 605 with an increased capacity to minimize, inhibit, avoid, prevent, and/or otherwise resist bending, bowing, flexing, buckling, curling, deflection, and/or other deformation.

The package 610/carrier 605 described above has a compact structure that can, for example, provide materials savings and waste reduction. Additionally, the positioning of the reinforcement portion 611 of the attachment panel 421/reinforcement portion 613 between the front portion 606 and the back portion 608 of the carrier 605 results in a robust structure for holding and carrying the containers B. Further, the exposure of one or more portions of the containers B on exterior portions of the carrier 605/package 610 provides a consumer with a clear view of labeling or surface graphics associated with the containers B as well as providing convenient access to remove one or more of the containers B from the carrier 605/package 610. Such an arrangement provides advantages similar to those described above with respect to the carriers 105, 205, 305, 405, 505/packages 110, 210, 310, 410, 510.

Figure 17:
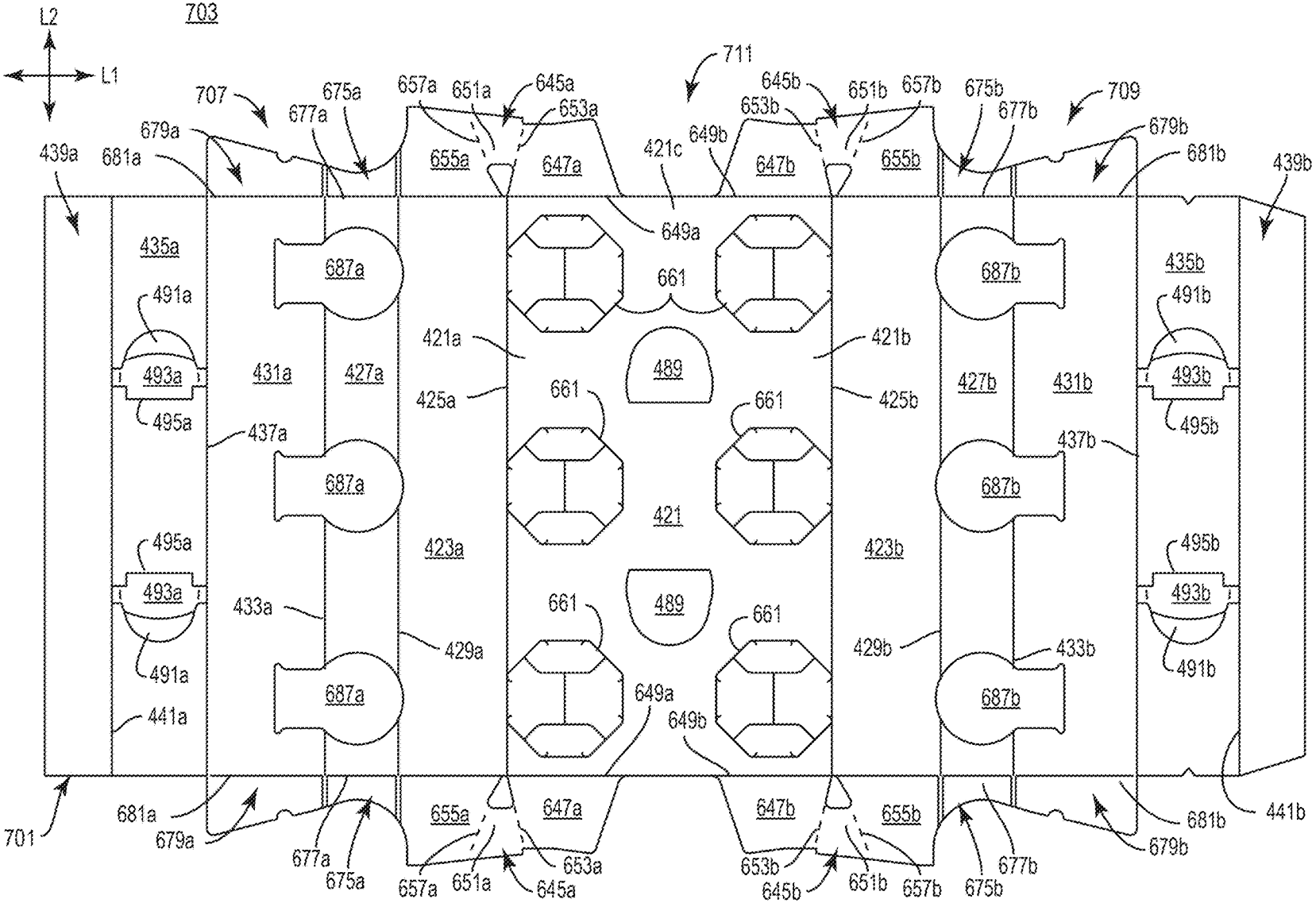
FIG. 17 is a plan view of an outer surface of a blank for forming a package and carrier according to a seventh exemplary embodiment of the disclosure.
Figure 18:
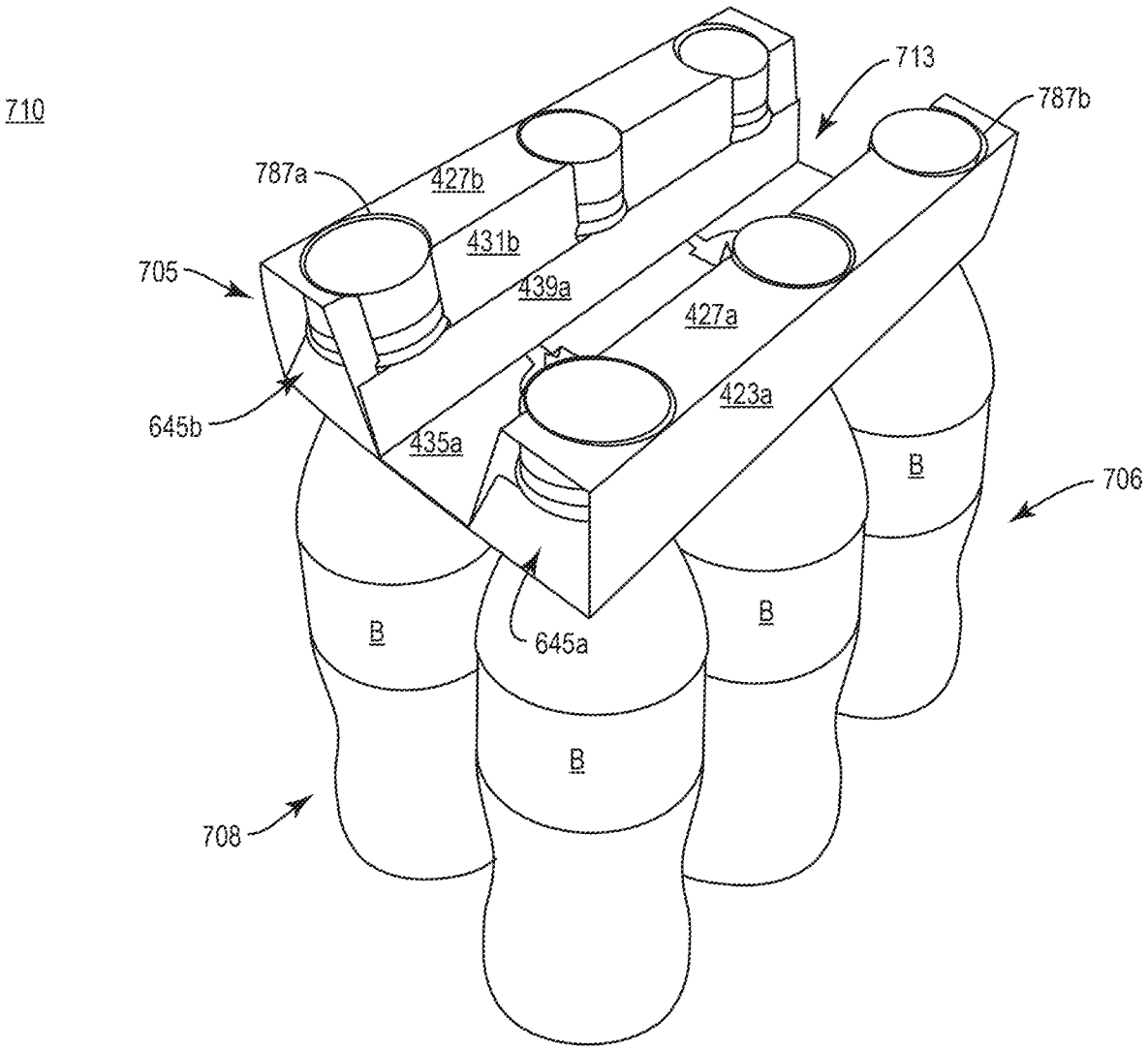
FIG. 18 is a perspective view of the package and carrier formed from the blank of FIG. 17 according to the seventh exemplary embodiment.

Turning to FIG. 17, an exterior surface 701 of a blank 703 for forming a carrier 705 (FIG. 18) according to a seventh exemplary embodiment of the disclosure is illustrated. The blank 703 and carrier 705 formed therefrom can have one or more features that are the same or similar to those described above with respect to the blanks 103, 203, 303, 405, 503, 603 and carriers 205, 305, 405, 505, 605 formed therefrom, and like or similar features are designated with like or similar reference numerals. The carrier 705 can be provided with one or more containers B as a package 710 (FIG. 18).

As shown, the blank 703 can be generally similar to the blank 603 described above, and has a front portion 707 for forming a front portion 706 of the carrier 705, a back portion 709 for forming a back portion 708 of the carrier 705, and a reinforcement portion 711 for forming a reinforcement portion 713 of the carrier 705 extending from the front portion 706 of the carrier 705 to the back portion 708 of the carrier 705 for reinforcing the carrier 705.

However, the container retention features of the blank 703 and carrier 705 formed therefrom can include container retention openings 787*a*, 787*b* interrupting the respective fold lines 433*a*, 433*b* for at least partially receiving respective containers B of the plurality of containers B.

As shown, the respective container retention openings 787*a*, 787*b* can each have a respective base portion at least partially between the respective fold lines 429*a*, 433*a* and fold lines 429*b*, 433*b*, and a generally square or rectangular distal portion extending away from the respective base portion.

With additional reference to FIG. 18, the carrier 705 and package 710 can be formed from the blank 703 in a manner generally similar to that described above with respect to the formation of the carrier 605 and package 610 from the blank 603, with similar advantages and functionality.

As shown, the carrier 705 and package 710 is configured and arranged such that at least the cap CP and flange F of the respective containers B can be at least partially received through the respective container retention openings 787*a*, 787*b*. In some embodiments, the base portion of the respective container retention openings 787*a*, 787*b* is configured to at least partially approximate and expose the respective caps CP of the respective containers B, and the respective distal portions of the respective container retention openings 787*a*, 787*b* is such to underlie and/or at least partially engage the respective flanges F of the respective containers C.

Such an arrangement of the container retention openings 787*a*, 787*b* about the respective containers B can be such that a desired amount of exposure of the containers B can be afforded, e.g., for product inspection, to display printed, textured, and/or colored surface information on the containers B, while further enhancing the engagement between the carrier 705 and the respective contains B.

Figure 19:
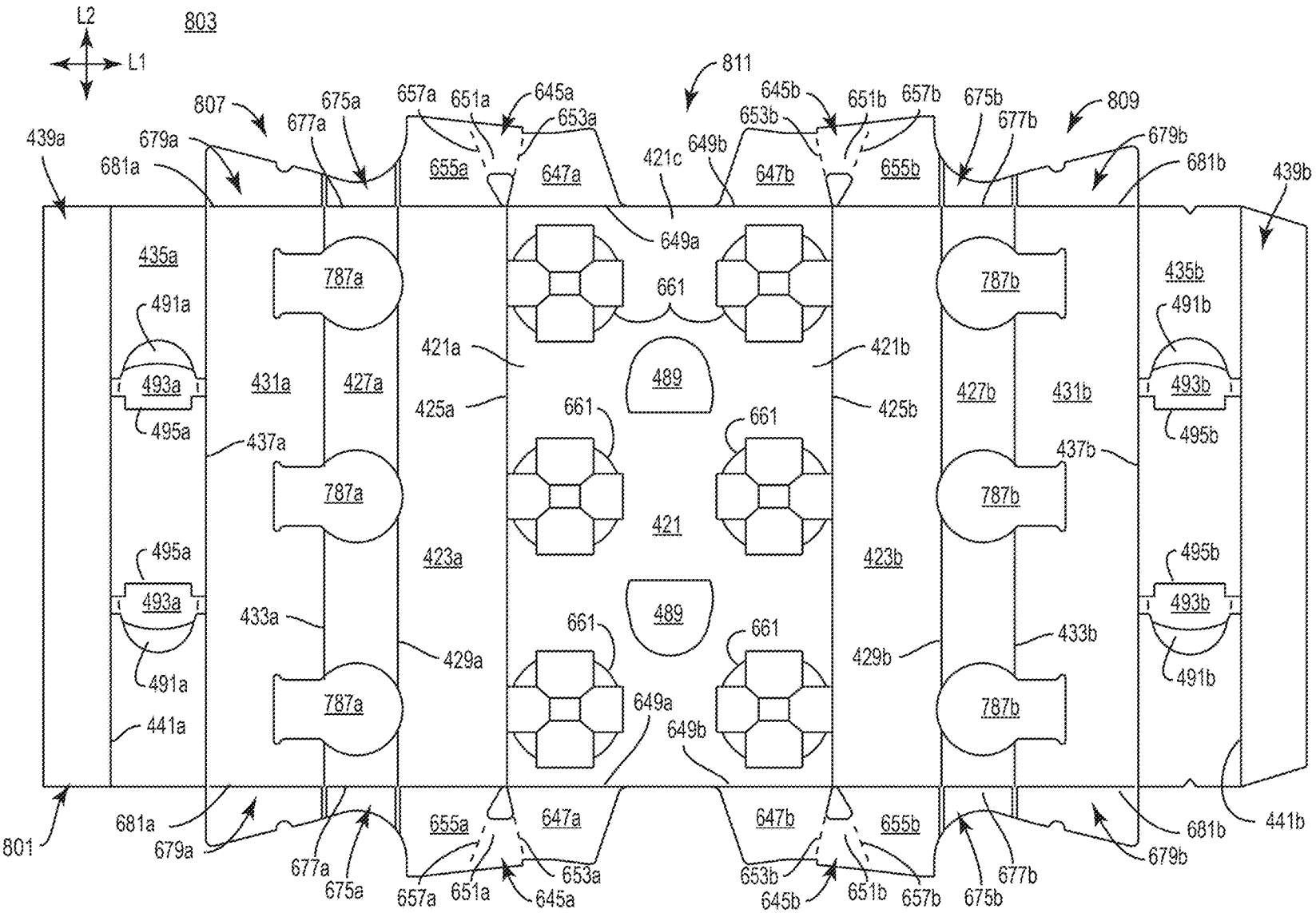
FIG. 19 is a plan view of an outer surface of a blank for forming a package and carrier according to an eighth exemplary embodiment of the disclosure.
Figure 20:
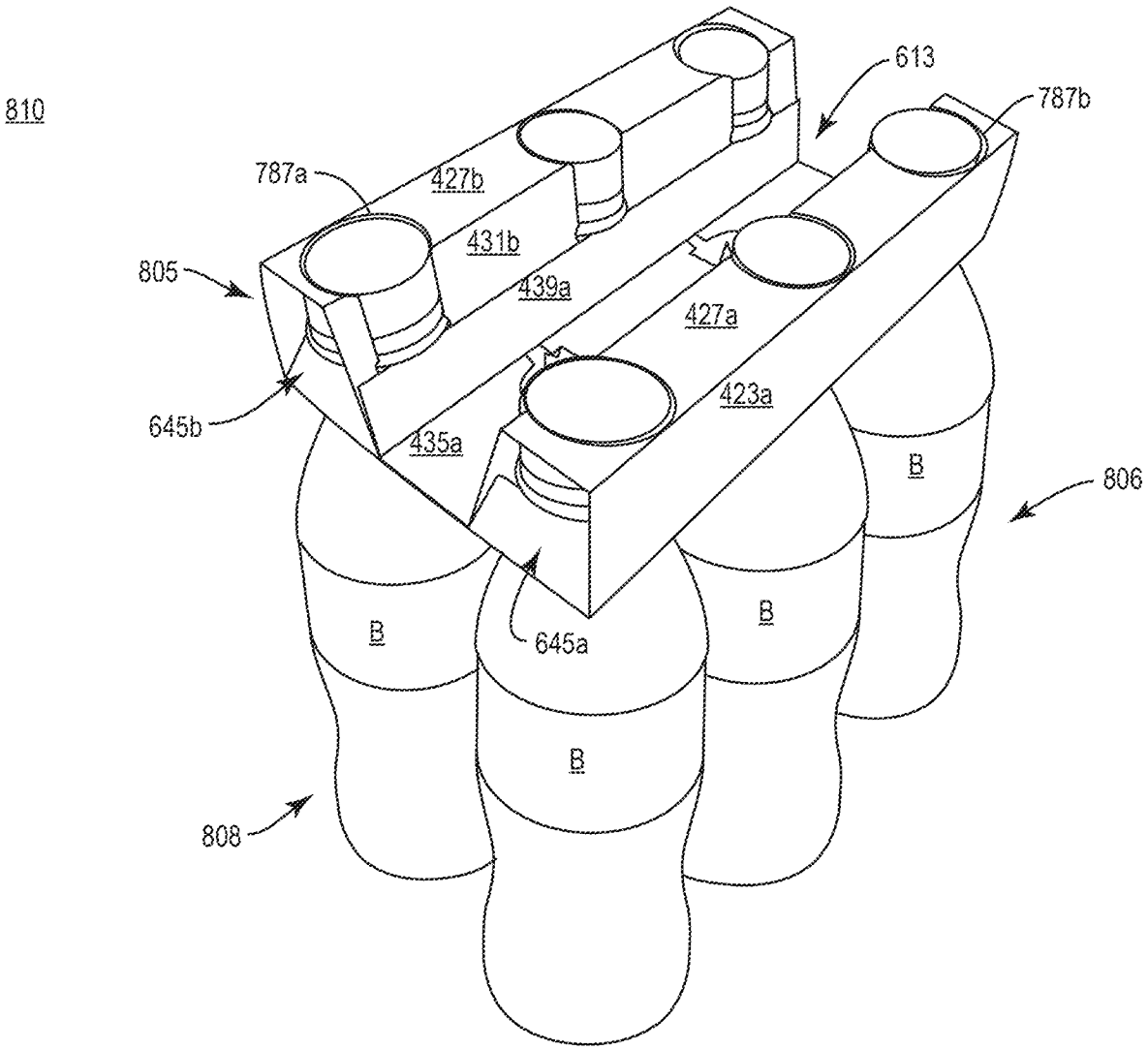
FIG. 20 is a perspective view of the package and carrier formed from the blank of FIG. 19 according to the eighth exemplary embodiment.

Turning to FIG. 19, an exterior surface 801 of a blank 803 for forming a carrier 805 (FIG. 20) according to an eighth exemplary embodiment of the disclosure is illustrated. The blank 803 and carrier 805 formed therefrom can have one or more features that are the same or similar to those described above with respect to the blanks 103, 203, 303, 405, 503, 603, 703 and carriers 205, 305, 405, 505, 605, 705 formed therefrom, and like or similar features are designated with like or similar reference numerals. The carrier 805 can be provided with one or more containers B as a package 810 (FIG. 20).

As shown, the blank 803 can be generally similar to the blank 703 described above, and has a front portion 807 for forming a front portion 806 of the carrier 805, a back portion 809 for forming a back portion 808 of the carrier 805, and a reinforcement portion 811 for forming a reinforcement portion 813 of the carrier 805 extending from the front portion 806 of the carrier 805 to the back portion 808 of the carrier 805 for reinforcing the carrier 805.

Figure 19A:
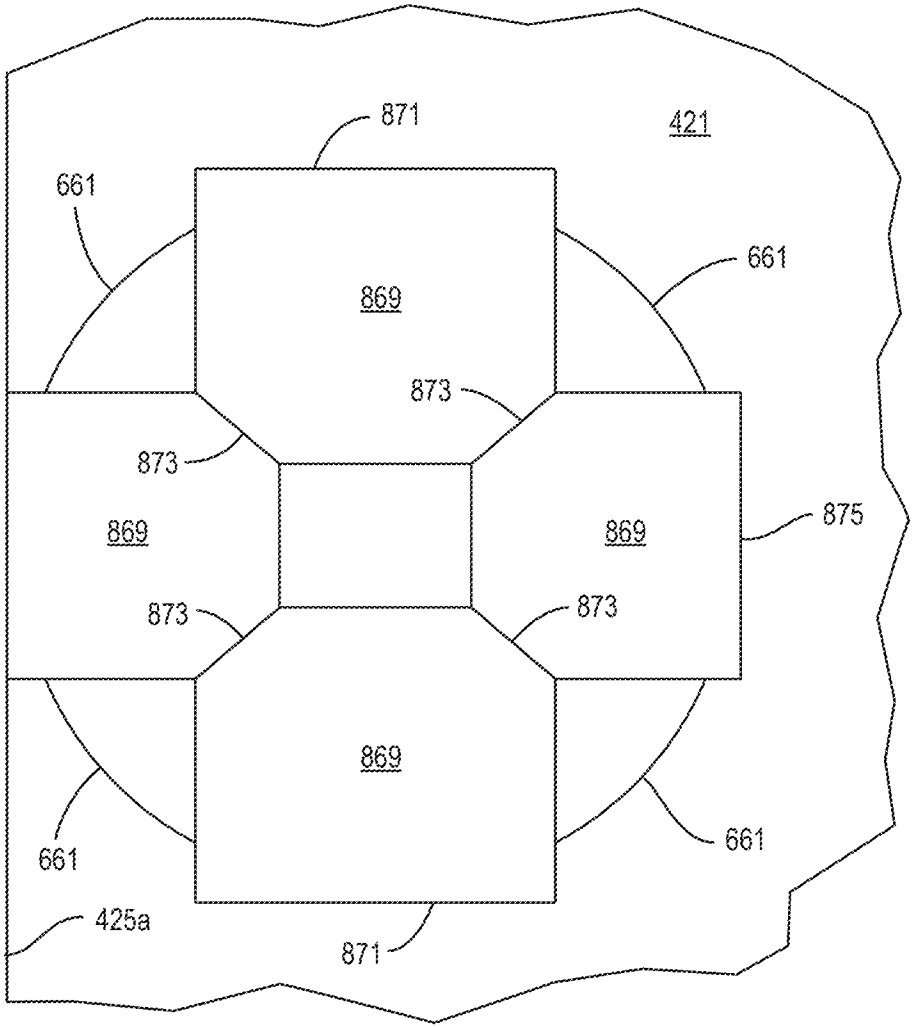
FIG. 19A is an enlarged view of a portion of the blank of FIG. 19.

As shown in FIG. 19A, the blank 803 and carrier 805 formed therefrom can include the respective container retention openings 661, and a plurality of container retention tabs 869 positioned extending into the respective container retention openings 661. In the illustrated embodiment, a pair of laterally opposed container retention tabs 869 can be foldably connected to the attachment panel 421 at a respective longitudinal fold line 871 and positioned extending into each respective container retention opening 661, and a pair of longitudinally opposed container retention tabs 869 can be positioned extending into each respective container retention opening 661, with adjacent container retention tabs 869 in each respective container retention openings 661 at least partially separable at a respective oblique cut 873.

The longitudinally outermost container retention tabs 869 can be foldably connected to the attachment panel at respective portions of the respective fold line 425*a*, 425*b*, and the longitudinally innermost container retention tabs 869 can be foldably connected to the attachment panel 421 at respective lateral fold lines 875.

With additional reference to FIG. 20, the carrier 805 and package 810 can be formed from the blank 803 in a manner generally similar to that described above with respect to the formation of the carrier 705 and package 710 from the blank 703, with similar advantages and functionality.

Figure 21:
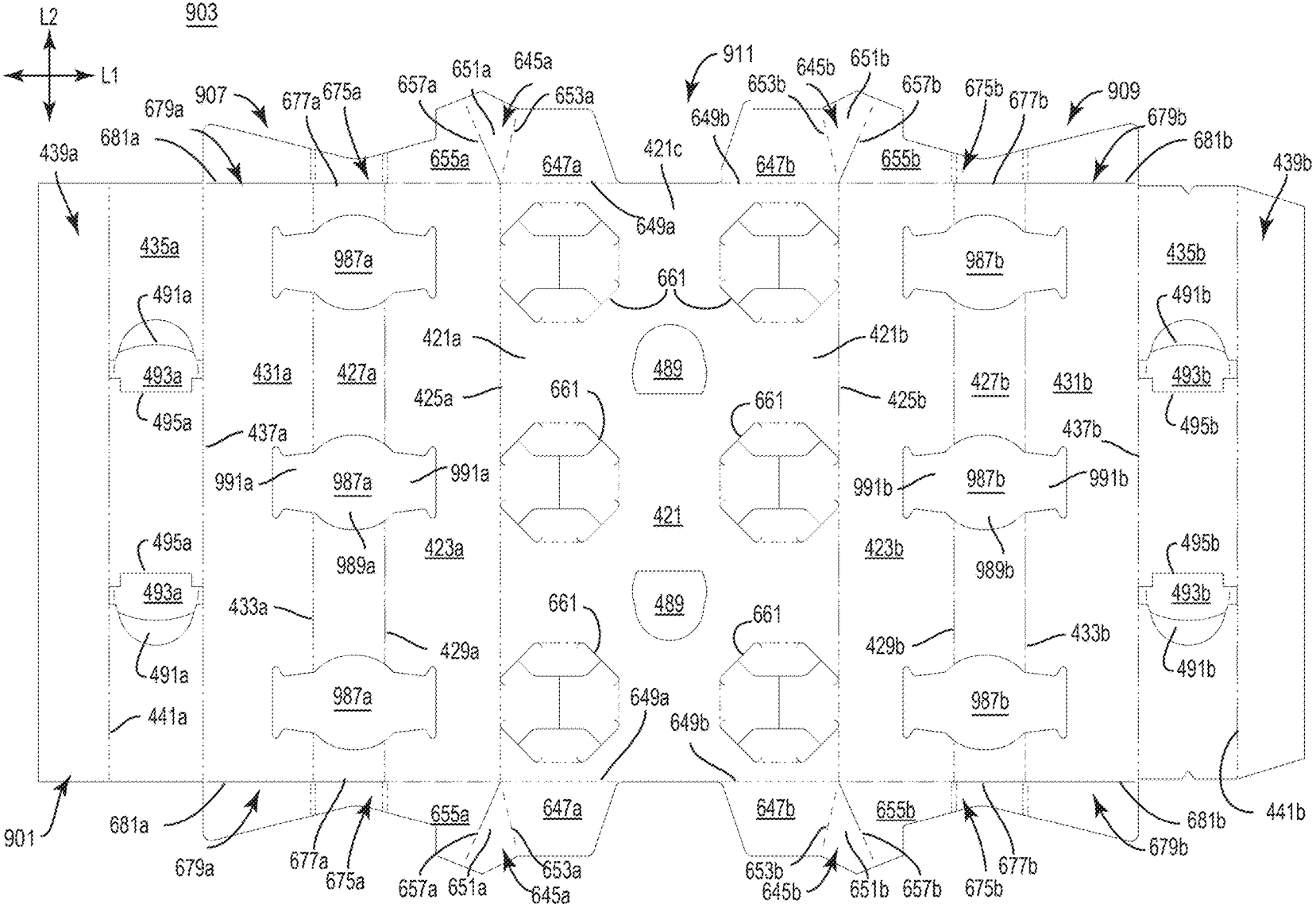
FIG. 21 is a plan view of an outer surface of a blank for forming a package and carrier according to a ninth exemplary embodiment of the disclosure.

Turning to FIG. 21, an exterior surface 901 of a blank 903 for forming a carrier according to a ninth exemplary embodiment of the disclosure is illustrated. The blank 903 and carrier formed therefrom can have one or more features that are the same or similar to those described above with respect to the blanks 103, 203, 303, 405, 503, 603, 703, 803 and carriers 205, 305, 405, 505, 605, 705, 805 formed therefrom, and like or similar features are designated with like or similar reference numerals. The carrier formed from the blank 903 can be provided with one or more containers B as a package.

As shown, the blank 903 can be generally similar to the blank 703 described above, and has a front portion 907 for forming a front portion of a carrier, a back portion 909 for forming a back portion of carrier, and a reinforcement portion 911 for forming a reinforcement portion of the carrier extending from the front portion of the carrier formed from the blank 903 to the back portion of the carrier formed from the blank 903 for reinforcing the carrier.

The blank 903 and carrier formed therefrom can include the respective container retention openings 987*a* at least partially defined in the front top panel 427*a* and interrupting the fold lines 429*a*, 433*a* so as to extend at least partially into the outer front panel 423*a* and the inner front panel 431*a*.

Each container retention opening 987*a*, as shown, can have a generally bowtie-like configuration, with a generally circular central portion 989*a* proximate the front top panel 427*a* and a pair of generally boiling flask or keyhole-shaped portions 991*a* extending into the respective panels 429*a*, 433*a*. In some embodiments, the portions 991*a* of the container retention openings 987*a* can have generally tapering edges configured and dimensioned to engage a portion of a respective container B therethrough when a carrier/package is formed from the blank 903. For example, in some embodiments, the portions 991*a* of the container retention openings 987*a* defined by the respective adjacent panels 429*a*, 433*a* can be configured and dimensioned for frictional and/or interfering contact with one or more ribs or knurls formed on an outer surface of the cap CP of a respective container B of the plurality of containers B. Such contact can, for example, maintain a rotational position of a respective container B along a carrier and package formed from the blank 903, for example, so as to maintain a desired orientation of surface graphics or labeling for viewing by a customer.

Similarly, each container retention opening 987*b*, can have a generally bowtie-like configuration, with a generally circular central portion 989*b* proximate the back top panel 427*b* and a pair of generally boiling flask or keyhole-shaped portions 991*b* extending into the respective panels 429*b*, 433*b*. In some embodiments, the portions 991*b* of the container retention openings 987*b* can have generally tapering edges configured and dimensioned to engage a portion of a respective container B therethrough when a carrier/package is formed from the blank 903. For example, in some embodiments, the portions 991*b* of the container retention openings 987*b* defined by the respective adjacent panels 429*b*, 433*b* can be configured and dimensioned for frictional and/or interfering engagement with one or more ribs or knurls formed on an outer surface of the cap CP of a respective container B of the plurality of containers B.

A carrier and package can be formed from the blank 903 in a manner generally similar to that described above with respect to the formation of the carrier 705 and package 710 from the blank 703, with similar advantages and functionality.

Figure 22:
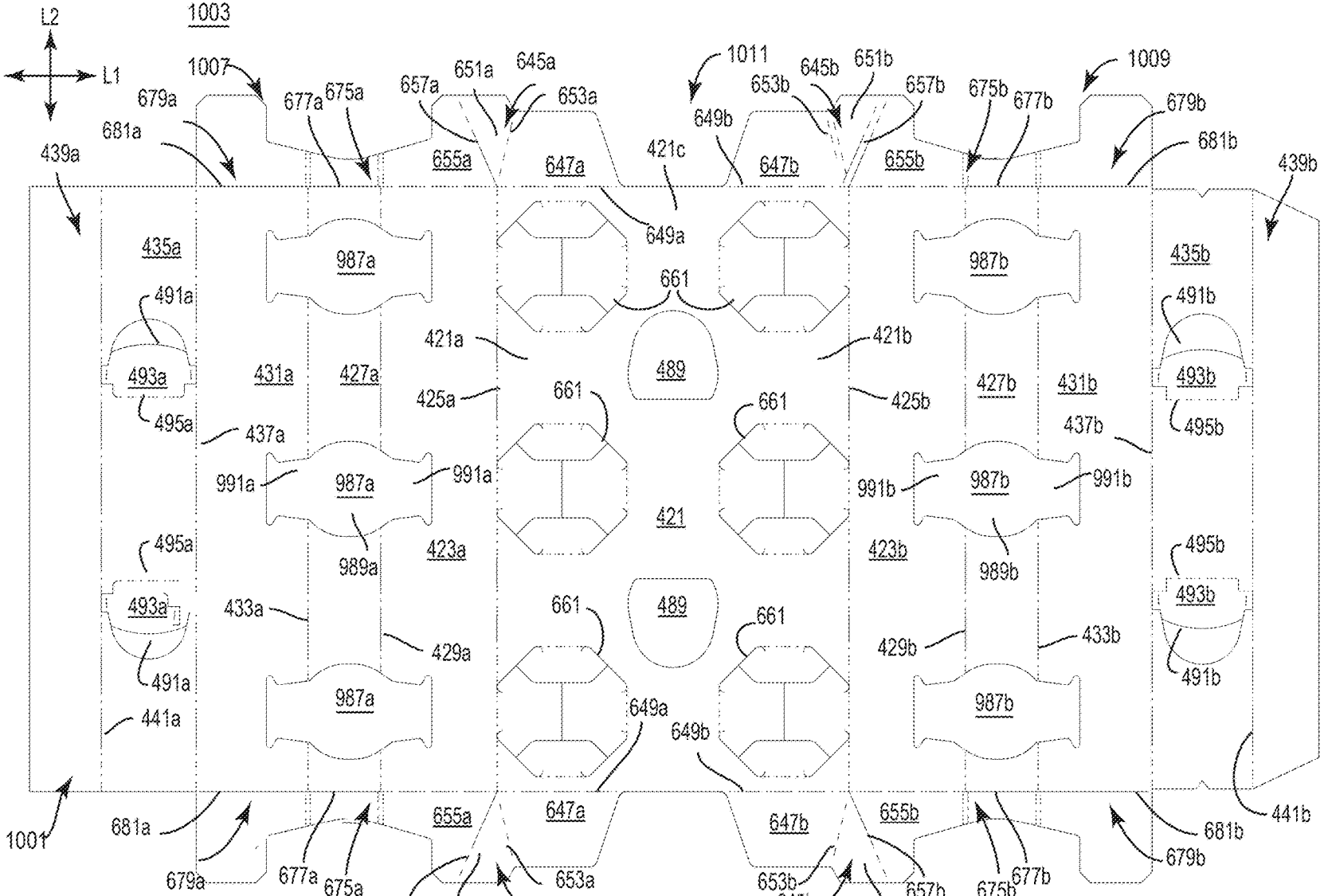
FIG. 22 is a plan view of an outer surface of a blank for forming a package and carrier according to a tenth exemplary embodiment of the disclosure.

Turning to FIG. 22, an exterior surface 1001 of a blank 1003 for forming a carrier according to a tenth exemplary embodiment of the disclosure is illustrated. The blank 1003 and carrier formed therefrom can have one or more features that are the same or similar to those described above with respect to the blanks 103, 203, 303, 405, 503, 603, 703, 803, 903 and carriers 205, 305, 405, 505, 605, 705, 805, 905 formed therefrom, and like or similar features are designated with like or similar reference numerals. The carrier formed from the blank 1003 can be provided with one or more containers B as a package.

As shown, the blank 1003 can be generally similar to the blank 903 described above, and has a front portion 1007 for forming a front portion of a carrier, a back portion 1009 for forming a back portion of carrier, and a reinforcement portion 1011 for forming a reinforcement portion of the carrier extending from the front portion of the carrier formed from the blank 1003 to the back portion of the carrier formed from the blank 1003 for reinforcing the carrier.

A carrier and package can be formed from the blank 1003 in a manner generally similar to that described above with respect to the formation of the carrier 705 and package 710 from the blank 703, with similar advantages and functionality.

It will be understood that the blanks and carriers described herein can be provided in different configurations without departing from the disclosure. For example, the blanks and carriers described herein can be sized and provided with a corresponding number of features suitable to engage a desired number and configuration of containers.

In general, the blank may be constructed from paperboard having a caliper so that it is heavier and more rigid than ordinary paper. The blank can also be constructed of other materials, such as cardboard, or any other material having properties suitable for enabling the carrier to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding thereal-ong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carrier panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprising:

a front portion, a back portion, and a reinforcement portion extending from the front portion to the back portion;

a plurality of panels comprising a central attachment panel, an outer panel extending upwardly from the central attachment panel, a top panel extending from the outer panel, an inner panel extending at least partially downwardly from the top panel, and a reinforcement panel at least partially overlapping the central attachment panel, the inner panel extends obliquely downwardly from the top panel, the front portion of the carrier comprises a front portion of the central attachment panel, the back portion of the carrier comprises a back portion of the central attachment panel, and the reinforcement portion of the carrier comprises a reinforcement portion of the central attachment panel and the reinforcement panel;

an attachment flap extending obliquely upwardly from the reinforcement panel, the attachment flap is positioned for extending to a portion of at least one container of the plurality of containers; and container retention features comprising a plurality of container retention openings at least partially defined in the inner panel for at least partially receiving a respective container of the plurality of containers and a plurality of container retention openings at least partially defined in the central attachment panel for at least partially receiving a respective container of the plurality of containers, the container retention features further comprise a plurality of container retention tabs foldably connected to the central attachment panel and positioned extending into a respective container retention opening in the central attachment panel for engaging a respective container of the plurality of containers, the outer panel, the top panel, and the inner panel are positioned to at least partially enclose an upper portion of at least one container of the plurality of containers.

2. The carrier of claim 1, wherein the outer panel is one of a front outer panel and a back outer panel of a respective one of the front portion of the carrier and the back portion of the carrier, the top panel is one a front top panel and a back top panel of a respective one of the front portion of the carrier and the back portion of the carrier, the inner panel is one of a front inner panel and a back inner panel of a respective one of the front portion of the carrier and the back portion of the carrier, the reinforcement panel is one of a front reinforcement panel and a back reinforcement panel of a respective one of the front portion of the carrier and the back portion of the carrier, the attachment flap is one of a front attachment flap and a back attachment flap of a respective one of the front portion of the carrier and the back portion of the carrier, the one of the front attachment flap and the back attachment flap at least partially overlaps the other of the front portion of the carrier and the back portion of the carrier.

3. A blank for forming a carrier for holding a plurality of containers, the blank comprising:

a front portion, a back portion, and a reinforcement portion extending from the front portion to the back portion;

a plurality of panels comprising a central attachment panel, an outer panel for extending upwardly from the central attachment panel when the carrier is formed from the blank, a top panel extending from the outer panel, an inner panel for extending at least partially downwardly from the top panel when the carrier is formed from the blank, and a reinforcement panel for at least partially overlapping the central attachment panel when the carrier is formed from the blank, the inner panel is for extending obliquely downwardly from the top panel when the carrier is formed from the blank, the front portion of the blank comprises a front portion of the central attachment panel, the back portion of the blank comprises a back portion of the central attachment panel, and the reinforcement portion of the blank comprises a reinforcement portion of the central attachment panel and the reinforcement panel;

an attachment flap for extending obliquely upwardly from the reinforcement panel when the carrier is formed from the blank, the attachment flap is for being positioned for extending to a portion of at least one container of the plurality of containers when the carrier is formed from the blank; and container retention features comprising a plurality of container retention openings at least partially defined in the inner panel for at least partially receiving a respective container of the plurality of containers and a plurality of container retention openings at least partially defined in the central attachment panel for at least partially receiving a respective container of the plurality of containers, the container retention features further comprise a plurality of container retention tabs foldably connected to the central attachment panel and positioned extending into a respective container retention opening in the central attachment panel for engaging a respective container of the plurality of containers, the outer panel, the top panel, and the inner panel are for being positioned to at least partially enclose an upper portion of at least one container of the plurality of containers when the carrier is formed from the blank, the outer panel, the top panel, and the inner panel are for being positioned to at least partially enclose an upper portion of at least one container of the plurality of containers when the carrier is formed from the blank.

4. The blank of claim 3, wherein the outer panel is one of a front outer panel and a back outer panel of a respective one of the front portion of the blank and the back portion of the blank, the top panel is one a front top panel and a back top panel of a respective one of the front portion of the blank and the back portion of the blank, the inner panel is one of a front inner panel and a back inner panel of a respective one of the front portion of the blank and the back portion of the blank, the reinforcement panel is one of a front reinforcement panel and a back reinforcement panel of a respective one of the front portion of the blank and the back portion of the blank, the attachment flap is one of a front attachment flap and a back attachment flap of a respective one of the front portion of the blank and the back portion of the blank, the one of the front attachment flap and the back attachment flap at least partially overlaps the other of the front portion of the blank and the back portion of the blank.

5. A method of forming a carrier for holding a plurality of containers, the method comprising:

obtaining a blank, the blank comprises a front portion, a back portion, and a reinforcement portion extending from the front portion to the back portion, the blank comprising a plurality of panels comprising a central attachment panel, an outer panel, a top panel extending from the outer panel, an inner panel extending from the top panel, and a reinforcement panel, the blank further comprising an attachment flap, and container retention features comprising a plurality of container retention openings at least partially defined in the inner panel and a plurality of container retention openings at least partially defined in the central attachment panel, the container retention features further comprising a plurality of container retention tabs foldably connected to the central attachment panel and positioned extending into a respective container retention opening in the central attachment panel for engaging a respective container of the plurality of containers, the front portion of the blank comprises a front portion of the central attachment panel, the back portion of the blank comprises a back portion of the central attachment panel, and the reinforcement portion of the blank comprises a reinforcement portion of the central attachment panel and the reinforcement panel, the outer panel is one of a front outer panel and a back outer panel of a respective one of the front portion of the blank and the back portion of the blank, the top panel is one a front top panel and a back top panel of a respective one of the front portion of the blank and the back portion of the blank, the inner panel is one of a front inner panel and a back inner panel of a respective one of the front portion of the blank and the back portion of the blank, the reinforcement panel is one of a front reinforcement panel and a back reinforcement panel of a respective one of the front portion of the blank and the back portion of the blank, the attachment flap is one of a front attachment flap and a back attachment flap of a respective one of the front portion of the blank and the back portion of the blank;

forming a front portion of the carrier from the front portion of the blank;

forming a back portion of the carrier from the back portion of the blank;

forming a reinforcement portion of the carrier from the reinforcement portion of the blank;

positioning the central attachment panel for at least partially receiving a respective container of the plurality of containers;

positioning the one of the front outer panel and the back outer panel extending upwardly from the central attachment panel;

positioning the one of the front inner panel and the back inner panel extending obliquely downwardly from the one of the front top panel and the back top panel;

at least partially overlapping the one of the front reinforcement panel and the back reinforcement panel on the central attachment panel;

positioning the one of the front attachment flap and the back attachment flap extending obliquely upwardly from the one of the front reinforcement panel and the back reinforcement panel and for extending to a portion of at least one container of the plurality of containers, further comprising positioning the one of the front attachment flap and the back attachment flap at least partially overlapping the other of the front portion of the carrier and the back portion of the carrier; and positioning the one of the front outer panel and the back outer panel, the one of the front top panel and the back top panel, and the one of the front inner panel and the back inner panel to at least partially enclose an upper portion of at least one container of the plurality of containers.

6. A package, the package comprising:

a plurality of containers; and a carrier holding the plurality of containers, the carrier comprising:

a front portion, a back portion, and a reinforcement portion extending from the front portion to the back portion;

a plurality of panels comprising a central attachment panel, an outer panel extending upwardly from the central attachment panel, a top panel extending from the outer panel, an inner panel extending obliquely downwardly from the top panel, and a reinforcement panel at least partially overlapping the central attachment panel;

an attachment flap extending obliquely upwardly from the reinforcement panel and to a portion of at least one container of the plurality of containers; and container retention features comprising a plurality of container retention openings at least partially defined in the inner panel and at least partially receiving a respective container of the plurality of containers and a plurality of container retention openings at least partially defined in the central attachment panel and at least partially receiving a respective container of the plurality of containers, the container retention features further comprise a plurality of container retention tabs foldably connected to the attachment panel and positioned extending into a respective container retention opening in the central attachment panel and engaging a respective container of the plurality of containers, the outer panel, the top panel, and the inner panel are positioned at least partially enclosing an upper portion of at least one container of the plurality of containers, the front portion of the carrier comprises a front portion of the central attachment panel, the back portion of the carrier comprises a back portion of the central attachment panel, and the reinforcement portion of the carrier comprises a reinforcement portion of the central attachment panel and the reinforcement panel, the outer panel is one of a front outer panel and a back outer panel of a respective one of the front portion of the carrier and the back portion of the carrier, the top panel is one a front top panel and a back top panel of a respective one of the front portion of the carrier and the back portion of the carrier, the inner panel is one of a front inner panel and a back inner panel of a respective one of the front portion of the carrier and the back portion of the carrier, the reinforcement panel is one of a front reinforcement panel and a back reinforcement panel of a respective one of the front portion of the carrier and the back portion of the carrier, the attachment flap is one of a front attachment flap and a back attachment flap of a respective one of the front portion of the carrier and the back portion of the carrier, the one of the front attachment flap and the back attachment flap at least partially overlaps the other of the front portion of the carrier and the back portion of the carrier.

* * * * *